US010227679B2

(12) United States Patent
Yan et al.

(10) Patent No.: US 10,227,679 B2
(45) Date of Patent: Mar. 12, 2019

(54) HIGH PERFORMANCE ALSIMGCU CASTING ALLOY

(71) Applicant: ALCOA INC., Pittsburgh, PA (US)

(72) Inventors: Xinyan Yan, Murrysville, PA (US); Jen C. Lin, Export, PA (US)

(73) Assignee: ALCOA USA CORP., Pittsburgh, PA (US)

( * ) Notice: Subject to any disclaimer, the term of this patent is extended or adjusted under 35 U.S.C. 154(b) by 606 days.

(21) Appl. No.: 14/574,933

(22) Filed: Dec. 18, 2014

(65) Prior Publication Data

US 2017/0016092 A1 Jan. 19, 2017

Related U.S. Application Data

(63) Continuation of application No. PCT/US2014/070938, filed on Dec. 17, 2014.

(60) Provisional application No. 61/919,415, filed on Dec. 20, 2013.

(51) Int. Cl.

| | |
|---|---|
| ***C22C 21/02*** | (2006.01) |
| ***C22F 1/043*** | (2006.01) |
| ***B22D 17/02*** | (2006.01) |
| ***B22D 17/08*** | (2006.01) |
| ***B22D 21/00*** | (2006.01) |

(52) U.S. Cl.

CPC ..... *C22C 21/02* (2013.01); *B22D 17/02* (2013.01); *B22D 17/08* (2013.01); *B22D 21/007* (2013.01); *C22F 1/043* (2013.01)

(58) Field of Classification Search

CPC ..... C22C 21/02; C22C 21/04; C22F 1/043

See application file for complete search history.

(56) References Cited

U.S. PATENT DOCUMENTS

| | | | | |
|---|---|---|---|---|
| 1,921,195 | A | 8/1933 | Kempf | |
| 2,821,495 | A | 1/1958 | Dulin | 148/21.91 |
| 5,055,256 | A | 10/1991 | Sigworth et al. | |
| 5,846,347 | A | 12/1998 | Tanaka et al. | 148/439 |
| 5,879,478 | A | 3/1999 | Loue et al. | 148/438 |
| 6,364,970 | B1 | 4/2002 | Hielscher et al. | |
| 6,630,039 | B2 | 10/2003 | Lukasak et al. | 148/690 |
| 7,625,454 | B2 | 12/2009 | Lin et al. | 148/549 |

(Continued)

FOREIGN PATENT DOCUMENTS

| | | |
|---|---|---|
| CA | 2151884 | 12/1995 |
| CN | 102605226 | 7/2012 |

(Continued)

OTHER PUBLICATIONS

Teksid Aluminum "Specifica composizione chimica leghe di alluminio", Documento Del Sistema Qualita No. DLEGAD05, 4 pages, Aug. 28, 2007.

(Continued)

*Primary Examiner* — Lois L Zheng
(74) *Attorney, Agent, or Firm* — Greenberg Traurig, LLP

(57) ABSTRACT

New aluminum casting alloys having 8.5-9.5 wt. % silicon, 0.8-2.0 wt. % copper (Cu), 0.20-0.53 wt. % magnesium (Mg), and 0.35 to 0.8 wt. % manganese are disclosed. The alloy may be solution heat treated, treated in accordance with T5 tempering and/or artificially aged to produce castings, e.g., for cylinder heads and engine blocks. In one embodiment, the castings are made by high pressure die casting.

12 Claims, 35 Drawing Sheets

(56) References Cited

U.S. PATENT DOCUMENTS

| | | | | |
|---|---|---|---|---|
| 8,574,382 | B2 | 11/2013 | Dragulin et al. | 148/439 |
| 2003/0143102 | A1 | 7/2003 | Matsuoka et al. | 420/546 |
| 2003/0155049 | A1 | 8/2003 | Bergsma | 148/549 |
| 2004/0045638 | A1 | 3/2004 | Garat et al. | 148/417 |
| 2004/0261615 | A1 | 12/2004 | Yanagimoto et al. | 92/208 |
| 2005/0199318 | A1 | 9/2005 | Doty | 148/439 |
| 2009/0260724 | A1 | 10/2009 | Pandey | 148/550 |
| 2010/0006192 | A1 | 1/2010 | Okamoto | 148/691 |
| 2010/0047113 | A1 | 2/2010 | Lin et al. | 420/532 |
| 2012/0000578 | A1 | 1/2012 | Wang et al. | 148/549 |
| 2013/0105045 | A1 | 5/2013 | Yan et al. | 148/95 |
| 2015/0071815 | A1 | 3/2015 | Wiesner et al. | 420/532 |
| 2015/0129370 | A1 | 5/2015 | Shahani et al. | |

FOREIGN PATENT DOCUMENTS

| | | | | |
|---|---|---|---|---|
| DE | 19524564 | | 1/1997 | |
| JP | 56-163234 | | 12/1981 | |
| JP | 57-79140 | | 5/1982 | |
| JP | 62-149839 | | 7/1987 | |
| JP | H02-261025 | | 3/1990 | |
| JP | H05-179383 | | 7/1993 | |
| JP | H08-035030 | | 2/1996 | |
| JP | H10-158771 | | 6/1998 | |
| JP | 2001-073056 | | 3/2001 | |
| JP | 2001-262262 | | 9/2001 | |
| JP | 2002-47526 | | 2/2002 | |
| JP | 2006-241531 | * | 9/2006 | C22C 21/02 |
| JP | 2007-048643 | | 2/2007 | |
| JP | 2009-127122 | | 6/2009 | |
| RU | 2310695 | * | 11/2007 | C22F 1/04 |
| WO | WO00/717742 | | 11/2000 | |
| WO | WO2005/075692 | | 8/2005 | |

OTHER PUBLICATIONS

Department of Defense Handbook MIL-HDBK-5J "Metallic Materials and Elements for Aerospace Vehicle Structures", pp. 3-496-3-497, Jan. 31, 2003.

EFunda: Properties of Aluminum Alloy 354.0, Ornamental Accessories, retrieved from the Internet at http://www.efunda.com/materials/alloys/aluminum/show_aluminum.cfm?ID=AA_354.0&show_prop=all&Page_Title=354.0 pp. 1-2, on Oct. 9, 2014.

ASM Specialty Handbook: Aluminum and Aluminum Alloys, "Foundry Products" pp. 88-120, J.R. Davis Ed., 1993, ASM International, Materials Park, OH.

Metals Handbook, "Properties of Aluminum Casting Alloys", pp. 838-839, Taylor Lyman Ed., The American Society for Metals, Cleveland, OH, 1948.

Registration Record Series "Designations and Chemical composition Limits for Aluminum Alloys in the Form of Castings and Ingot", pp. 1-9, Apr. 2002, The Aluminum Association, Washington, DC.

ASM Handbook, formerly 9$^{th}$ Edition, Metals Handbook, vol. 15, "Casting", ASM International, ISBN 0-87170-007-7, pp. 332-334, 744-746, 754, 757-759, 767, 1988.

ASM Material Data Sheet, ASM Aerospace Specification Metals Inc., retrieved from the internet at http://asm.matweb.com/search/Specific.Material.asp?bassnum=MA7075T6, 2 pages, on Feb. 26, 2014.

International Standard ISO 3522, 3$^{rd}$ Edition, "Aluminium and aluminium alloys—Castings—Chemical composition and mechanical properties", pp. 1-22, May 1, 2006.

7075 aluminum alloy—Wikipedia, the free encyclopedia, retrieved from the internet, at http://en.wikipedia.org/wiki/7075_aluminum_alloy, 4 pages, on Feb. 26, 2014.

Chinese Office Action, from related Chinese Patent Application No. CN201280056407.5, dated Aug. 17, 2015.

International Search Report and Written Opinion, dated Jul. 31, 2013, from related International Application No. PCT/US2012/062250.

International Search Report and Written Opinion, dated Aug. 21, 2015, from corresponding International Application No. PCT/US2014/070938.

Chen, S. L., et al., "The PANDAT Software package and its applications," *CALPHAD*, 26(2): 175-188, XP055072399, Jun. 1, 2002.

Chen, S. L., et al., "Calculating phase diagrams using PANDAT and panengine," *JOM* , 55(12): 48-51, XP055072400, Dec. 1, 2003.

Kraft, T., et al., "Predicting microstructure and microsegregation in multicomponent alloys," *JOM*, 49(12): 20-28, XP055072397, Dec. 1, 1997.

Lumley, R. N., et al., "Rapid Heat Treatment of Aluminum High-Pressure Diecastings," *Metallurgical and Materials Transactions A*, 40(7): 1716-1726, Springer Verlag, New York, XP019696606, May 2, 2009.

Sunday, S., et al., "A Study of the Mechanical Properties of Cast-to-Wrought Aluminium Welds," Welding Research Supplement, Feb. 1, 1984, XP055061759, retrieved from the Internet on May 3, 2013.

Yan, X., et al., "Computational and experimental investigation of microsegregation in an Al-rich Al—Cu—Mg—Si quaternary alloy," *Acta Materiala*, 50(9):2199-2207, XP055072398, May 1, 2002.

Extended European Search Report, dated Jul. 7, 2017, from related, co-owned European Patent Application No. 14883243.9.

ASM Metals Handbook Ninth Edition: Volume 2, Properties and Selection: Nonferrous Alloys and Pure Metals (1979), pp. 141, 149, the American Society for Metals.

ASM Metals Handbook Ninth Edition: Volume 15, Casting (1988), "Aluminum and Aluminum Alloys, Nonferrous Casting Alloys", pp. 743-746, 750-752, 769-770, the American Society for Metals.

ASM Metals Handbook Tenth Edition: Volume 2, Properties and Selection: Nonferrous Alloys and Special-Purpose Materials, Aluminum Foundry Products (1990), p. 132, the American Society for Metals.

"Primary Aluminum Casting Alloys," Brochure by Aluminium Rheinfelden GmbH, Apr. 11, 1991, nine pages, both original German version and English language translation.

Technical specification sheet for aluminum., SG-AlSi9Cu1/Ziar, document ID: EUR-SCM-XA-0034, by Nemak, Monterrey, Mexico, 2009.

Hatch, John E., "Aluminum: Properties and Physical Metallurgy", (1984), pp. 320, 348-350, copyright 1984 by the American Society for Metals.

Hielscher, U., "Cast Aluminum in Vehicle Construction," Primary aluminum casting alloys, Reports from industry practice, reprint from "Zev Glasersannalen" 111 (1987), No. 1, pp. 1-8, both original German version and English language translation.

Mondolfo, L. F. "Aluminum Alloys: Structure and Properties", Aluminum-Silicon, Aluminum-Magnesium Silicide Alloys (1976), pp. 759-760, 775, copyright Butterworth & Co Publishers Ltd., 1976.

Schneider, W., et al. "Heat treatment of aluminum casting alloys for die and permanent mold casting," Offprint from Gießerei 77 (1990), No. 22, pp. 693-699, both original German version and English language translation.

Van Horn, Kent R., Ed., "Aluminum, Vol. I, Properties, Physical Metallurgy, and Phase Diagrams", (1967), p. 301, American Society for Metals, Metals Park, Ohio.

Van Horn, Kent R., Ed., "Aluminum, Vol. III, Fabrication and Finishing", (1967), pp. 22-23, American Society for Metals, Metals Park, Ohio.

* cited by examiner

HIGH PERFORMANCE ALSIMGCU CASTING ALLOY

CROSS-REFERENCE TO RELATED APPLICATIONS

This patent application claims priority to U.S. Provisional Patent Application No. 61/919,415, filed Dec. 20, 2013, entitled "High Performance AlSiMgCu Casting Alloy with Engine and HPDC Applications", and International Patent Application No. PCT/US14/70938, filed Dec. 17, 2014, entitled "HIGH PERFORMANCE AlSiMgCu CASTING ALLOY". All of the above-identified patent applications are incorporated herein by reference in their entirety.

FIELD

The present invention relates to aluminum alloys, and more particularly, to aluminum alloys used for making cast products.

BACKGROUND

Aluminum alloys are widely used, e.g., in the automotive and aerospace industries, due to a high performance-to-weight ratio, favorable corrosion resistance and other factors. Various aluminum alloys have been proposed in the past that have characteristic combinations of properties in terms of weight, strength, castability, resistance to corrosion, and cost. AlSiMgCu casting alloys are described in commonly-owned U.S. Patent Application Publication No. 2013/0105045, entitled "High-Performance AlSiMgCu Casting Alloy", published May 2, 2013.

SUMMARY

The disclosed subject matter relates to improved aluminum casting alloys (also known as foundry alloys) and methods for producing same. More specifically, the present application relates to new aluminum casting alloys having:

- 8.5-9.5 wt. % silicon;
- 0.5-2.0 wt. % copper (Cu);
  - wherein 2.5≤(Cu+10Mg)≤5.8;
- 0.15-0.60 wt. % magnesium (Mg);
- 0.35 to 0.8 wt. % manganese;
- up to 5.0 wt. % zinc;
- up to 1.0 wt. % silver;
- up to 1.0 wt. % nickel;
- up to 1.0 wt. % hafnium;
- up to 1.0 wt. % iron;
- up to 0.30 wt. % titanium;
- up to 0.30 wt. % zirconium;
- up to 0.30 wt. % vanadium;
- up to 0.10 wt. % of one or more of strontium, sodium and antimony;
- other elements being ≤0.04 wt. % each and ≤0.12 wt. % in total;
- the balance being aluminum.

The new aluminum casting alloys may be utilized in a variety of applications, including engine applications (e.g., as a cylinder head, as a cylinder/engine block) and automotive applications (e.g., suspension and structural components, connecting rods), among others.

I. Composition

As noted above, the new aluminum casting alloys generally include 8.5-9.5 wt. % Si. In one embodiment, the aluminum alloy includes 8.75-9.5 wt. % Si. In one embodiment, the aluminum alloy includes 8.75-9.25 wt. % Si.

As noted above, the new aluminum casting alloys generally include 0.5-2.0 wt. % copper (Cu). In one approach, the aluminum alloy includes 0.8 to 2.0 wt. % copper. In another approach, the aluminum alloy includes 1.0 to 1.5 wt. % copper. In yet another approach, the aluminum alloy includes 0.7 to 1.3 wt. % copper. In another approach, the aluminum alloy includes 0.8 to 1.2 wt. % copper.

As noted above, the new aluminum casting alloys generally include 0.15-0.60 wt. % Mg. In one approach, the aluminum alloy includes 0.20-0.53 wt. % magnesium (Mg). In one approach the alloy includes ≥0.36 wt. % magnesium (e.g., 0.36-0.53 wt. % Mg). In one approach, the aluminum alloy includes from 0.40 to 0.45 wt. % magnesium. In another approach, the alloy includes ≤0.35 wt. % magnesium (e.g., 0.15-0.35 wt. % Mg). In one another approach, the alloy includes 0.20-0.25 wt. % Mg. Other combinations of magnesium and copper are described below.

The amount of copper plus magnesium may be limited to ensure an appropriate volume fraction of Q phase, as described below. For products to be processed to a T5 temper, and having 0.15-0.35 wt. % Mg (e.g., 0.20-0.25 wt. % Mg), a new aluminum casting alloy may include an amount of copper plus magnesium such that 2.5≤(Cu+10Mg)≤4.5. In one embodiment, a new aluminum casting alloy includes an amount of copper plus magnesium such that 2.5≤(Cu+10Mg)≤4.0. In another embodiment, a new aluminum casting alloy includes an amount of copper plus magnesium such that 2.5≤ (Cu+10Mg)≤3.75. In yet another embodiment, a new aluminum casting alloy includes an amount of copper plus magnesium such that 2.5≤ (Cu+10Mg)≤3.5. In another embodiment, a new aluminum casting alloy includes an amount of copper plus magnesium such that 2.5≤(Cu+10Mg)≤3.25. In yet another embodiment, a new aluminum casting alloy includes an amount of copper plus magnesium such that 2.75≤(Cu+10Mg)≤3.5. In any of the embodiments of this paragraph the magnesium within the aluminum alloy may be limited to 0.15-0.30 wt. % Mg, such as limited to 0.20-0.25 wt. % Mg.

For products to be processed to any of a T5, T6 or T7 temper, a new aluminum casting alloy includes an amount of copper plus magnesium such that 4.7≤(Cu+10Mg)≤5.8. In one embodiment, a new aluminum casting alloy includes an amount of copper plus magnesium such that 4.7≤(Cu+10Mg)≤5.7. In another embodiment, a new aluminum casting alloy includes an amount of copper plus magnesium such that 4.7≤(Cu+10Mg)≤5.6. In yet another embodiment, a new aluminum casting alloy includes an amount of copper plus magnesium such that 4.7≤(Cu+10Mg)≤5.5. In yet another embodiment, a new aluminum casting alloy includes an amount of copper plus magnesium such that 4.8≤(Cu+10Mg)≤5.5. In another embodiment, a new aluminum casting alloy includes an amount of copper plus magnesium such that 4.9≤(Cu+10Mg)≤5.5. In yet another embodiment, a new aluminum casting alloy includes an amount of copper plus magnesium such that 5.0≤(Cu+10Mg)≤5.5. In another embodiment, a new aluminum casting alloy includes an amount of copper plus magnesium such that 5.0≤(Cu+10Mg)≤5.4. In yet another embodiment, a new aluminum casting alloy includes an amount of copper plus magnesium such that 5.1≤(Cu+10Mg)≤5.4. In any of the embodiments of this paragraph, the magnesium within the aluminum alloy may be toward the higher end of the acceptable range, such as from 0.30-0.60 wt. % Mg, or 0.35-0.55 wt. % Mg, or 0.37-0.50 wt. % Mg. or 0.40-0.50 wt. % Mg, or 0.40-0.45 wt. % Mg. In one approach, the aluminum alloy includes about 1.0 wt. % copper (e.g., 0.90-1.10 wt. % Cu, or 0.95-1.05 wt. % Cu) in combination with about 0.4 wt. % magnesium (0.35-0.45 wt. % Mg, or 0.37-0.43 wt. % Mg).

As noted above, the new aluminum casting alloys generally include 0.35 to 0.8 wt. % manganese. In one approach, the aluminum alloy includes 0.45-0.70 wt. % Mn. In another approach, the aluminum alloy includes 0.50-0.65 wt. % Mn. In another approach, the aluminum alloy includes 0.50-0.60 wt. % Mn. In one approach, the weight ratio of iron to manganese (Fe:Mn) in the aluminum alloy is ≤0.50. In another approach, the weight ratio of iron to manganese (Fe:Mn) in the aluminum alloy is ≤0.45. In another approach, the weight ratio of iron to manganese (Fe:Mn) in the aluminum alloy is ≤0.40. In another approach, the weight ratio of iron to manganese (Fe:Mn) in the aluminum alloy is ≤0.35. In another approach, the weight ratio of iron to manganese (Fe:Mn) in the aluminum alloy is ≤0.30.

As noted above, the new aluminum casting alloys may include up to 1.0 wt. % Fe. In one approach, the aluminum alloy includes from 0.01 to 0.5 wt. % Fe. In another approach, the aluminum alloy includes from 0.01 to 0.35 wt. % Fe. In yet approach, the aluminum alloy includes from 0.01 to 0.30 wt. % Fe. In another approach, the aluminum alloy includes from 0.01 to 0.25 wt. % Fe. In yet approach, the aluminum alloy includes from 0.01 to 0.20 wt. % Fe. In another approach, the aluminum alloy includes from 0.01 to 0.15 wt. % Fe. In yet another approach, the aluminum alloy includes from 0.10 to 0.30 wt. % Fe.

As noted above, the new aluminum casting alloys may include up to 5.0 wt. % Zn. In one approach, the alloy includes ≤0.5 wt. % Zn. In another approach, the aluminum alloy includes ≤0.25 wt. % Zn. In yet another approach, the aluminum alloy includes ≤0.15 wt. % Zn. In another approach, the aluminum alloy includes ≤0.05 wt. % Zn. In yet another approach, the aluminum alloy includes ≤0.01 wt. % Zn.

As noted above, the new aluminum casting alloys may include up to 1.0 wt. % Ag. In one embodiment, the aluminum alloy includes ≤0.5 wt. % Ag. In another approach, the aluminum alloy includes ≤0.25 wt. % Ag. In yet another approach, the aluminum alloy includes ≤0.15 wt. % Ag. In another approach, the aluminum alloy includes ≤0.05 wt. % Ag. In yet another approach, the aluminum alloy includes ≤0.01 wt. % Ag.

As noted above, the new aluminum casting alloys may include up to 1.0 wt. % Ni. In one embodiment, the aluminum alloy includes ≤0.5 wt. % Ni. In another approach, the aluminum alloy includes ≤0.25 wt. % Ni. In yet another approach, the aluminum alloy includes ≤0.15 wt. % Ni. In another approach, the aluminum alloy includes ≤0.05 wt. % Ni. In yet another approach, the aluminum alloy includes ≤0.01 wt. % Ni.

As noted above, the new aluminum casting alloys may include up to 1.0 wt. % Hf. In one embodiment, the aluminum alloy includes ≤0.5 wt. % Hf. In another approach, the aluminum alloy includes ≤0.25 wt. % Hf. In yet another approach, the aluminum alloy includes ≤0.15 wt. % Hf. In another approach, the aluminum alloy includes ≤0.05 wt. % Hf. In yet another approach, the aluminum alloy includes ≤0.01 wt. % Hf.

As noted above, the new aluminum casting alloys may include up to 0.30 wt. % each of zirconium and vanadium. For high pressure die casting embodiments, both zirconium and vanadium may be present, and in an amount of at least 0.05 wt. % each, and wherein the total amount of Zr+V does not form primary phase particles (e.g., the total amount of Zr+V is from 0.10 wt. to 0.50 wt. %). In one embodiment, the aluminum alloy includes at least 0.07 wt. % each of zirconium and vanadium, and Zr+V is from 0.14 to 0.40 wt. %. In one embodiment, the aluminum alloy includes at least 0.08 wt. % each of zirconium and vanadium, and Zr+V is from 0.16 to 0.35 wt. %. In one embodiment, the aluminum alloy includes at least 0.09 wt. % each of zirconium and vanadium, and Zr+V is from 0.18 to 0.35 wt. %. In one embodiment, the aluminum alloy includes at least 0.09 wt. % each of zirconium and vanadium, and Zr+V is from 0.20 to 0.30 wt. %. In another approach, the aluminum alloy includes ≤0.03 wt. % each of zirconium and vanadium (e.g., as impurities for non-HPDC applications).

As noted above, the new aluminum casting alloys may include up to 0.30 wt. % titanium. In one embodiment, the aluminum alloy includes from 0.005 to 0.25 wt. % Ti. In another embodiment, the aluminum alloy includes from 0.005 to 0.20 wt. % Ti. In yet another embodiment, the aluminum alloy includes from 0.005 to 0.15 wt. % Ti. In another embodiment, the aluminum alloy includes from 0.01 to 0.15 wt. % Ti. In yet another embodiment, the aluminum alloy includes from 0.03 to 0.15 wt. % Ti. In another embodiment, the aluminum alloy includes from 0.05 to 0.15 wt. % Ti. When both zirconium and titanium are used in the new aluminum alloy, the aluminum alloy generally includes at least 0.005 wt. % Ti, such as any of the amounts of titanium described above. In one embodiment, the aluminum alloy includes at least 0.09 wt. % each of zirconium and vanadium, and Zr+V is from 0.18 to 0.35 wt. % and from 0.05 to 0.15 wt. % Ti.

As noted above, the new aluminum casting alloys may include up to 0.10 wt. % of one or more of strontium, sodium and antimony. In one approach, the aluminum alloy includes ≤0.05 wt. % strontium. In one approach, the aluminum alloy includes ≤0.03 wt. % sodium. In one approach, the aluminum alloy includes ≤0.03 wt. % antimony. In one embodiment, the aluminum alloy includes strontium, and from 50-300 ppm of strontium. In one embodiment, the aluminum alloy is free of sodium and antimony, and includes these elements as impurities only.

As noted above, the new aluminum casting alloys generally include other elements being ≤0.04 wt. % each and ≤0.12 wt. % in total, the balance being aluminum. In one embodiment, the new aluminum casting alloys generally include other elements being ≤0.03 wt. % each and ≤0.10 wt. % in total, the balance being aluminum In one embodiment, the new aluminum casting alloy includes 9.14-9.41 wt. % Si, 0.54-1.53 wt. % Cu, 0.21-0.48 wt. % Mg, 0.48-0.53 wt. % Mn, 0.13-0.17 wt. % Fe, 0.11-0.30 wt. % Ti, 0.10-0.14 wt. % Zr, 0.12-0.13 wt. % V, ≤0.05 wt. % Zn, ≤0.05 wt. % Ag, ≤0.05 wt. % Ni, ≤0.05 wt. % Hf, up to 0.012 wt. % Sr, other elements being ≤0.04 wt. % each and ≤0.12 wt. % in total, the balance being aluminum. For alloys to be processed to the T5 temper, this alloy may include 0.20-0.25 wt. % Mg, and with Cu+10Mg being from 2.5 to 4.0. For alloys to be processed to any of a T5, T6 or T7 temper, this alloy may include 0.40-0.48 wt. % Mg, and with Cu+10Mg being from 4.7 to 5.8.

II. Processing

The new aluminum casting alloy may be shape cast in any suitable form or article. In one approach, the new aluminum alloy is shape cast in the form of an automotive component or engine component (e.g., a cylinder head or cylinder/engine block).

In one approach, a method of producing a shape cast article includes the steps of:

(a) obtaining the above-described aluminum alloy by melting the appropriate amounts of the above-described elements in an appropriate melting apparatus;

(b) introducing the molten aluminum alloy into a mold; and (c) removing a defect-free shape cast article from the mold.

After the removing step, the method may optionally include:

(d) tempering the shape cast article (e.g., tempering to a T5, T6 or T7 temper).

Defect-free means that the shape-cast article can be used for its intended purpose.

Regarding the introducing step (b), the mold may be any suitable mold compatible with the new aluminum casting alloy, such as a high pressure die casting (HPDC) mold.

Prior to the removing step (c), the method may include allowing the casting to solidify, and then cooling the casting. In one embodiment, the cooling step includes contacting the shape casting with water after the solidifying step. In another embodiment, the cooling step includes contacting the shape casting with air and/or water after the solidifying step. After the removing step (c), the method may include tempering the shape cast article.

In one embodiment, the tempering is tempering to a T5 temper. As defined by ANSI H35.1 (2009), the T5 temper is where an aluminum alloy is "cooled from an elevated temperature shaping process and then artificially aged. Applies to products that are not cold worked after cooling from an elevated temperature shaping process, or in which the effect of cold work in flattening or straightening may not be recognized in mechanical property limits." When tempering to a T5 temper, the tempering step may include, after the removing step, artificially aging the shape cast article. The artificially aging may be accomplished as described below. Due to the shape casting process (e.g., HPDC), the T5 temper does not require a separate solution heat treatment and quench (i.e., is free of a separate solution heat treatment and quenching step, as are required by the T6 and T7 temper.

In another embodiment, the tempering is tempering to a T6 temper. As defined by ANSI H35.1 (2009), the T6 is where an aluminum alloy is "solution heat-treated and then artificially aged. Applies to products that are not cold worked after solution heat-treatment, or in which the effect of cold work in flattening or straightening may not be recognized in mechanical property limits." When tempering to a T6 temper, the tempering step (d) may include (i) solutionizing of the shape cast article and subsequent (ii) quenching of the shape cast article. After the quenching step (ii), the method may include (iii) artificial aging of the shape cast article.

In yet another embodiment, the tempering is tempering to a T7 temper. As defined by ANSI H35.1 (2009), the T7 is where an aluminum alloy is "solution heat-treated and overaged/stabilized. Applies to cast products that are artificially aged after solution heat-treatment to provide dimensional and strength stability." When tempering to a T7 temper, the tempering step (d) may include (i) solutionizing of the shape cast article and subsequent (ii) quenching of the shape cast article. After the quenching step (ii), the method may include (iii) artificially aging of the shape cast article to an overaged/stabilized condition.

In one approach, a method includes solution heat treating and quenching the aluminum alloy. In one embodiment, the solution heat treating comprises the steps of:

(a) heating the aluminum alloy to a first temperature (e.g., subjecting the alloy to a 2 hour±15 minutes heat-up from ambient temperature up to 504.4° C.±5.0° C.);

(b) first maintaining the first temperature (e.g., for at least 0.5-8 hours, such as for about 2 hours);

(c) ramping the temperature to a second higher temperature (e.g., ramping to 530° C.±5.0° C. and over a period of 5-60 minutes, such as ramping to the second temperature in about 30 minutes);

(d) second maintaining the second temperature at 530° C. (e.g., for 2-8 hours, such as holding for about 4 hours).

After the second maintaining step (d), the aluminum alloy may be quenching (e.g., in water and/or air).

As noted above, the tempering step may include artificially aging the aluminum alloy. In one embodiment, the artificially aging comprises holding the alloy at a temperature of from 190° C. to 220° C. for 1-10 hours (e.g., for about 6 hours). In another embodiment, the artificial aging is conducted at a temperature of from 175° C. to 205° C. for 1-10 hours (e.g., for about 6 hours).

EXAMPLE 1

Figure 1:
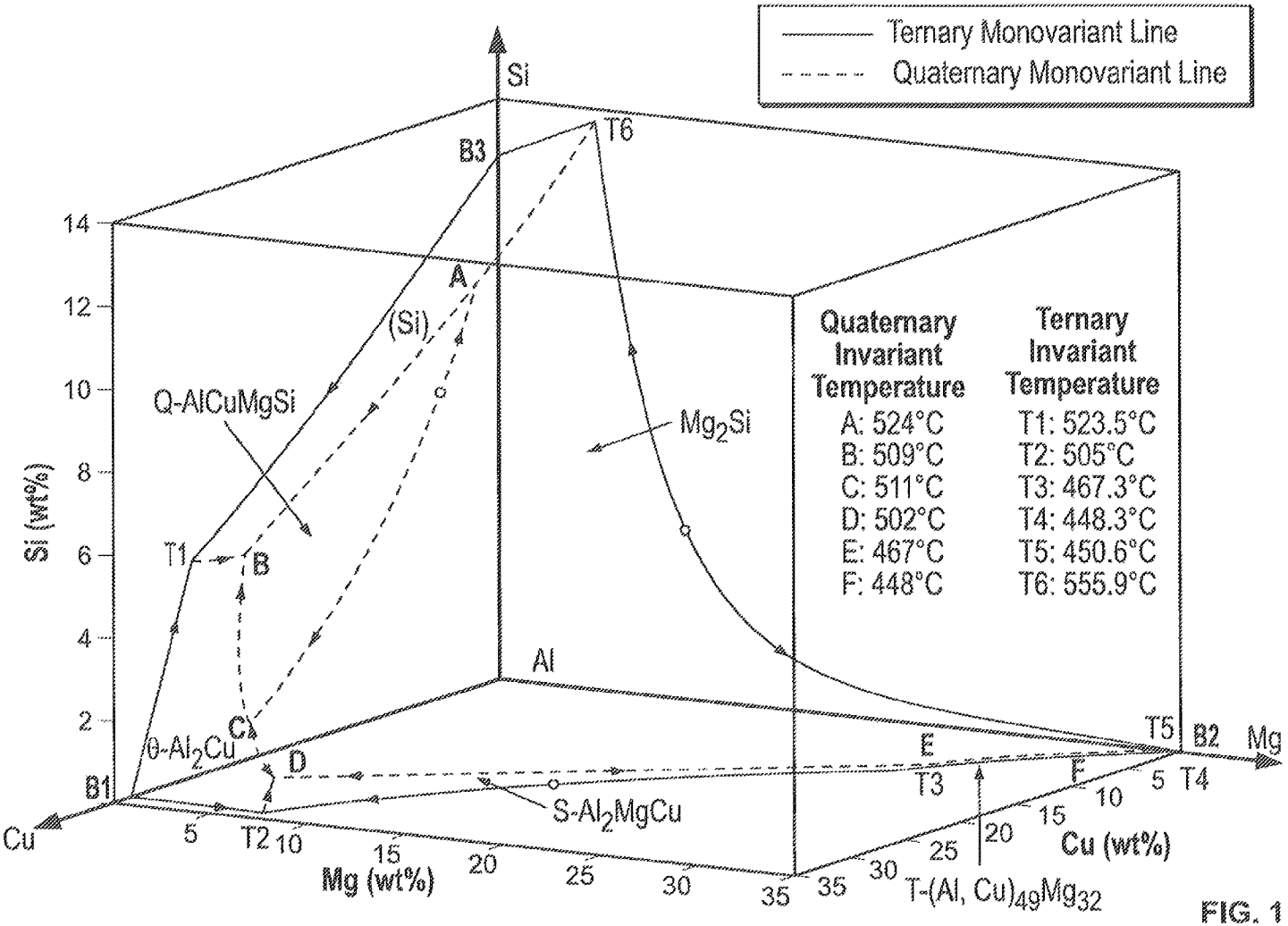
FIG. 1 is a graph of phase equilibria involving (Al) and liquid in an Al—Cu—Mg—Si system.

High Performance AlSiCuMg Cast Alloys 1.1 Alloy Development Methods Based on Computational Thermodynamics To improve the performances of Al—Si—Mg—Cu cast alloys, a novel alloy design method was used and is described as follows:

In Al—Si—Mg—Cu casting alloys, increasing Cu content can increase the strength due to higher amount of θ'-$Al_2Cu$ and Q' precipitates but reduce ductility, particularly if the amount of un-dissolved constituent Q-phase increases. FIG. 1 shows the calculated phase diagram of the Al—Cu—Mg—Si quaternary system, as shown in X. Yan, *Thermodynamic and solidification modeling coupled with experimental investigation of the multicomponent aluminum alloys*. University of Wisconsin—Madison, 2001, which is incorporated in its entirety by reference herein. FIG. 1 shows the three phase equilibria in ternary systems and the four phase equilibria quaternary monovariant lines. Points A, B, C, D, E and F are five phase invariant points in the quaternary system. Points T1 to T6 are the four-phase invariant points in ternary systems and B1, B2 and B3 are the three phase invariant points in binary systems. The formation of Q-phase (AlCuMgSi) constituent particles during solidification is almost inevitable for an Al—Si—Mg alloy containing Cu since Q-phase is involved in the eutectic reaction (invariant reaction B). If these Cu-containing Q-phase particles cannot be dissolved during solution heat treatment, the strengthening effect of Cu will be reduced and the ductility of the casting will also suffer.

In order to minimize/eliminate un-dissolved Q-phase (AlCuMgSi) and maximize solid solution/precipitation strengthening, the alloy composition, solution heat treatment and aging practice should be optimized. In accordance with the present disclosure, a thermodynamic computation was used to select alloy composition (mainly Cu and Mg content) and solution heat treatment for avoiding un-dissolved Q-phase particles. Pandat thermodynamic simulation software and the PanAluminum database LLC, Computherm, Pandat Software and PanAluminum Database. http://www.computherm.com were used to calculate these thermodynamic data.

Figure 2:
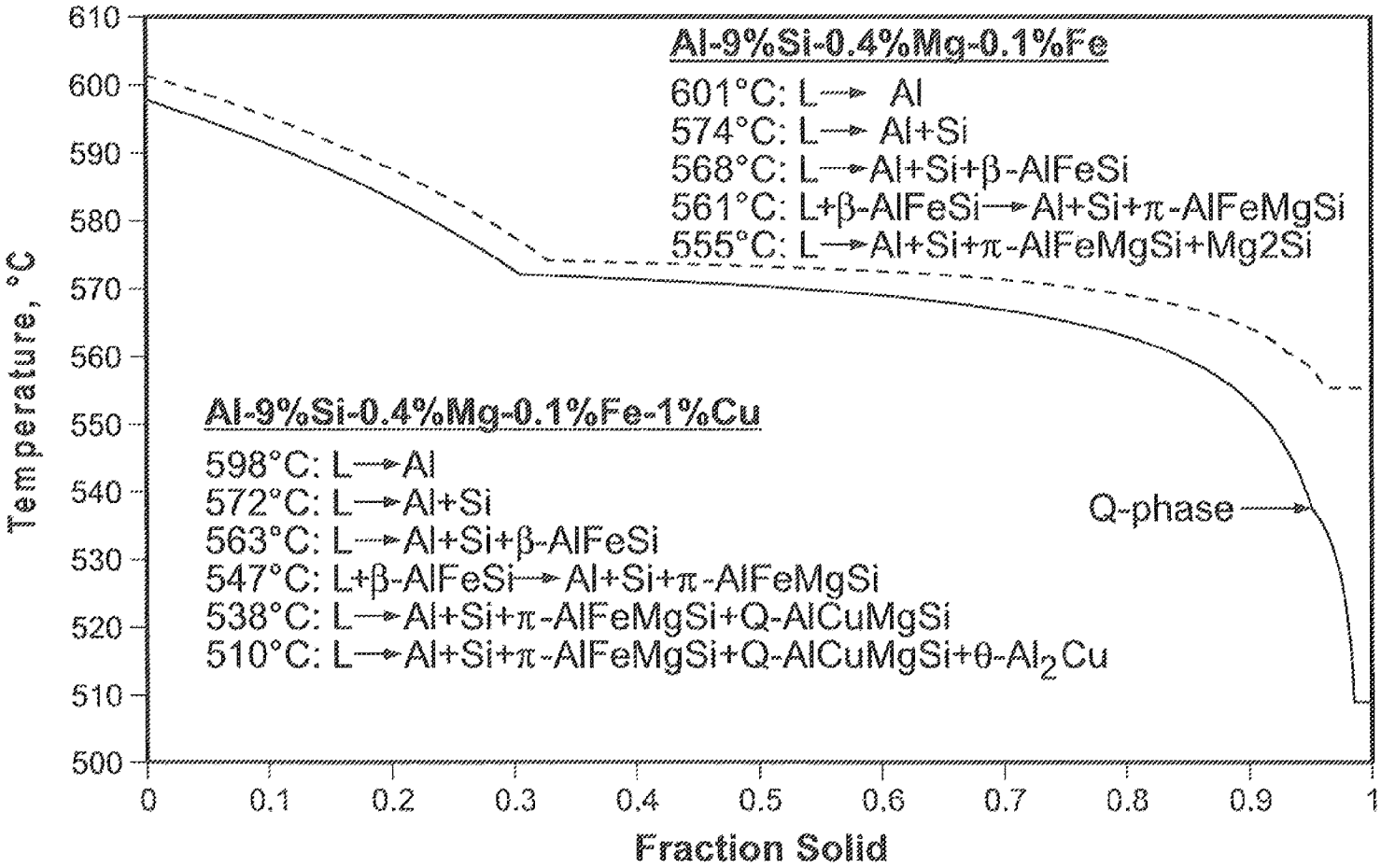
FIG. 2 is a graph of the effect of Cu additions on the solidification path of Al-9% Si-0.4% Mg-0.1% Fe alloy.

The inventors of the present disclosure recognize that adding Cu to Al—Si—Mg cast alloys will change the solidification sequence. FIG. 2 shows the predicted effect of 1% Cu (all compositions in this report are in weight percent) on the solidification path of Al-9% Si-0.4% Mg-0.1% Fe. More particularly, the solidification temperature range is significantly increased with the addition of 1% Cu due to the formation of Cu-containing phases at lower temperatures. For the Al-9% Si-0.4% Mg-0.1% Fe-1% Cu alloy, Q-AlCuMgSi formed at ~538° C. and θ—$Al_2Cu$ phase formed at ~510° C. The volume fraction of each constituent phase and their formation temperatures are also influenced by the Cu content.

Figure 3:
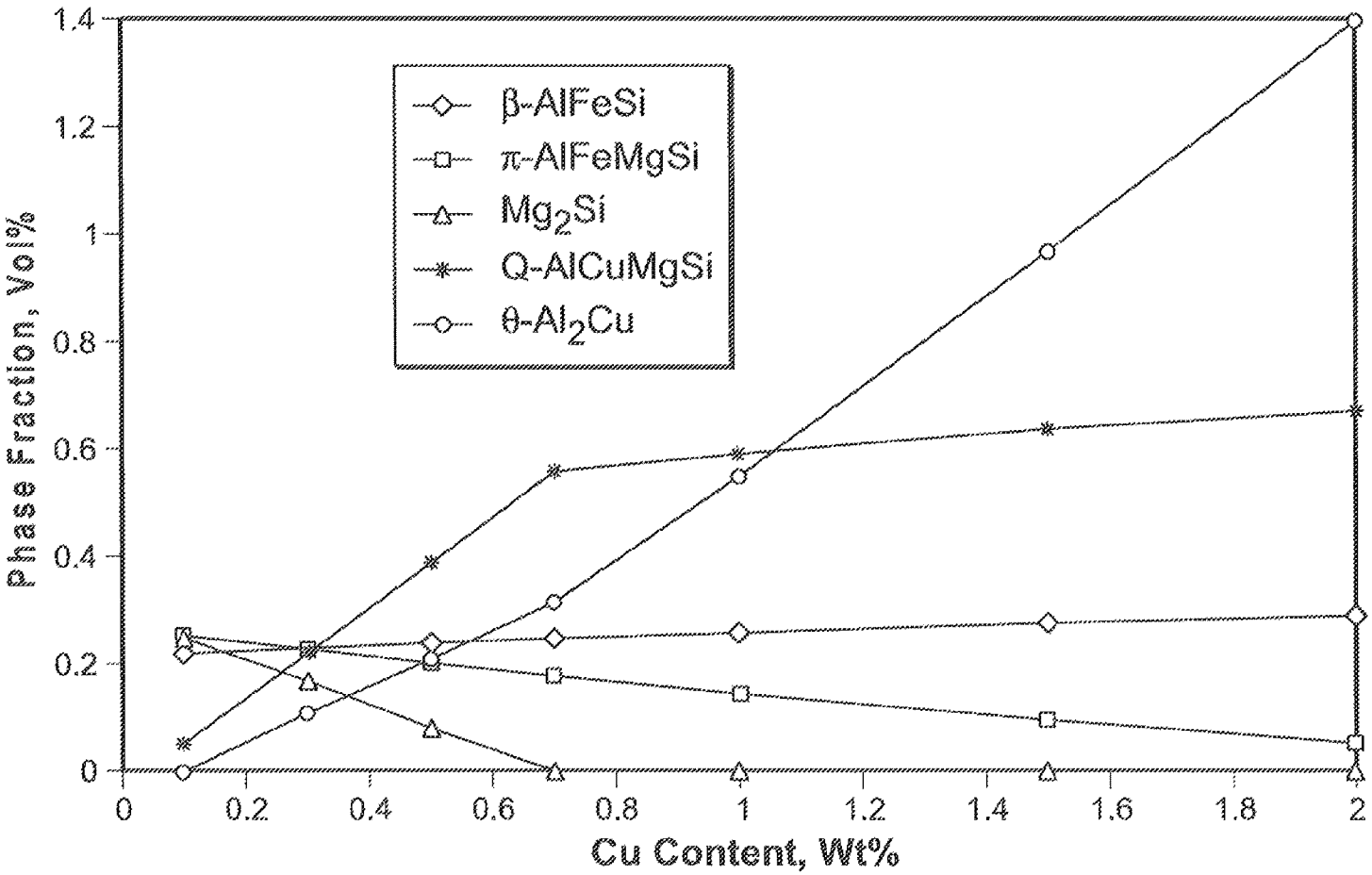
FIG. 3 is a graph of the effect of Cu content on phase fractions in Al-9%-0.4% Mg-0.1% Fe-x % Cu alloys.

FIG. 3 shows the predicted effect of Cu content on phase fractions in Al-9% Si-0.4% Mg-0.1% Fe-x % Cu alloys. As the Cu content increases, the amount of θ-$Al_2Cu$ and Q-AlCuMgSi increases while the amount of $Mg_2Si$ and π-AlFeMgSi decreases. In alloys with more than 0.7% Cu, $Mg_2Si$ phase will not form during solidification. The amount of Q-AlCuMgSi is also limited by the Mg content in the alloy if the Cu content is more than 0.7%.

Figure 4:
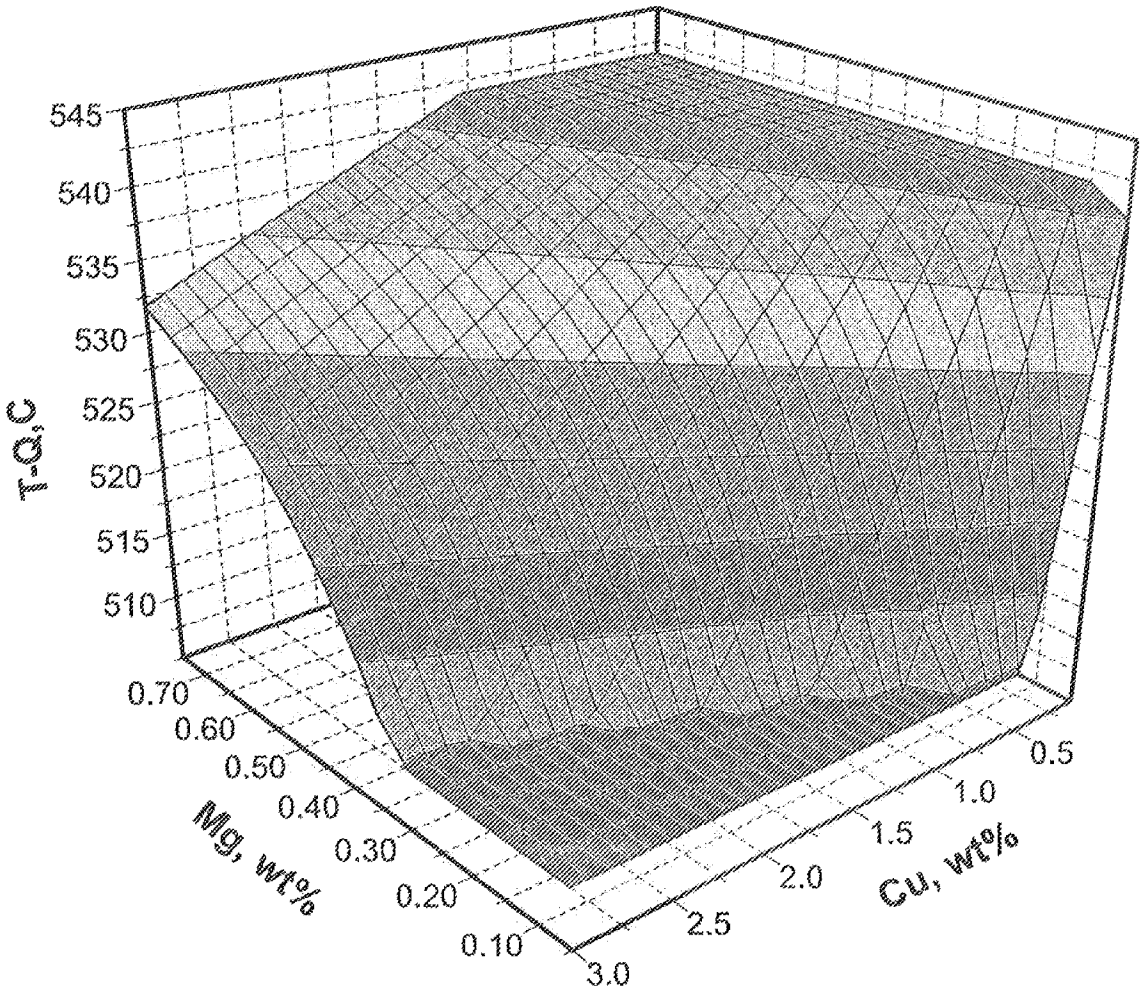
FIG. 4 is a graph of the effect of Cu and Mg content on the Q-phase formation temperature of Al-9% Si—Mg—Cu alloys.

The Q-AlCuMgSi phase formation temperature ($T_Q$) in Al-9% Si—Mg—Cu alloys is a function of Cu and Mg content. The "formation temperature" of a constituent phase is defined as the temperature at which the constituent phase starts to form from the liquid phase. FIG. 4 shows the predicted effects of Cu and Mg content on the formation temperature of Q-AlCuMgSi phase. The formation temperature of Q-AlCuMgSi phase decreases with increasing Cu content; but increases with increasing Mg content.

In accordance with the present disclosure, in order to completely dissolve all the as-cast Q-AlCuMgSi phase particles, the solution heat treatment temperature ($T_H$) needs to be controlled above the formation temperature of the Q-AlCuMgSi phase, i.e., $T_H > T_Q$. The upper limit of the solution heat treatment temperature is the equilibrium solidus temperature ($T_S$) in order to avoid re-melting. As a practical measure, the solution heat treatment temperature is controlled to be at least 5 to 10° C. below the solidus temperature to avoid localized melting and creation of metallurgical flaws known in the art as rosettes. Hence, in practice, the following relationship is established:

$$T_S - 10°\ \text{C.} > T_H > T_Q \quad (1)$$

Figure 5:
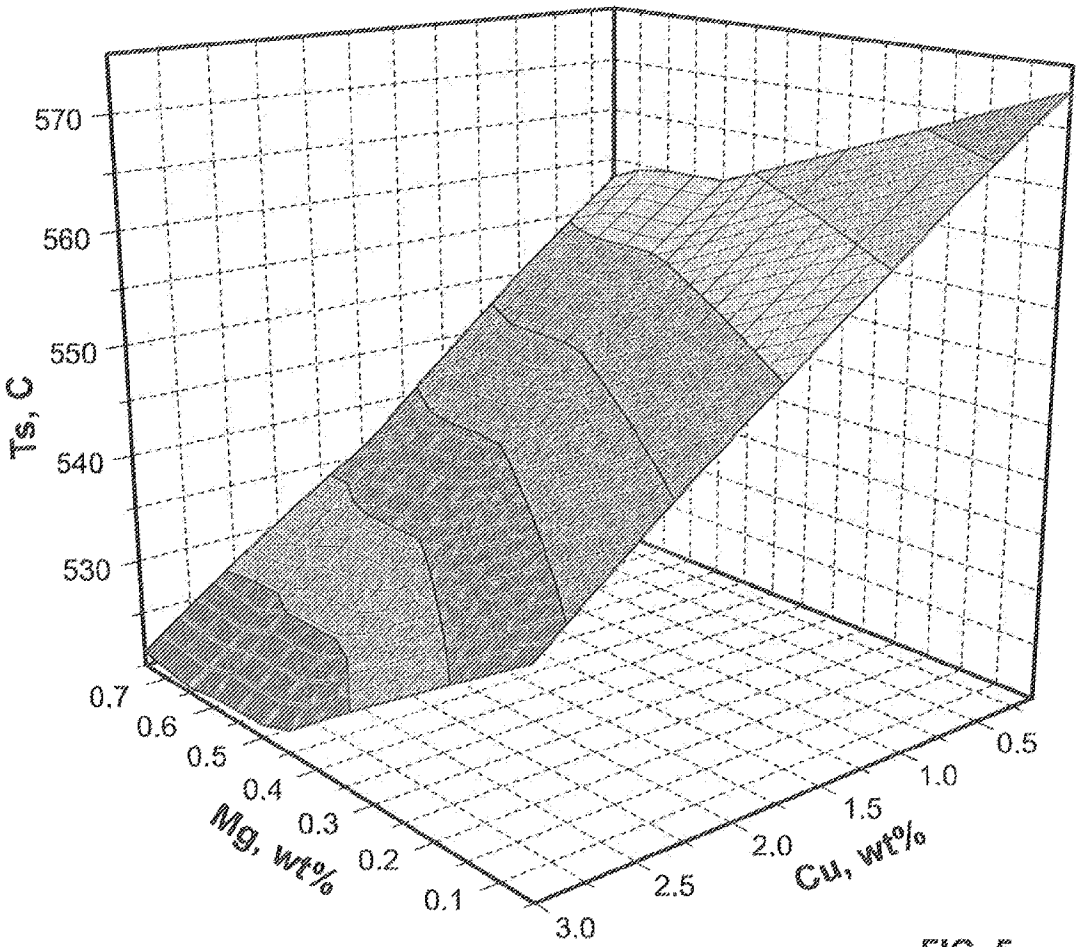
FIG. 5 is a graph of the effect of Mg and Cu content on the equilibrium solidus temperature of Al-9% Si—Mg—Cu alloys.
Figure 6:
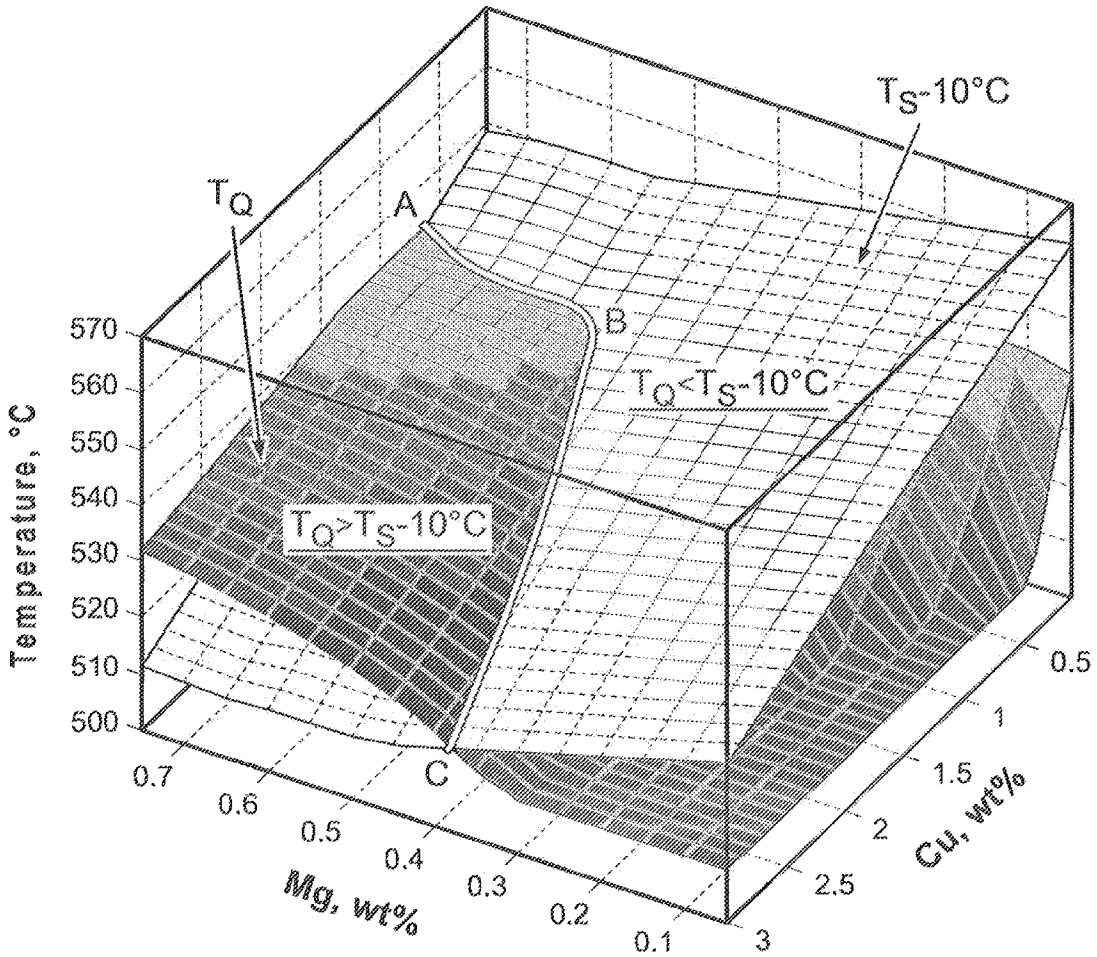
FIG. 6 is a graph of the effect of Mg and Cu content on the equilibrium solidus temperature ($T_S$) and Q-phase formation temperature ($T_Q$) of Al-9% Si—Mg—Cu alloys.
Figure 25:
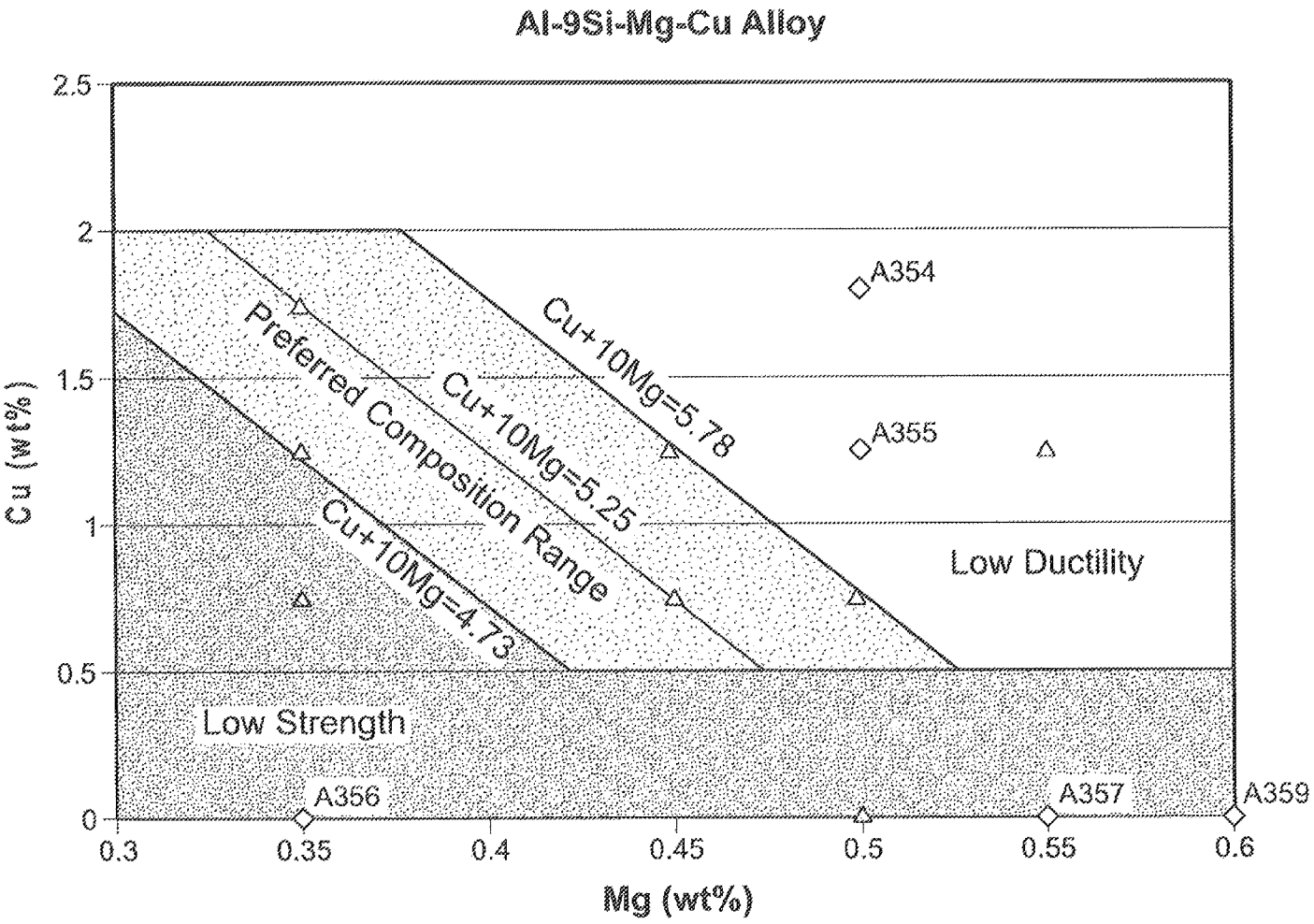
FIG. 25 is a graph of Mg and Cu content correlated to strength and ductility for Al-9Si—Mg—Cu alloys.

In accordance with the present disclosure, to achieve this criterion, the alloy composition, mainly the Cu and Mg contents, should be selected so that the formation temperature of Q-AlCuMgSi phase is lower than the solidus temperature. FIG. 5 shows the predicted effects of Cu and Mg content on the solidus temperature of Al-9% Si—Cu—Mg alloys. As expected, the solidus temperature decreases as the Cu and Mg content increases. It should be noted that Mg content increases the formation temperature of the Q-AlCuMgSi phase but decreases the solidus temperature as indicated in FIG. 6. The Q-AlCuMgSi phase formation temperature surface and the ($T_S$−10° C.) surface (10° C. below the solidus temperature surface) are superimposed in FIG. 6. These two surfaces intersect along the curve A-B-C. The area that meets the criterion of Equation (1) is on the right hand side of curve A-B-C, i.e., $T_Q<T_S-10°$ C. Projection of the curve A-B-C to the Cu—Mg composition plane yields the center line Cu+10Mg=5.25 of the preferred composition boundary, as shown in FIG. 25. The lower boundary, Cu+10Mg=4.73, was defined by the intersection of the Q-AlCuMgSi phase formation temperature surface and the ($T_S-15°$ C.) surface (15° C. below the solidus temperature surface). The upper boundary, Cu+10Mg=5.78, was defined by the intersection of the Q-AlCuMgSi phase formation temperature surface and the ($T_S-5°$ C.) surface (5° C. below the solidus temperature surface). For Al-9% Si-0.1% Fe-x % Cu-y % Mg alloys, Q-AlCuMgSi phase particles can be completely dissolved during solution heat treatment when the Cu and Mg contents are controlled within these boundaries.

In accordance with the present disclosure, the preferred Mg and Cu content to maximize the alloy strength and ductility is shown in FIG. 25.

The preferred relationship of Mg and Cu content is defined by:

$$Cu+10Mg=5.25 \text{ with } 0.5<Cu<2.0$$

The upper bound is Cu+10Mg=5.8 and the lower bound is Cu+10Mg=4.7.

The foregoing approach allows the selection of a solutionization temperature by (i) calculating the formation temperature of all dissolvable constituent phases in an aluminum alloy; (ii) calculating the equilibrium solidus temperature of an aluminum alloy; (iii) defining a region in Al—Cu—Mg—Si space where the formation temperature of all dissolvable constituent phases is at least 10° C. below the solidus temperature. The Al—Cu—Mg—Si space is defined by the relative % composition of each of Al, Cu, Mg and Si and the associated solidus temperatures for the range of relative composition. For a given class of alloy, e.g., Al—Cu—Mg—Si, the space may be defined by the solidus temperature associated with relative composition of two elements of interest, e.g., Cu and Mg, which are considered relative to their impact on the significant properties of the alloy, such as tensile properties. In addition, the solutionizing temperature may be selected to diminish the presence of specific phases, e.g., that have a negative impact on significant properties, such as, tensile properties. The alloy, e.g., after casting, may be heat treated by heating above the calculated formation temperature of the phase that needs to be completely dissolved after solution heat treatment, e.g., the Q-AlCuMgSi phase, but below the calculated equilibrium solidus temperature. The formation temperature of the phase that needs to be completely dissolved after solution heat treatment and solidus temperatures may be determined by computational thermodynamics, e.g., using Pandat™ software and PanAluminum™ Database available from CompuTherm LLC of Madison, Wis.

1.2 Composition Selection for Tensile Bar Casting

Figure 7:
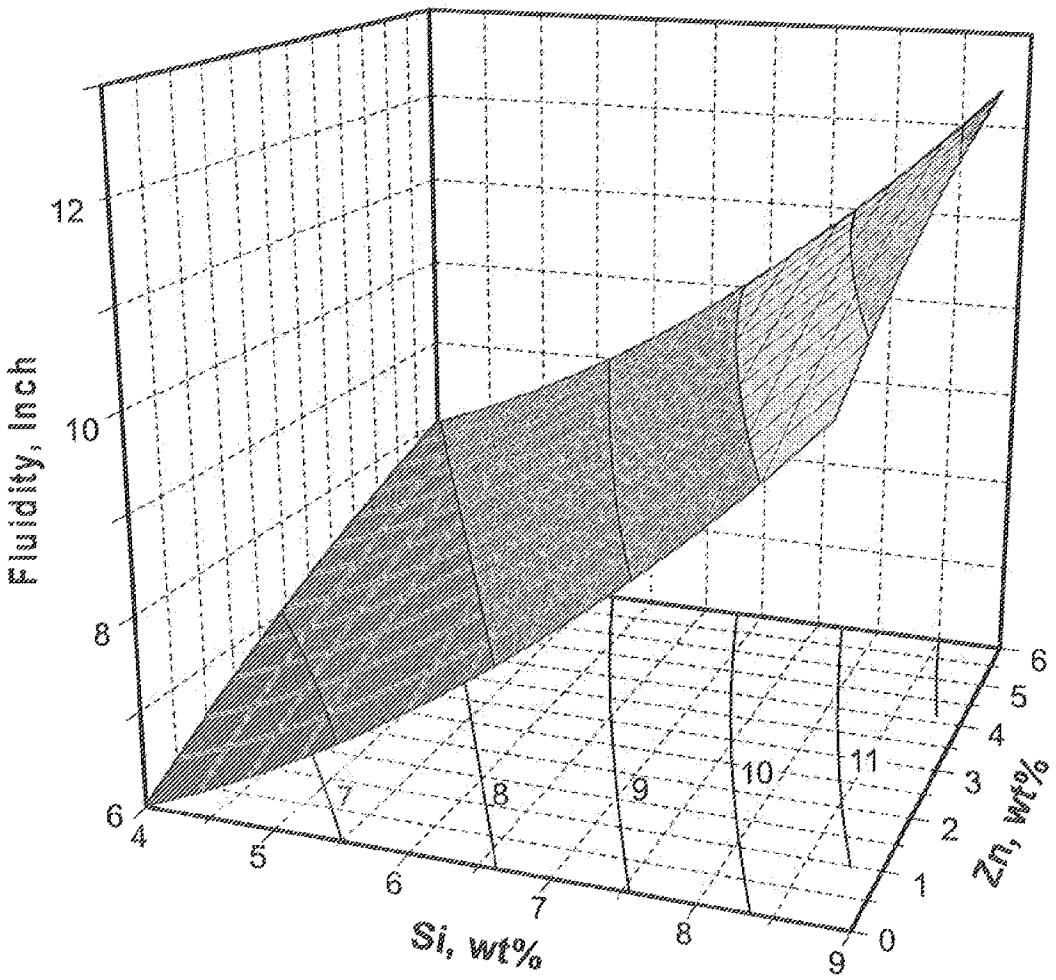
FIG. 7 is a graph of the effect of zinc and silicon on the fluidity of Al-x % Si-0.5% Mg-y % Zn alloys

Based on the foregoing analysis, several Mg and Cu content combinations were selected as given in Table 3. Additionally, studies by the present inventors have indicated that an addition of zinc with a concentration greater than 3 wt % to Al—Si—Mg—(Cu) alloys can increase both ductility and strength of the alloy. As shown in FIG. 7, zinc can also increase the fluidity of Al—Si—Mg alloys. Thus, an addition of zinc (4 wt %) was also evaluated. It has also been reported L. A. Angers, *Development of Advanced I/M 2xxx Alloys for High Speed Civil Transport Applications*, Alloy Technology Division Report No. AK92, 1990-04-16 that an addition of Ag can accelerate age-hardening of high Cu-containing (>~1.5 wt %) aluminum alloys, and increase the tensile strength at room temperature and elevated temperature. An addition of Ag (0.5 wt %) was also included in alloys with higher Cu content such as 1.75 wt % Cu. Hence, ten alloy compositions were selected for evaluation. The target compositions of these alloys are given in Table 3. It should be noted that alloy 1 in Table 3 is the baseline alloy, A359.

TABLE 3

Target Compositions (all values in weight percent)

| | Alloy | Si | Cu | Mg | Zn | Ag | Fe | Sr* | Ti | B |
|---|---|---|---|---|---|---|---|---|---|---|
| 1 | Al—9Si—0.5Mg | 9 | 0 | 0.5 | 0 | 0 | <0.1 | 0.0125 | 0.04 | 0.003 |
| 2 | Al—9Si—0.35Mg—0.75Cu—4Zn | 9 | 0.75 | 0.35 | 4 | 0 | <0.1 | 0.0125 | 0.04 | 0.003 |
| 3 | Al—9Si—0.45Mg—0.75Cu—4Zn | 9 | 0.75 | 0.45 | 4 | 0 | <0.1 | 0.0125 | 0.04 | 0.003 |
| 4 | Al—9Si—0.45Mg—0.75Cu | 9 | 0.75 | 0.45 | 0 | 0 | <0.1 | 0.0125 | 0.04 | 0.003 |
| 5 | Al—9Si—0.5Mg—0.75Cu | 9 | 0.75 | 0.5 | 0 | 0 | <0.1 | 0.0125 | 0.04 | 0.003 |
| 6 | Al—9Si—0.35Mg—1.25Cu | 9 | 1.25 | 0.35 | 0 | 0 | <0.1 | 0.0125 | 0.04 | 0.003 |
| 7 | Al—9Si—0.45Mg—1.25Cu | 9 | 1.25 | 0.45 | 0 | 0 | <0.1 | 0.0125 | 0.04 | 0.003 |
| 8 | Al—9Si—0.55Mg—1.25Cu | 9 | 1.25 | 0.55 | 0 | 0 | <0.1 | 0.0125 | 0.04 | 0.003 |
| 9 | Al—9Si—0.35Mg—1.75Cu | 9 | 1.75 | 0.35 | 0 | 0 | <0.1 | 0.0125 | 0.04 | 0.003 |
| 10 | Al—9Si—0.35Mg—1.75Cu—0.5Ag | 9 | 1.75 | 0.35 | 0 | 0.5 | <0.1 | 0.0125 | 0.04 | 0.003 |

A modified ASTM tensile-bar mold was used for the casting. A lubricating mold spray was used on the gauge section, while an insulating mold spray was used on the remaining portion of the cavity. Thirty castings were made for each alloy. The average cycle time was about two minutes. The actual compositions investigated are listed in Table 4, below.

TABLE 4

Actual Compositions (all values in weight percent)

| | Alloy | Si | Cu | Mg | Zn | Ag | Fe | Sr* | Ti | B |
|---|---|---|---|---|---|---|---|---|---|---|
| 1 | Al—9Si—0.5Mg | 8.87 | 0.021 | 0.48 | 0 | 0 | 0.079 | 0.0125 | 0.05 | 0.003 |
| 2 | Al—9Si—0.35Mg—0.75Cu—4Zn | 9.01 | 0.75 | 0.37 | 4.03 | 0 | 0.077 | 0.0125 | 0.031 | 0.003 |
| 3 | Al—9Si—0.45Mg—0.75Cu—4Zn | 9.09 | 0.75 | 0.46 | 4.02 | 0 | 0.081 | 0.0125 | 0.04 | 0.003 |

TABLE 4-continued

| Actual Compositions (all values in weight percent) | | | | | | | | | |
|---|---|---|---|---|---|---|---|---|---|
| Alloy | Si | Cu | Mg | Zn | Ag | Fe | Sr* | Ti | B |
| 4 Al—9Si—0.45Mg—0.75Cu | 9.18 | 0.76 | 0.45 | 0 | 0 | 0.083 | 0.0125 | 0.042 | 0.003 |
| 5 Al—9Si—0.5Mg—0.75Cu | 9.02 | 0.77 | 0.49 | 0 | 0 | 0.081 | 0.0125 | 0.013 | 0.003 |
| 6 Al—9Si—0.35Mg—1.25Cu | 9.02 | 1.25 | 0.34 | 0 | 0 | 0.088 | 0.0125 | 0.03 | 0.003 |
| 7 Al—9Si—0.45Mg—1.25Cu | 9.11 | 1.28 | 0.44 | 0 | 0 | 0.082 | 0.0125 | 0.04 | 0.003 |
| 8 Al—9Si—0.55Mg—1.25Cu | 8.99 | 1.27 | 0.53 | 0 | 0 | 0.1 | 0.0125 | 0.04 | 0.003 |
| 9 Al—9Si—0.35Mg—1.75Cu | 9.29 | 1.83 | 0.37 | 0 | 0 | 0.08 | 0.0125 | 0.048 | 0.003 |
| 10 Al—9Si—0.35Mg—1.75Cu—0.5Ag | 8.88 | 1.78 | 0.35 | 0 | 0.5 | 0.081 | 0.0125 | 0.044 | 0.003 |

The actual compositions are very close to the target compositions. The hydrogen content (single testing) of the castings is given in Table 5.

TABLE 5

| Hydrogen Content of the Castings | | |
|---|---|---|
| | Alloy | H Content (ppm) |
| 1 | Al—9Si—0.5Mg | 0.14 |
| 2 | Al—9Si—0.35Mg—0.75Cu—4Zn | 0.11 |
| 3 | Al—9Si—0.45Mg—0.75Cu—4Zn | 0.19 |
| 4 | Al—9Si—0.45Mg—0.75Cu | 0.11 |
| 5 | Al—9Si—0.5Mg—0.75Cu | 0.14 |
| 6 | Al—9Si—0.35Mg—1.25Cu | 0.15 |
| 7 | Al—9Si—0.45Mg—1.25Cu | 0.13 |
| 8 | Al—9Si—0.55Mg—1.25Cu | 0.16 |
| 9 | Al—9Si—0.35Mg—1.75Cu | 0.13 |
| 10 | Al—9Si—0.35Mg—1.75Cu—0.5Ag | Not measured |

Note:
alloy 3 was degassed with porous lance; all other alloys were degassed using a rotary degasser.

1.3 The Preferred Solution Heat Treat Temperature as a Function of Cu and Mg

To dissolve all the Q-AlCuMgSi phase particles, the solution heat treatment temperature should be higher than the Q-AlCuMgSi phase formation temperature. Table 6 lists the calculated final eutectic temperature, Q-phase formation temperature and solidus temperature using the targeted composition of the ten alloys investigated.

TABLE 6

| Calculated Final Eutectic Temperature, Q-phase Formation Temperature and Solidus Temperature for Ten Investigated Casting Alloys | | | |
|---|---|---|---|
| Alloy | Final eutectic temperature, ° C. | Q-phase forming temperature, ° C. | Solidus temperature, ° C. |
| 1 Al—9Si—0.5Mg | 560 | — | 563 |
| 2 Al—9Si—0.35Mg—0.75Cu—4Zn | 470 | 518 | 540 |
| 3 Al—9Si—0.45Mg—0.75Cu—4Zn | 470 | 518 | 543 |
| 4 Al—9Si—0.45Mg—0.75Cu | 510 | 541 | 554 |
| 5 Al—9Si—0.5Mg—0.75Cu | 510 | 541 | 553 |
| 6 Al—9Si—0.35Mg—1.25Cu | 510 | 533 | 552 |
| 7 Al—9Si—0.45Mg—1.25Cu | 510 | 536 | 548 |
| 8 Al—9Si—0.55Mg—1.25Cu | 510 | 538 | 545 |
| 9 Al—9Si—0.35Mg—1.75Cu | 510 | 528 | 543 |
| 10 Al—9Si—0.35Mg—1.75Cu—0.5Ag | 510 | 526 | 543 |

Based on the above mentioned information, two solution heat treatment practices were defined and used. Alloys 2, 3, 9 and 10 had lower solidus temperature and/or lower final eutectic/Q-phase formation temperature than others. Hence a different SHT practice was used.

The practice I for alloys 2, 3, 9 and 10 was:
1.5 hour log heat-up to 471° C.
2 hour soak at 471° C.
0.5 hour ramp up to 504° C.
4 hour soak at 504° C.
0.5 hour ramp up to $T_H$
6 hour soak at $T_H$
CWQ (Cold Water Quench)
and practice II for other six alloys was:
1.5 hour log heat-up to 491° C.
2 hour soak at 491° C.
0.25 hour ramp up to 504° C.
4 hour soak at 504° C.
0.5 hour ramp up to $T_H$
6 hour soak at $T_H$
CWQ (Cold Water Quench)

The final step solution heat treatment temperature $T_H$ was determined from following equation based on Mg and Cu content:

$$T_H(^\circ\text{C.})=570-10.48*Cu-71.6*Mg-1.3319*Cu*Mg-0.72*Cu*Cu+72.95*Mg*Mg, \quad (2)$$

where, Mg and Cu are magnesium and copper contents, in wt. %. A lower limit for $T_H$ is defined by:

$$T_Q=533.6-20.98*Cu+88.037*Mg+33.43*Cu*Mg-0.7763*Cu*Cu-126.267*Mg*Mg \quad (3)$$

An upper limit for $T_H$ is defined by:

$$T_S=579.2-10.48*Cu-71.6*Mg-1.3319*Cu*Mg-0.72*Cu*Cu+72.95*Mg*Mg \quad (4)$$

Figure 8:
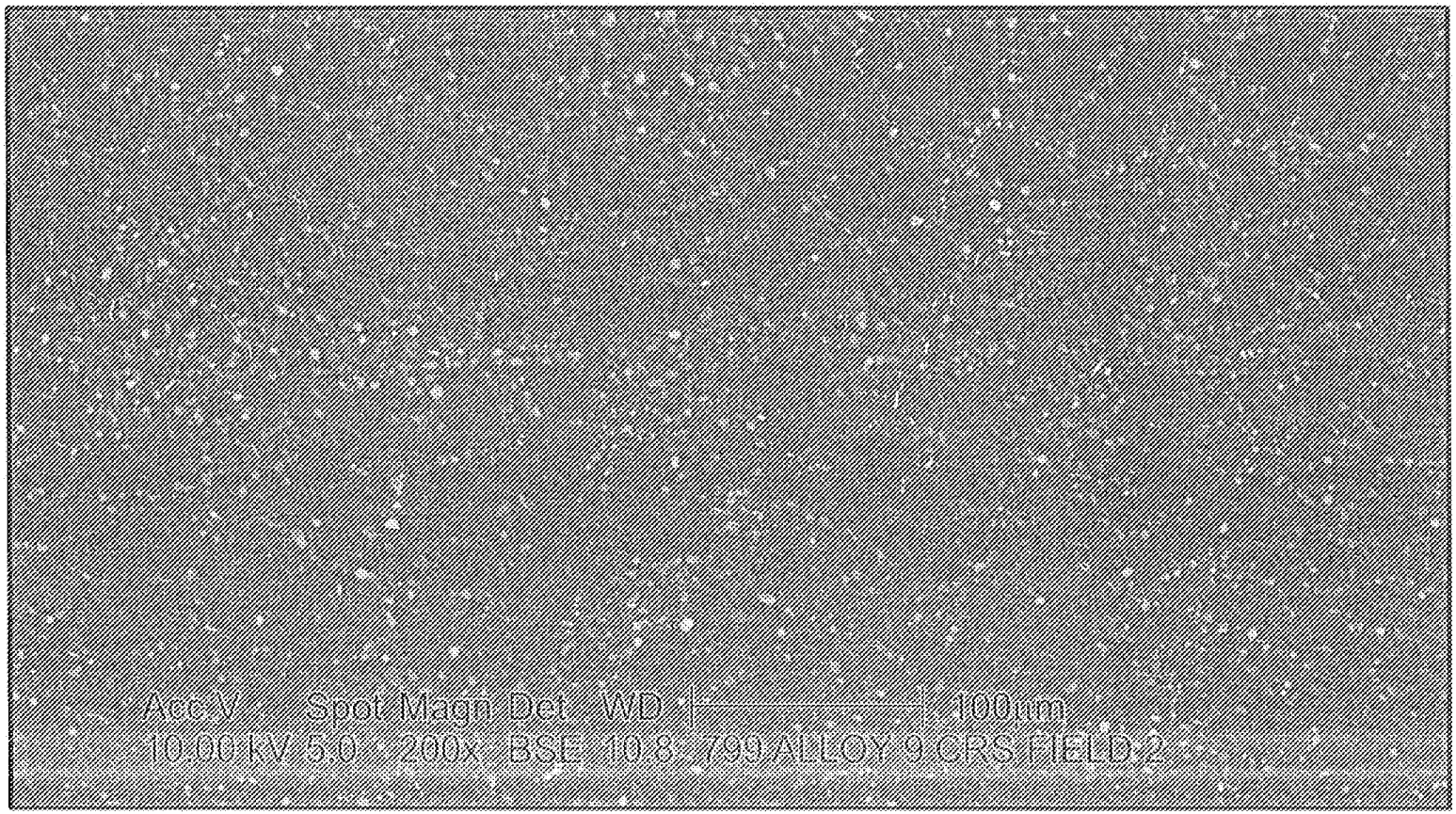
FIG. 8 is an SEM (scanning electron micrograph) @200× magnification, showing spherical Si particles and un-dissolved Fe-containing particles.
Figure 9B:
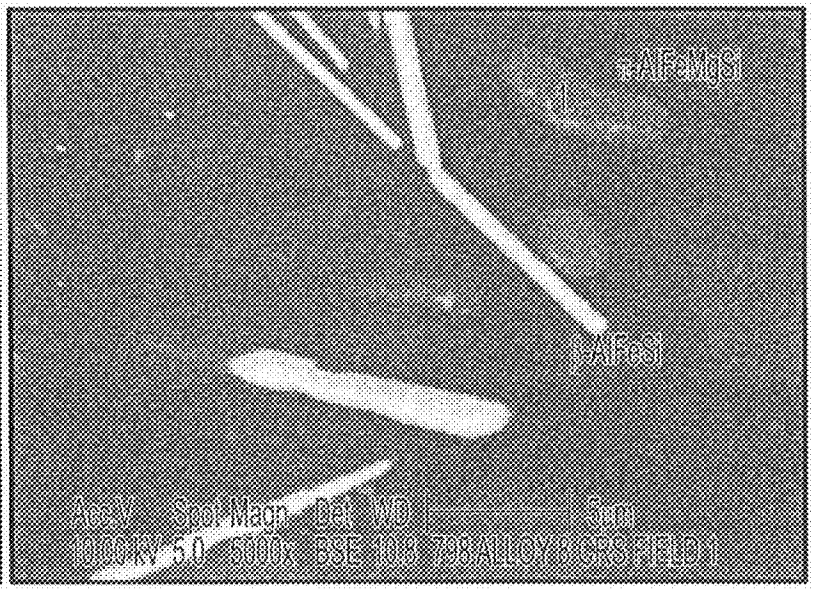
FIGS. 9*a-b* are photographs of undissolved Fe-containing particles in the investigated alloys.
Figure 9A:
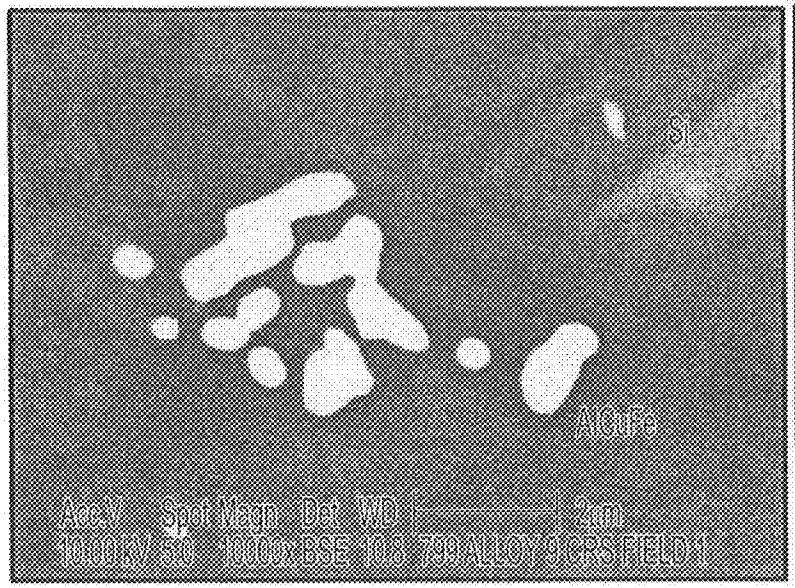
Figure 10A:
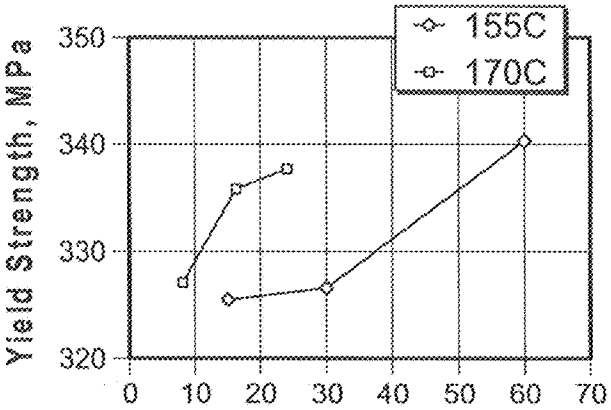
FIGS. 10*a-d* are graphs of the effect of aging condition on tensile properties of the Al-9Si-0.5Mg alloy.
Figure 10B:
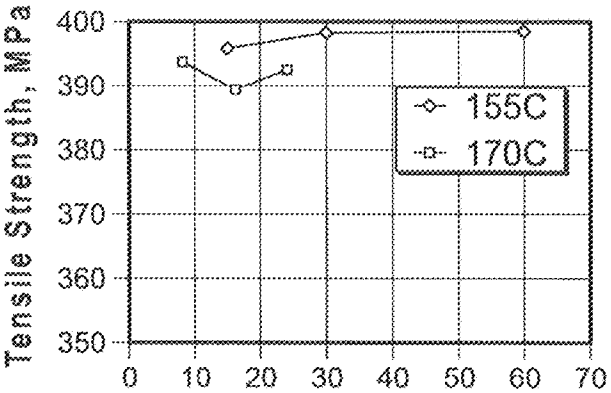
Figure 10C:
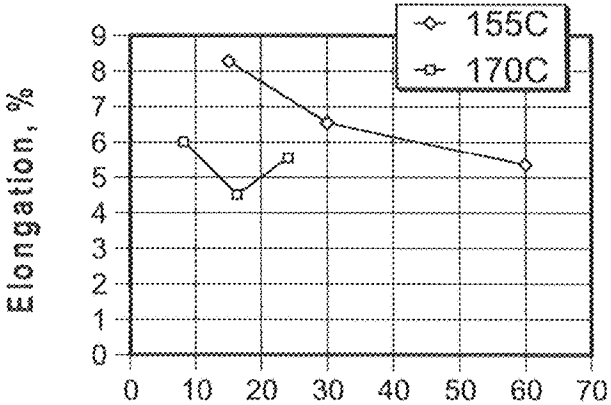
Figure 10D:
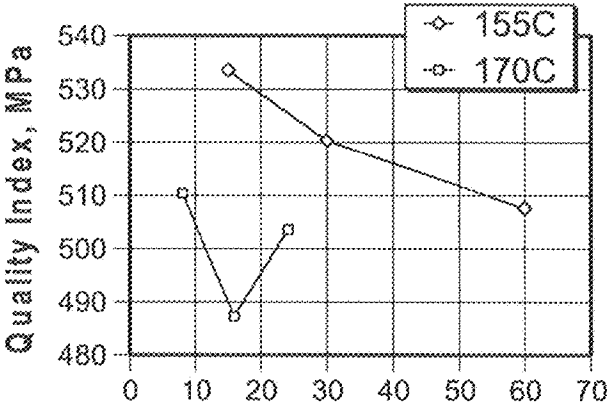
Figure 11A:
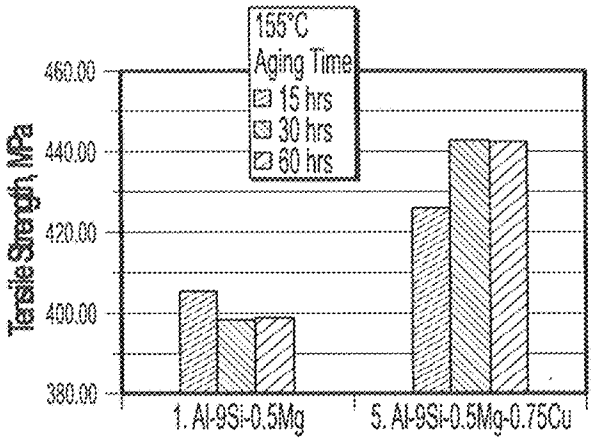
FIGS. 11*a-d* are graphs of the effect of Cu on tensile properties of the Al-9% Si-0.5% Mg alloy.
Figure 11B:
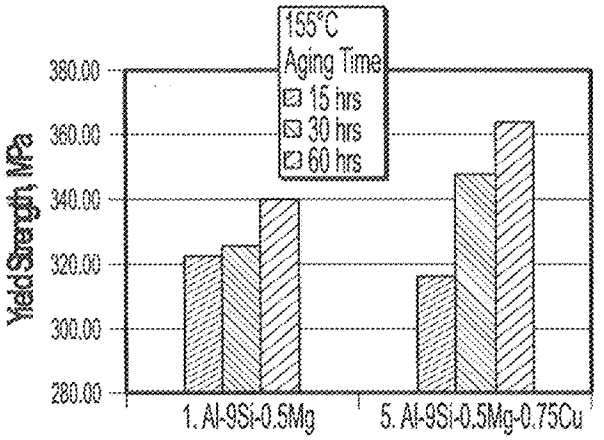
Figure 11C:
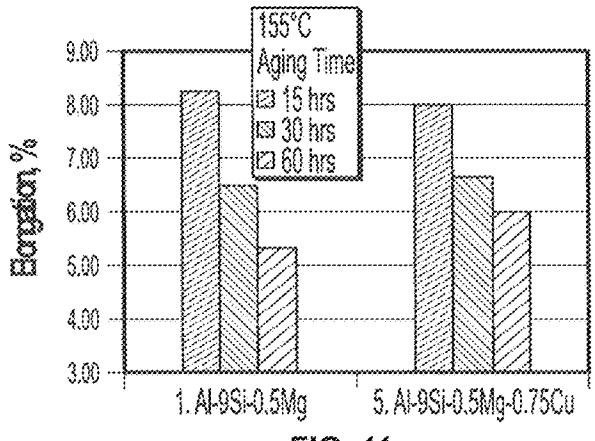
Figure 11D:
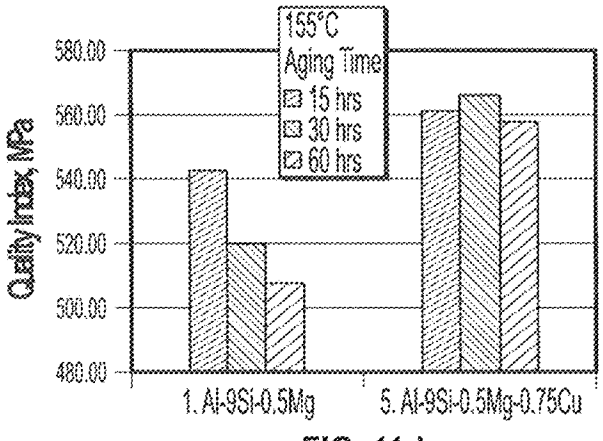
Figure 12B:
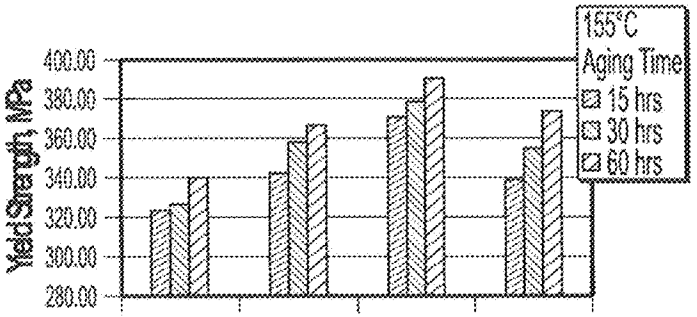
FIGS. 12*a-d* are graphs of the effect of Cu and Zn on tensile properties of the Al-9% Si-0.5% Mg alloy.
Figure 12A:
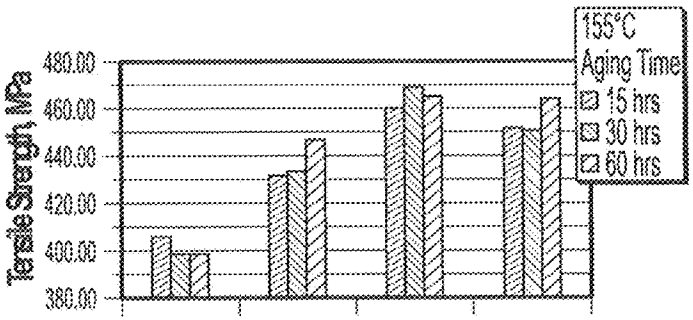
Figure 12D:
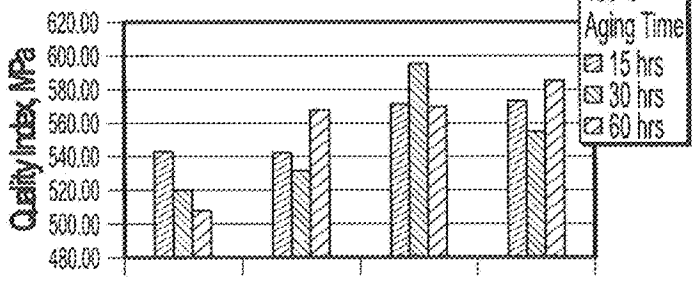
Figure 12C:
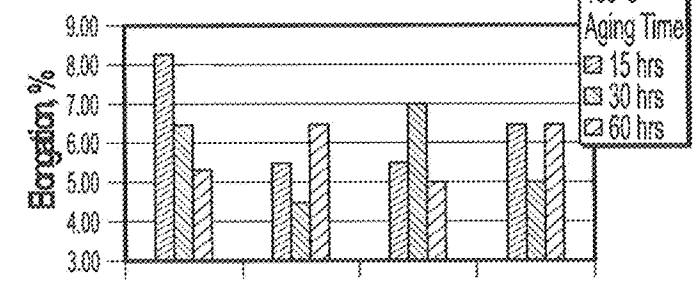
Figure 13B:
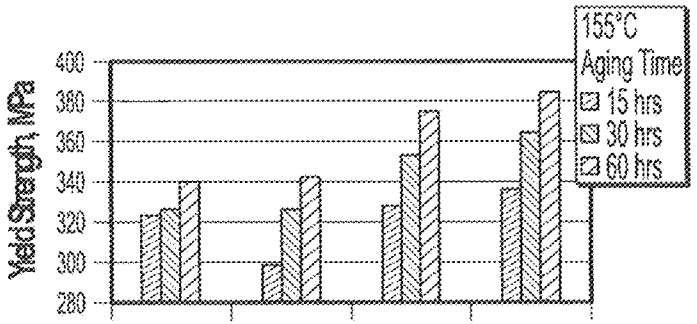
FIGS. 13*a-d* are graphs of the effect of Mg content on tensile properties of the Al-9% Si-1.25% Cu—Mg alloy.
Figure 13A:
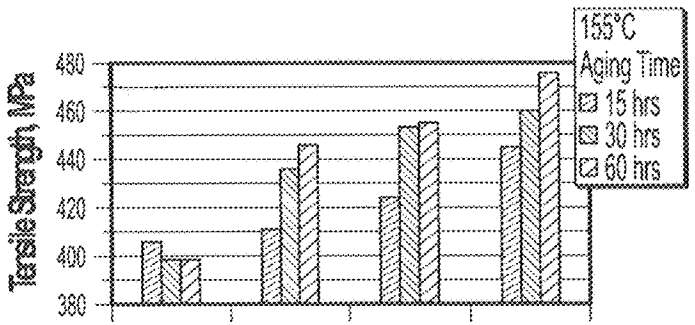
Figure 13D:
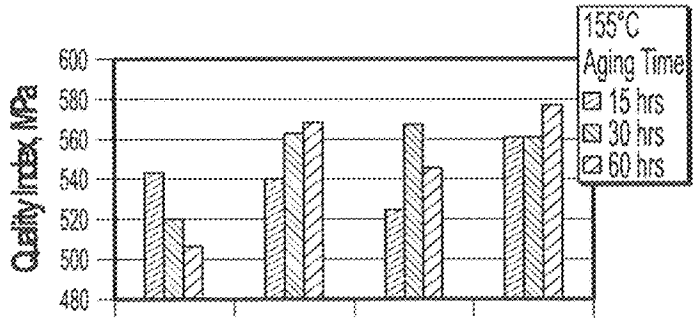
Figure 13C:
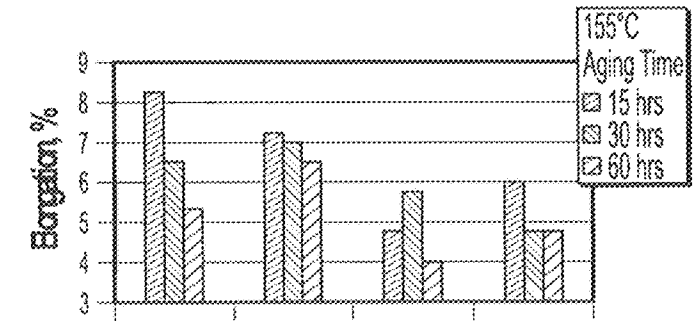
Figure 14B:
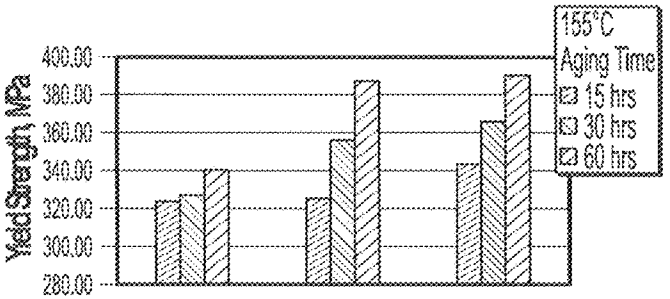
FIGS. 14*a-d* are graphs of the effect of Ag on tensile properties of the Al-9% Si-0.35% Mg-1.75% Cu alloy.
Figure 14D:
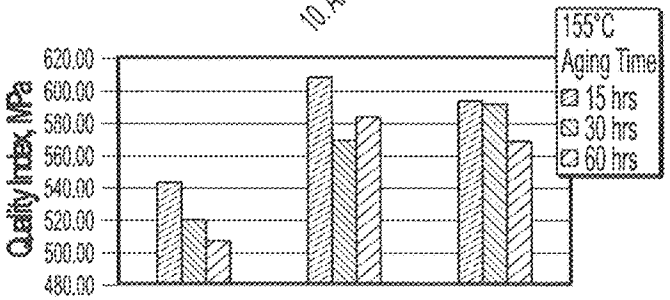
Figure 14A:
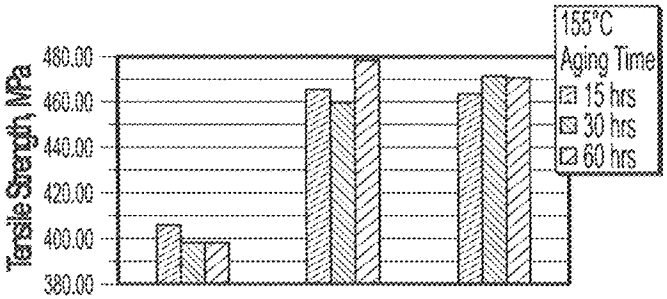
Figure 14C:
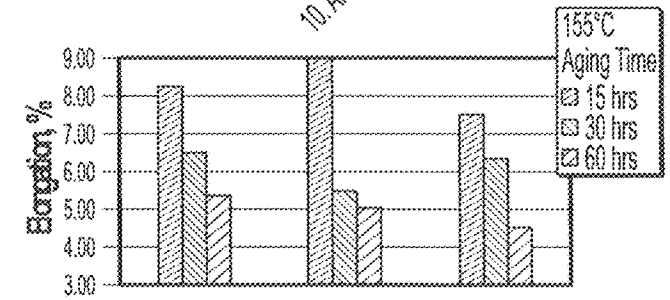
Figure 15B:
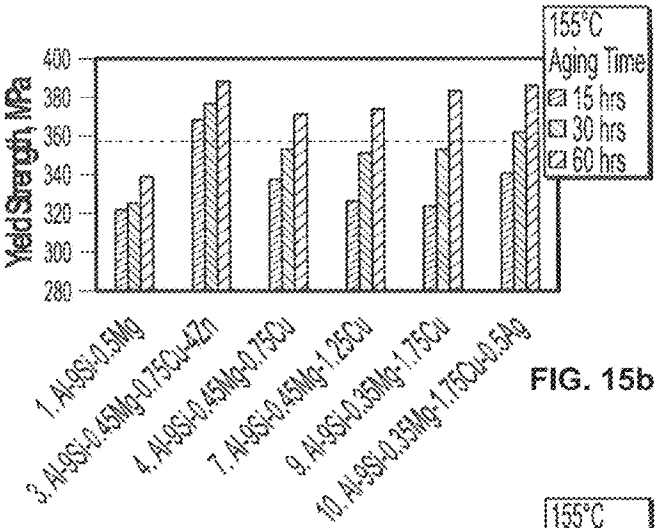
FIGS. 15*a-d* are graphs of tensile properties for six alloys aged for different times at an elevated temperature, as described in the disclosure.
Figure 15D:
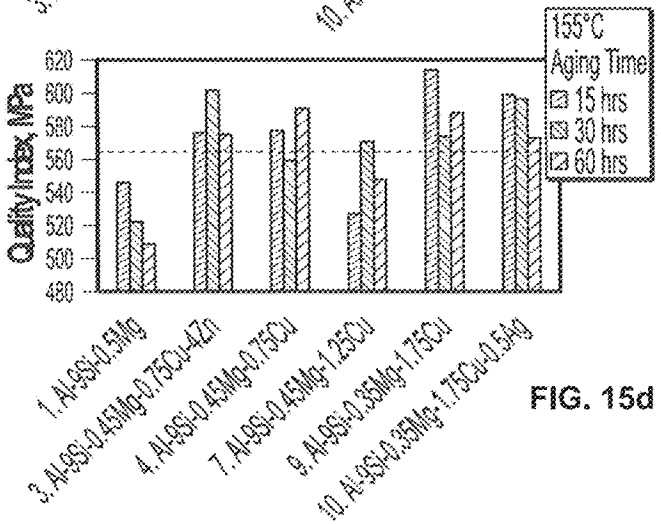
Figure 15A:
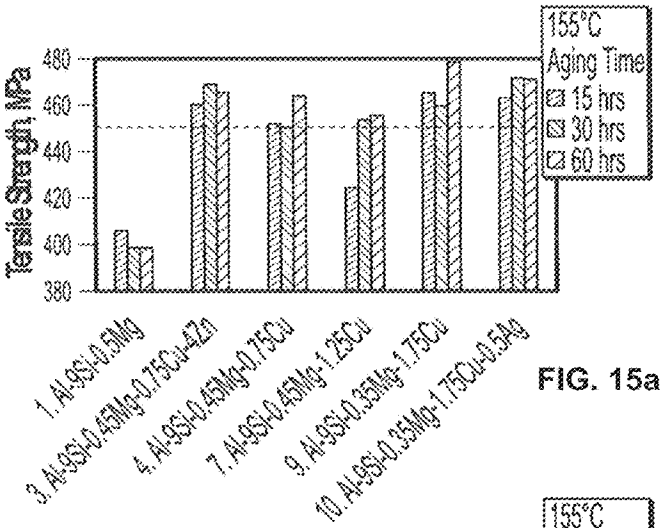
Figure 15C:
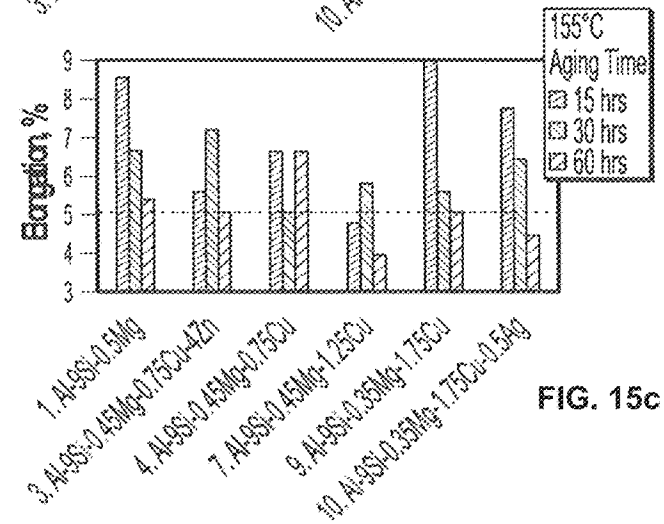

The microstructure of the solution heat treated specimens was characterized using optical and SEM microscopy. There were no un-dissolved Q-phase particles detected in all the Cu-containing alloys investigated. FIG. 8 shows the microstructure of the Al-9% Si-0.35% Mg-1.75% Cu alloy (alloy #9) in the T6 temper. Si particles were all well-spheroidized. Some un-dissolved particles were identified as β-AlFeSi, π-AlFeMgSi and $Al_7Cu_2Fe$ phases. The morphologies of these un-dissolved phases are shown in FIG. 9 at higher magnification.

1.4 Experimental Results 1.4.1 Property Characterization

Tensile properties were evaluated according to the ASTM B557 method. Test bars were cut from the modified ASTM B108 castings and tested on the tensile machine without any further machining. All the tensile results are an average of five specimens. Toughness of selected alloys was evaluated using the un-notched Charpy Impact test, ASTM E23-07a. The specimen size was 10 mm×10 mm×55 mm machined from the tensile-bar casting. Two specimens were measured for each alloy.

Smooth S-N fatigue test was conducted according to the ASTM E606 method. Three stress levels, 100 MPa, 150 MPa, and 200 MPa were evaluated. The R ratio was −1 and the frequency was 30 Hz. Three replicated specimens were tested for each condition. Test was terminated after about $10^7$ cycles. Smooth fatigue round specimens were obtained by slightly machining the gauge portion of the tensile bar casting.

Corrosion resistance (type-of-attack) of selected conditions was evaluated according to the ASTM G110 method. Corrosion mode and depth-of-attack on both the as-cast surface and machined surface were assessed.

All the raw test data including tensile, Charpy impact and S-N fatigue are given in Tables 7 to 9. A summary of the findings is given in the following sections.

TABLE 7

Mechanical properties of various alloys aged at 155° C. for different times*

| Alloy | Aged at 155° C. for 15 hrs | | | | Aged at 155° C. for 30 hrs | | | |
|---|---|---|---|---|---|---|---|---|
| | UTS (MPa) | TYS (MPa) | E (%) | Q (MPa) | UTS (MPa) | TYS (MPa) | E (%) | Q (MPa) |
| 1. Al—9Si—0.5Mg | 405.8 | 323.3 | 8.3 | 543.2 | 398.5 | 326.5 | 6.5 | 520.4 |
| 2. Al—9Si—0.35Mg—0.75Cu—4Zn | 431.5 | 342.0 | 5.5 | 542.6 | 433.5 | 358.0 | 4.5 | 531.5 |
| 3. Al—9Si—0.45Mg—0.75Cu—4Zn | 460.5 | 370.5 | 5.5 | 571.6 | 469.0 | 378.5 | 7.0 | 595.8 |
| 4. Al—9Si—0.45Mg—0.75Cu | 451.5 | 339.0 | 6.5 | 573.4 | 450.5 | 354.8 | 5.0 | 555.3 |
| 5. Al—9Si—0.5Mg—0.75Cu | 426.0 | 317.3 | 8.0 | 561.5 | 442.8 | 348.2 | 6.7 | 566.4 |
| 6. Al—9Si—0.35Mg—1.25Cu | 411.2 | 299.2 | 7.3 | 540.2 | 436.3 | 326.3 | 7.0 | 563.1 |
| 7. Al—9Si—0.45Mg—1.25Cu | 424.3 | 328.0 | 4.8 | 525.8 | 453.8 | 353.0 | 5.8 | 567.7 |
| 8. Al—9Si—0.55Mg—1.25Cu | 444.8 | 336.5 | 6.0 | 561.6 | 460.3 | 365.3 | 4.8 | 561.8 |
| 9. Al—9Si—0.35Mg—1.75Cu | 465.7 | 325.0 | 9.0 | 608.8 | 459.5 | 355.3 | 5.5 | 570.6 |
| 10. Al—9Si—0.35Mg—1.75Cu—0.5Ag | 463.3 | 343.0 | 7.5 | 594.5 | 471.7 | 364.5 | 6.3 | 591.9 |

| Alloy | Aged at 155° C. for 60 hrs | | | |
|---|---|---|---|---|
| | UTS (MPa) | TYS (MPa) | E (%) | Q (MPa) |
| 1. Al—9Si—0.5Mg | 398.7 | 340.2 | 5.3 | 507.7 |
| 2. Al—9Si—0.35Mg—0.75Cu—4Zn | 446.8 | 366.0 | 6.5 | 568.7 |
| 3. Al—9Si—0.45Mg—0.75Cu—4Zn | 465.3 | 390.7 | 5.0 | 570.2 |
| 4. Al—9Si—0.45Mg—0.75Cu | 464.0 | 373.5 | 6.5 | 585.9 |
| 5. Al—9Si—0.5Mg—0.75Cu | 442.5 | 364.5 | 6.0 | 559.2 |
| 6. Al—9Si—0.35Mg—1.25Cu | 446.5 | 342.8 | 6.5 | 568.4 |
| 7. Al—9Si—0.45Mg—1.25Cu | 455.3 | 375.8 | 4.0 | 545.6 |
| 8. Al—9Si—0.55Mg—1.25Cu | 475.8 | 385.0 | 4.8 | 577.3 |
| 9. Al—9Si—0.35Mg—1.75Cu | 478.8 | 386.3 | 5.0 | 583.6 |
| 10. Al—9Si—0.35Mg—1.75Cu—0.5Ag | 471.0 | 389.3 | 4.5 | 569.0 |

*Averaged value from five tensile specimens.
The Quality Index, Q = UTS + 150 log(E).

TABLE 8

Charpy impact test results for some selected alloys

| Alloy | Energy (ft-lbs) | | | |
|---|---|---|---|---|
| | 155° C./15 hrs | | 155° C./60 hrs | |
| | Specimen 1 | Specimen 3 | Specimen 7 | Specimen 9 |
| 1. Al—9Si—0.5Mg | 6 | 27 | 23 | 27 |
| 3. Al—9Si—0.45Mg—0.75Cu—4Zn | 17 | 18 | 10 | 12 |
| 4. Al—9Si—0.45Mg—0.75Cu | 32 | 15 | 28 | 13 |
| 7. Al—9Si—0.45Mg—1.25Cu | 27 | 12 | 7 | 12 |
| 9. Al—9Si—0.35Mg—1.75Cu | 16 | 15 | 8 | 9 |

TABLE 9

S-N fatigue results for some selected alloys aged at 155° C. for 60 hours ( Smooth, Axial; stress ratio = −1)

| Alloy | Stress (MPa) | Cycles to Failure | |
|---|---|---|---|
| | | 155 C./15 hrs | 155 C./60 hrs |
| 1. Al—9Si—0.5Mg | 100 | 1680725 | 1231620 |
| 1. Al—9Si—0.5Mg | 100 | 1302419 | 272832 |
| 1. Al—9Si—0.5Mg | 100 | 4321029 | 1077933 |

TABLE 9-continued

S-N fatigue results for some selected alloys aged at 155° C. for 60 hours ( Smooth, Axial; stress ratio = −1)

| Alloy | Stress (MPa) | Cycles to Failure | |
|---|---|---|---|
| | | 155 C./15 hrs | 155 C./60 hrs |
| 1. Al—9Si—0.5Mg | 150 | 71926 | 148254 |
| 1. Al—9Si—0.5Mg | 150 | 242833 | 42791 |
| 1. Al—9Si—0.5Mg | 150 | 153073 | 56603 |
| 1. Al—9Si—0.5Mg | 200 | 16003 | 54623 |
| 1. Al—9Si—0.5Mg | 200 | 8654 | 30708 |
| 1. Al—9Si—0.5Mg | 200 | 36597 | 39376 |
| 3. Al—9Si—0.45Mg—0.75Cu—4Zn | 100 | 160572 | 248032 |
| 3. Al—9Si—0.45Mg—0.75Cu—4Zn | 100 | 298962 | 131397 |
| 3. Al—9Si—0.45Mg—0.75Cu—4Zn | 100 | 120309 | 394167 |
| 3. Al—9Si—0.45Mg—0.75Cu—4Zn | 150 | 120212 | 12183 |
| 3. Al—9Si—0.45Mg—0.75Cu—4Zn | 150 | 70152 | 42074 |
| 3. Al—9Si—0.45Mg—0.75Cu—4Zn | 150 | 190200 | 31334 |
| 3. Al—9Si—0.45Mg—0.75Cu—4Zn | 200 | 38369 | 18744 |
| 3. Al—9Si—0.45Mg—0.75Cu—4Zn | 200 | 29686 | 14822 |
| 3. Al—9Si—0.45Mg—0.75Cu—4Zn | 200 | 39366 | 11676 |
| 4. Al—9Si—0.45Mg—0.75Cu | 100 | 485035 | 575446 |

TABLE 9-continued

S-N fatigue results for some selected alloys aged at 155° C. for 60 hours ( Smooth, Axial; stress ratio = −1)

| Alloy | Stress (MPa) | Cycles to Failure 155 C./ 15 hrs | Cycles to Failure 155 C./ 60 hrs |
|---|---|---|---|
| 4. Al—9Si—0.45Mg—0.75Cu | 100 | 4521553 | 233110 |
| 4. Al—9Si—0.45Mg—0.75Cu | 100 | 3287495 | 940229 |
| 4. Al—9Si—0.45Mg—0.75Cu | 150 | 170004 | 141654 |
| 4. Al—9Si—0.45Mg—0.75Cu | 150 | 110500 | 234640 |
| 4. Al—9Si—0.45Mg—0.75Cu | 150 | 688783 | 238478 |
| 4. Al—9Si—0.45Mg—0.75Cu | 200 | 108488 | 22686 |
| 4. Al—9Si—0.45Mg—0.75Cu | 200 | 40007 | 36390 |
| 4. Al—9Si—0.45Mg—0.75Cu | 200 | 51678 | 20726 |
| 7. Al—9Si—0.45Mg—1.25Cu | 100 | 1115772 | 1650686 |
| 7. Al—9Si—0.45Mg—1.25Cu | 100 | 318949 | 1744140 |
| 7. Al—9Si—0.45Mg—1.25Cu | 100 | 468848 | 484262 |
| 7. Al—9Si—0.45Mg—1.25Cu | 150 | 102341 | 232171 |
| 7. Al—9Si—0.45Mg—1.25Cu | 150 | 145766 | 106741 |
| 7. Al—9Si—0.45Mg—1.25Cu | 150 | 63720 | 226188 |
| 7. Al—9Si—0.45Mg—1.25Cu | 200 | 41686 | 21873 |
| 7. Al—9Si—0.45Mg—1.25Cu | 200 | 20709 | 58819 |
| 7. Al—9Si—0.45Mg—1.25Cu | 200 | 52709 | 4367 |
| 9. Al—9Si—0.35Mg—1.75Cu | 100 | 2159782 | 2288145 |
| 9. Al—9Si—0.35Mg—1.75Cu | 100 | 354677 | 1011473 |
| 9. Al—9Si—0.35Mg—1.75Cu | 100 | 4258369 | 783758 |
| 9. Al—9Si—0.35Mg—1.75Cu | 150 | 281867 | 164554 |
| 9. Al—9Si—0.35Mg—1.75Cu | 150 | 135810 | 188389 |
| 9. Al—9Si—0.35Mg—1.75Cu | 150 | 100053 | 146740 |
| 9. Al—9Si—0.35Mg—1.75Cu | 200 | 24014 | 48506 |
| 9. Al—9Si—0.35Mg—1.75Cu | 200 | 30695 | 8161 |
| 9. Al—9Si—0.35Mg—1.75Cu | 200 | 62211 | 31032 |

1.4.2 Mechanical Properties at Room Temperature 1.4.2.1 Effect of Aging Temperature on Tensile Properties The effect of artificial aging temperature on tensile properties was investigated using the baseline alloy 1-Al-9% Si-0.5% Mg. After a minimum 4 hours of natural aging, the tensile bar castings were aged at 155° C. for 15, 30, 60 hours and at 170° C. for 8, 16, 24 hours. Three replicate specimens were used for each aging condition.

FIG. 10 shows the tensile properties of the baseline A359 alloy (Al-9% Si-0.5% Mg) at various aging conditions. Low aging temperature (155° C.) tends to yield higher quality index than the high aging temperature (170° C.). Thus, the low aging temperature at 155° C. was selected, even though the aging time is longer to obtain improved properties.

1.4.2.2 Effects of Alloy Elements on Tensile Properties

FIG. 11 compares the tensile properties of baseline Al-9% Si-0.5% Mg alloy and Al-9% Si-0.5% Mg-0.75% Cu alloy. The addition of 0.75% Cu to Al-9% Si-0.5% Mg alloy increases the yield strength by ~20 MPa and ultimate tensile strength by ~40 MPa while maintaining the elongation. The average quality index of the Cu-containing alloy is ~560 MPa, which is much higher than the baseline alloy with an average of ~520 MPa.

FIG. 12 compares the tensile properties of four cast alloys, 1, 2, 3 and 4. Alloy 1 is the baseline alloy. Alloy 2-4 all contain 0.75% Cu with various amounts of Mg and/or Zn. Alloys 3 and 4 contain 0.45% Mg, while alloy 2 contains 0.35% Mg and alloy 1 contains 0.5% Mg. Alloys 2 and 3 also have 4% Zn. A preliminary assessment of these four alloys indicates that Mg and Zn increase alloy strength without sacrificing ductility. A direct comparison between alloys 3 and 4 indicates that by adding 4% Zn to the Al-9% Si-0.45% Mg-0.75% Cu alloy, both ultimate tensile strength and yield strength are increased while maintaining the elongation. The 4% Zn addition also increases the aging kinetics as indicated in FIG. 12. When aged at 155° C. for 15 hours, yield strength of about 370 MPa can be achieved for the Al-9% Si-0.45% Mg-0.75% Cu-4% Zn alloy, which is about 30 MPa higher than that of the alloy without Zn.

FIG. 13 shows the effect of Mg content (0.35-0.55 wt %) on the tensile properties of the Al-9% Si-1.25% Cu—Mg alloys (Alloys 6-8). The tensile properties of the baseline alloy Al-9% Si-0.5% Mg are also included for comparison. Mg content showed significant influence on the tensile properties. With increasing Mg content, both yield strength and tensile strength were increased, but the elongation was decreased. The decrease of elongation with increasing Mg content could be related to higher amount of π-AlFeMgSi phase particles even if all the Q-AlCuMgSi phase particles were dissolved. The impact of Mg content on quality indexes of the Al-9% Si-1.25% Cu—Mg alloys was overall found to be insignificant.

FIG. 14 shows the effect of Ag (0.5 wt %) on the tensile properties of Al-9% Si-0.35% Mg-1.75% Cu alloy. An addition of 0.5 wt % Ag had very limited impact on strength, elongation and quality index of the Al-9% Si-0.35% Mg-1.75% Cu alloy. It should be noted that the quality index of the Al-9% Si-0.35% Mg-1.75% Cu (without Ag) alloy is ~60 MPa higher than the baseline alloy, A359 (Alloy 1).

FIGS. 15*a*-15*d* show the tensile properties of five promising alloys in accordance with the present disclosure along with the baseline alloy Al-9Si-0.5 Mg (alloy 1). These five alloys achieve the target tensile properties, i.e., 10-15% increase in tensile and maintaining similar elongation as A356/A357 alloy. The alloys are: Al-9% Si-0.45% Mg-0.75% Cu (Alloy 4), Al-9% Si-0.45% Mg-0.75% Cu-4% Zn (Alloy 3), Al-9% Si-0.45% Mg-1.25% Cu (Alloy 7), Al-9% Si-0.35% Mg-1.75% Cu (Alloy 9), and Al-9% Si-0.35% Mg-1.75% Cu-0.5% Ag (Alloy 10).

Based on the data, it is believed that the following tensile properties can be obtained with alloys aged at 155° C. for time ranged from 15 to 60 hrs.

| | |
|---|---|
| Ultimate tensile strength: | 450-470 MPa |
| Tensile yield strength: | 360-390 MPa |
| Elongation: | 5-7% |
| Quality index: | 560-590 MPa |

These properties are much higher than A359 (Alloy 1) and are very similar to A201 (Al4.6Cu0.35Mg0.7Ag) cast alloy (UTS 450 MPa, TYS 380 MPa, Elongation 8%, and Q 585 MPa) ASM Handbook Volume 15, Casting, ASM International, December 2008. On the other hand, the castability of these Al-9% Si—Mg—Cu alloys is much better than A201 alloy. The A201 alloy has a poor castability due to its high tendency of hot cracking and Cu macro-segregation. Additionally, the material cost of A201 with 0.7 wt % Ag is also much higher than those embodiments in accordance with the present disclosure that are Ag-free.

Based on the tensile property results, four alloys without Ag (Alloys 3, 4, 7 and 9) with promising tensile properties along with baseline alloy, A359 (Alloy 1) were selected for further investigation. Charpy impact, S-N fatigue and general corrosion tests were conducted on these five alloys aged at 155° C. for 15 hours and 60 hours.

1.4.4 Charpy Impact Tests

Figure 16:
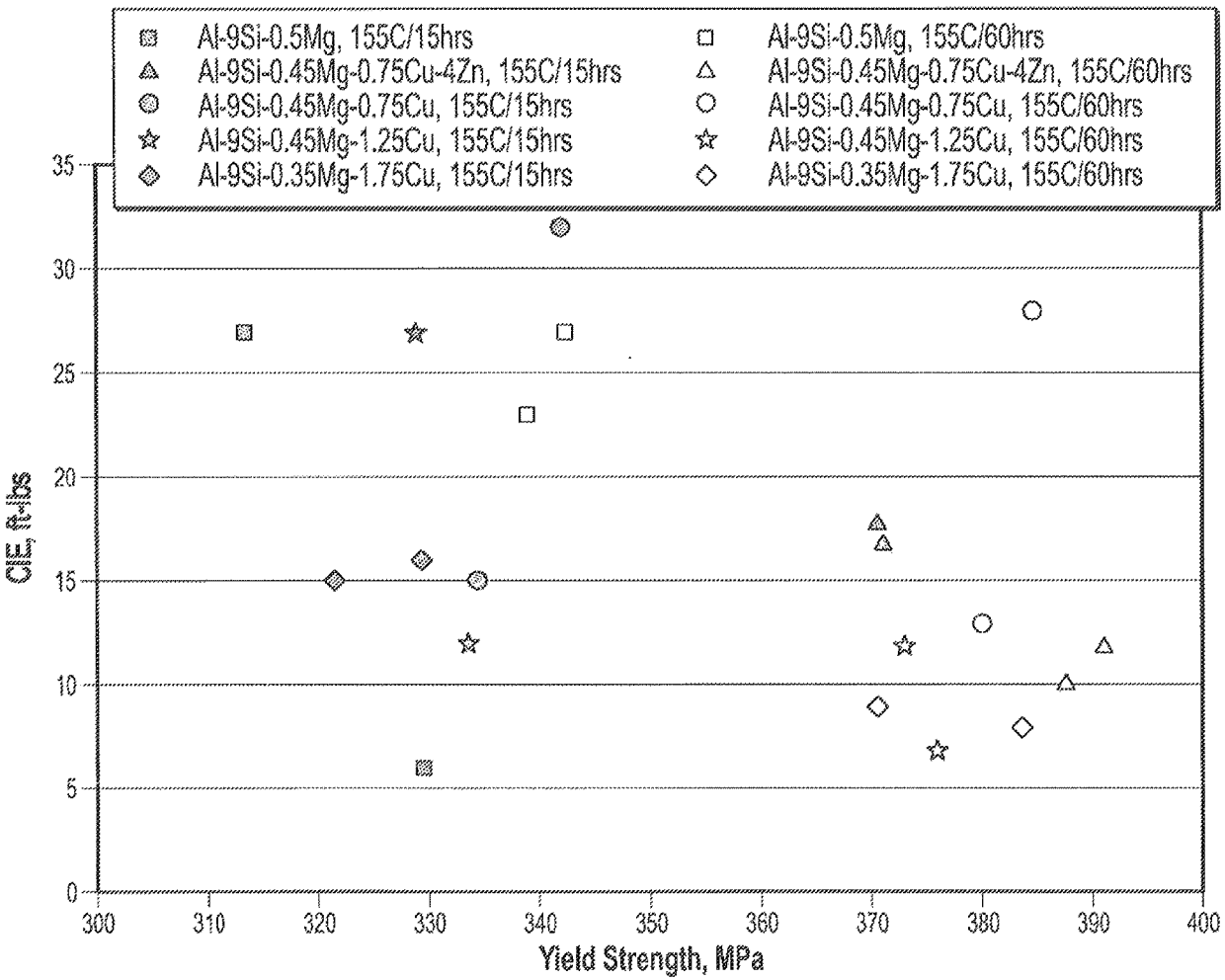
FIG. 16 is a graph of Charpy impact energy (CIE) vs. yield strength for five alloys aged for different times at an elevated temperature.

FIG. 16 shows the results of the individual tests by plotting Charpy impact energy vs. tensile yield strength. The filled symbols are for specimens aged at 155° C. for 15 hours and open symbols are for specimens aged at 155° C. for 60 hours. Tensile yield strength increases as the aging time increases, while the Charpy impact energy decreases with increasing aging time. The results indicate that most alloys/aging conditions follow the expected strength/toughness relationship. However, the results indeed show a slight degradation of the strength/toughness relationship with higher Cu content such as 1.25 and 1.75 wt %.

1.4.5 S-N Fatigue Tests

Aluminum castings are often used in engineered components subject to cycles of applied stress. Over their commercial lifetime millions of stress cycles can occur, so it is important to characterize their fatigue life. This is especially true for safety critical applications, such as automotive suspension components.

Figure 17:
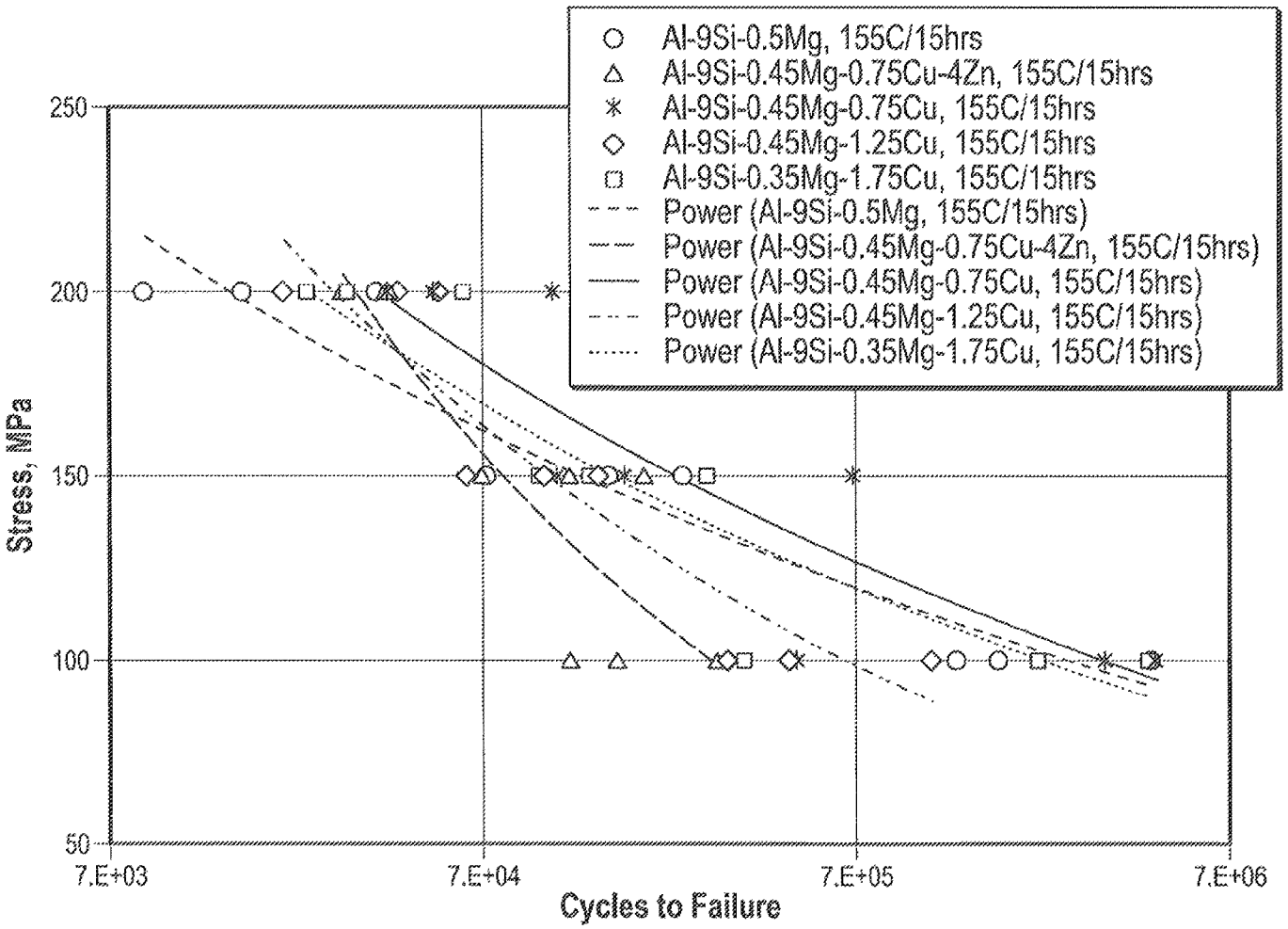
FIG. 17 is a graph of S-N fatigue curves of selected alloys aged at 155° C. for 15 hours. Smooth, Axial; stress ratio=−1.
Figure 18:
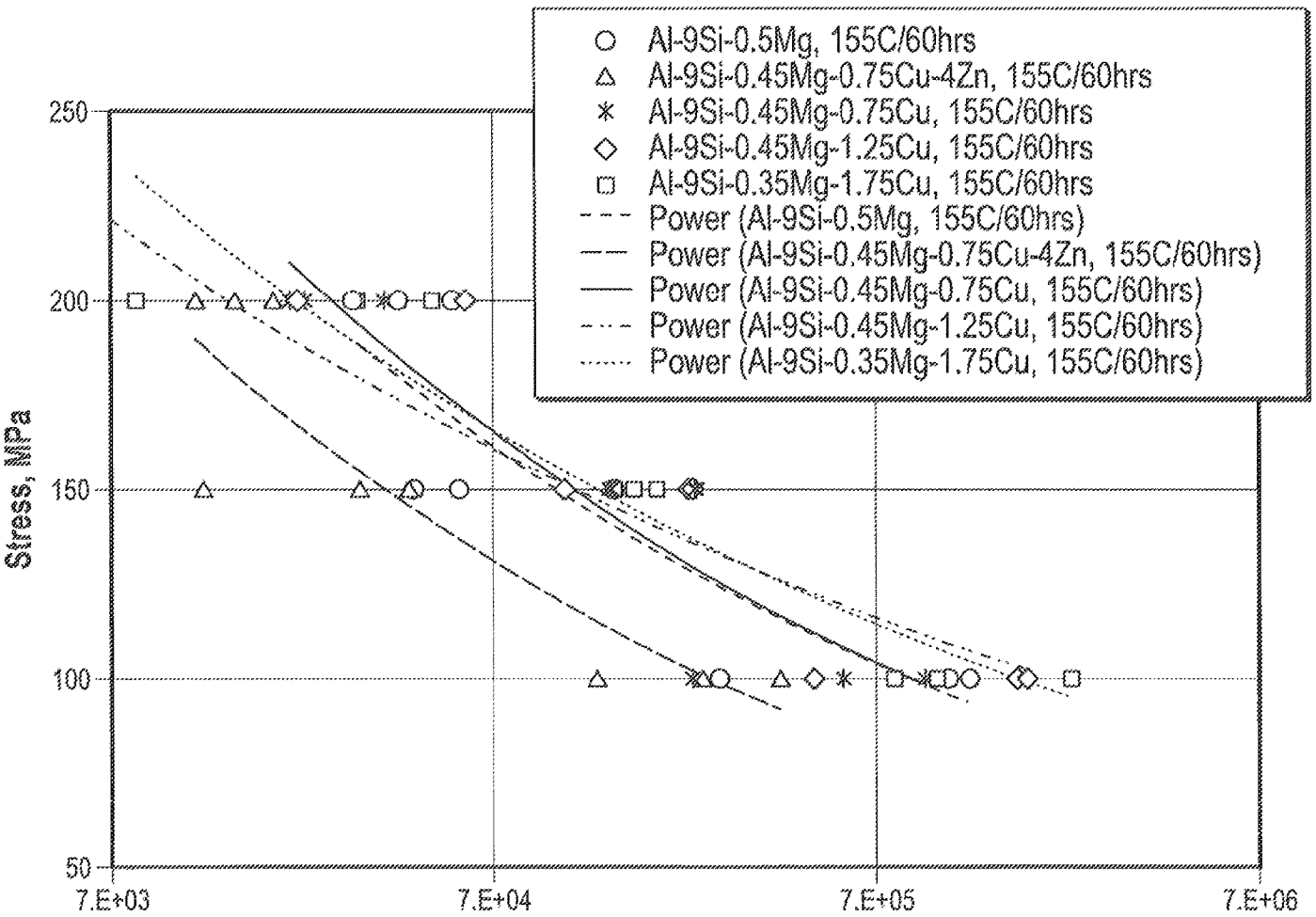
FIG. 18 is a graph of S-N fatigue curves of selected alloys aged at 155° C. for 60 hours. Smooth, Axial; stress ratio=−1.
Figure 19A:
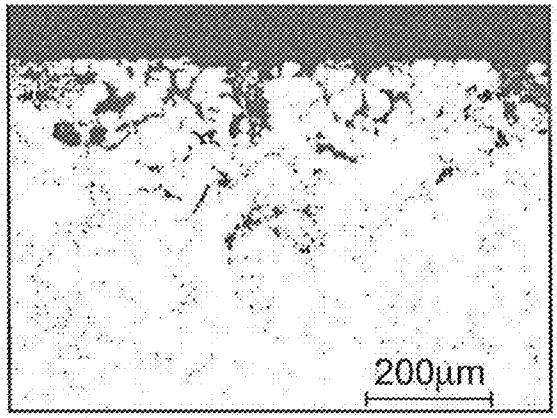
FIG. 19*a-d*-23*a-d* are optical micrographs of cross-sections of samples of five alloys as cast and machined and aged for two different time periods at an elevated temperature after 6-hour ASTM G110.
Figure 19B:
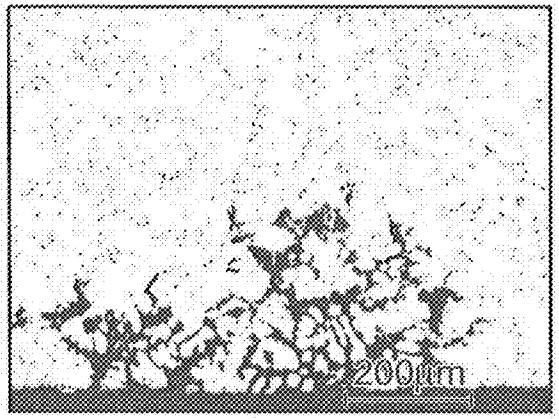
Figure 19C:
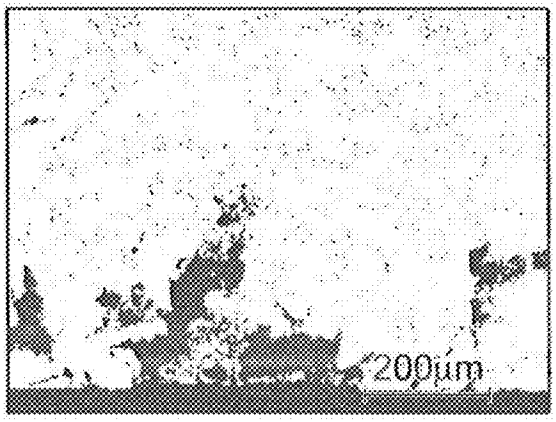
Figure 19D:
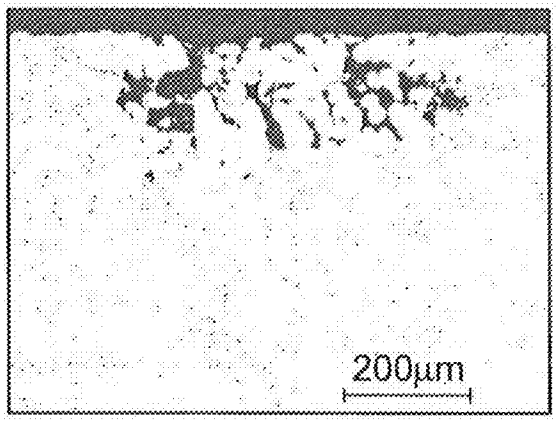
Figure 20A:
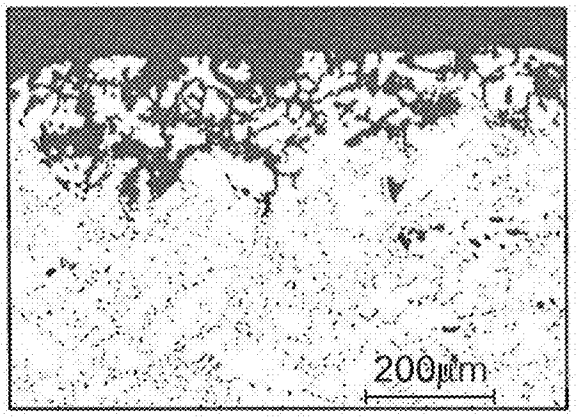
Figure 20B:
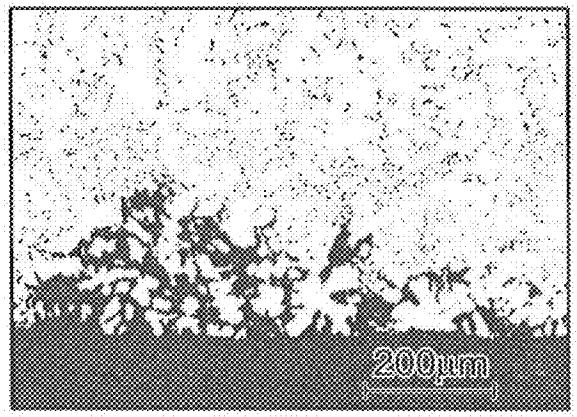
Figure 20C:
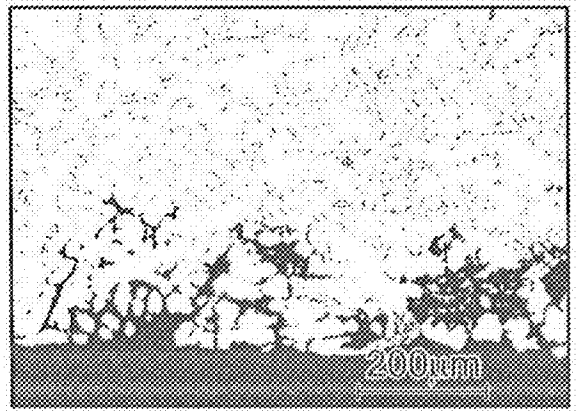
Figure 20D:
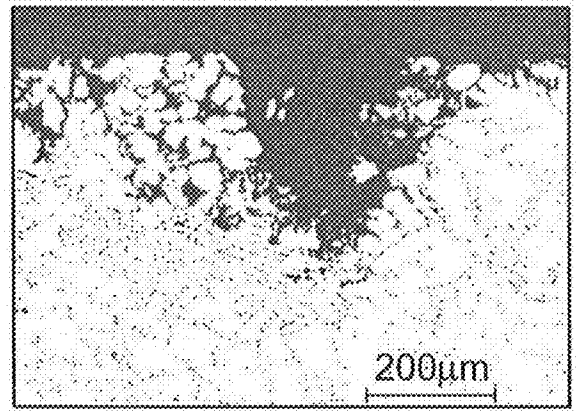
Figure 21A:
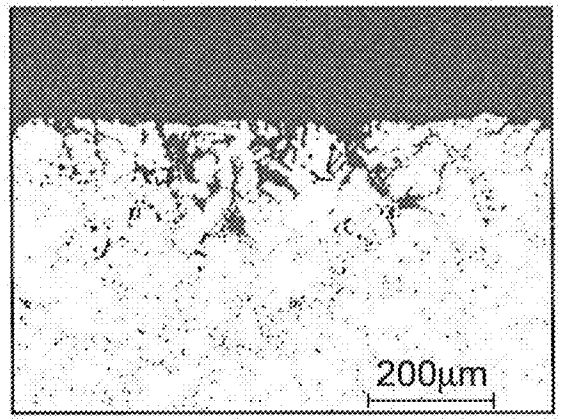
Figure 21B:
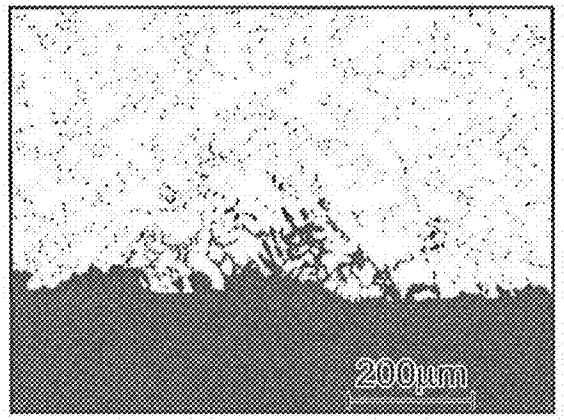
Figure 21C:
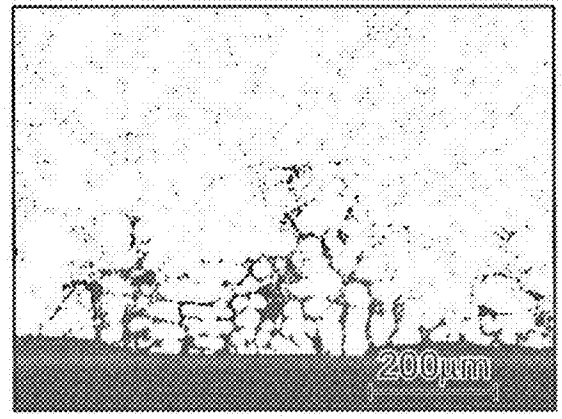
Figure 21D:
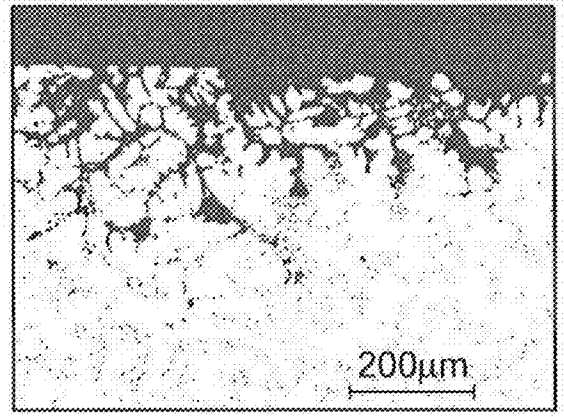
Figure 22A:
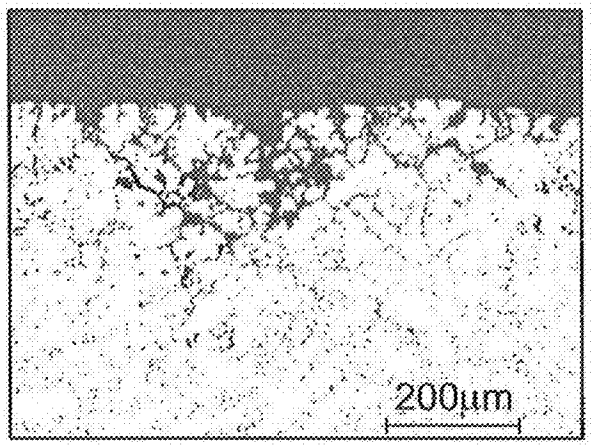
Figure 22B:
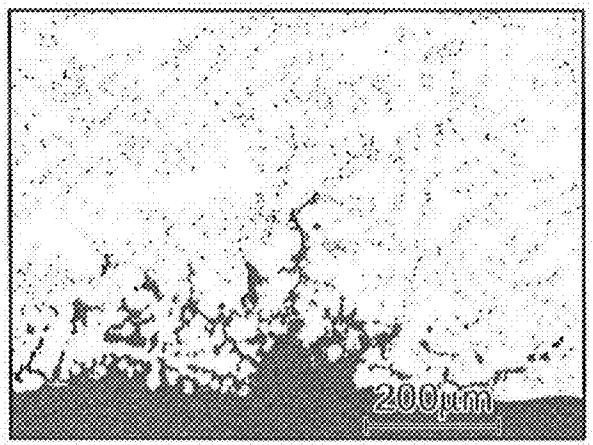
Figure 22C:
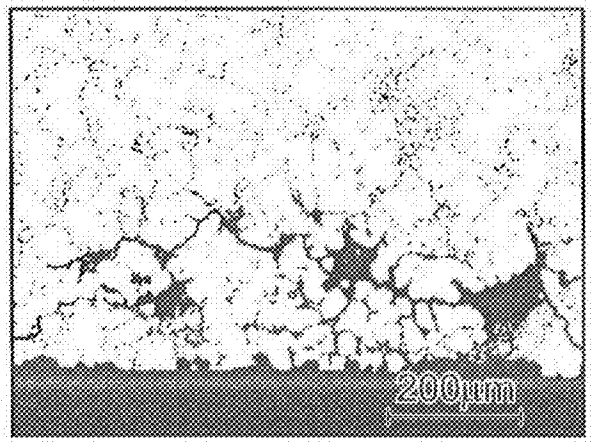
Figure 22D:
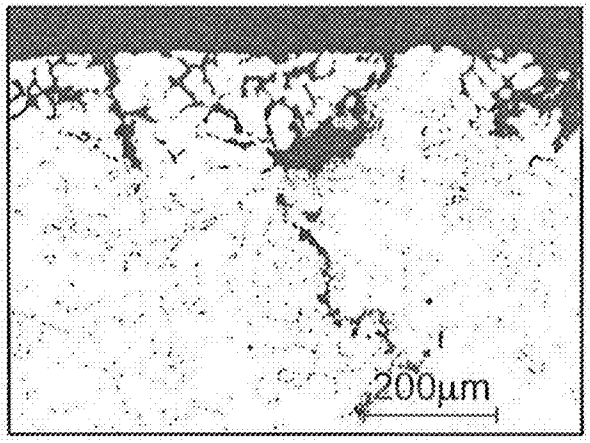
Figure 23A:
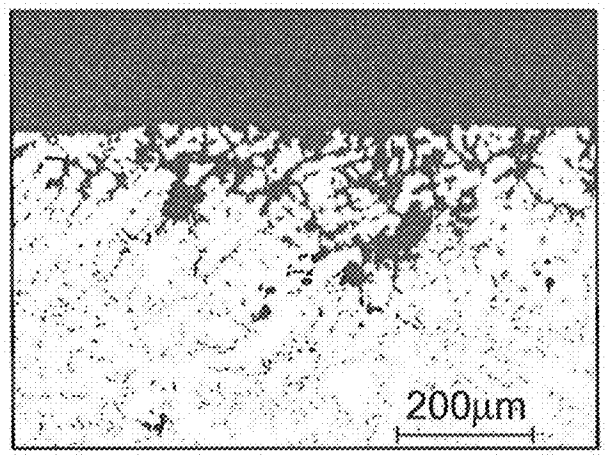
Figure 23B:
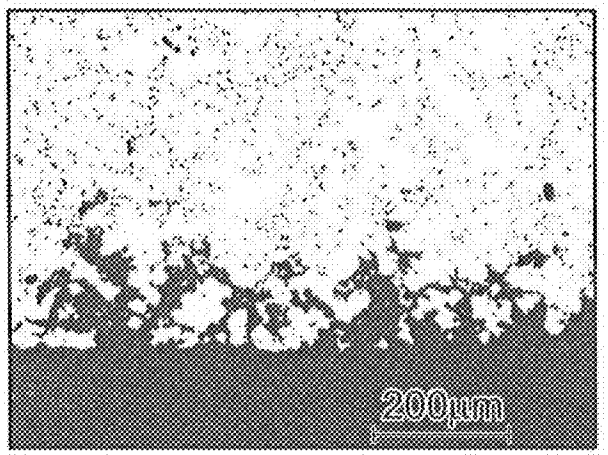
Figure 23C:
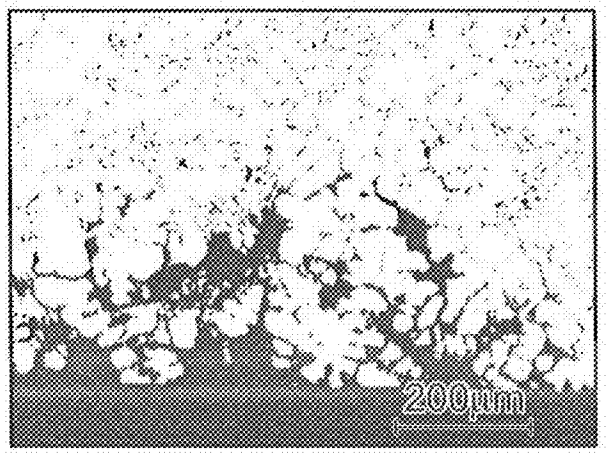
Figure 23D:
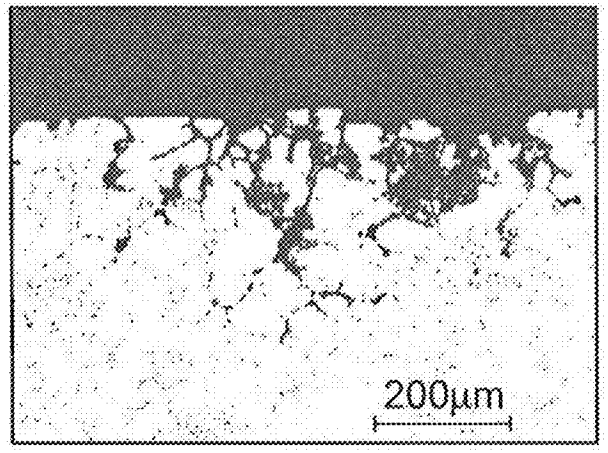

FIGS. 17 and 18 show the S-N fatigue test results of five selected alloys aged at 155° C. for 15 and 60 hours, respectively. During these tests a constant amplitude stress (R=−1) was applied to the test specimens. Three different stress levels, 100 MPa, 150 MPa and 200 MPa were applied. The total number of cycles to failure was recorded.

When aged at 155° C. for 15 hours, all the Cu-containing alloys showed better fatigue performance (higher number of cycles to failure) than the baseline A359 alloy at higher stress levels (>150 MPa). At lower stress levels (<125 MPa), the fatigue lives of the Al-9Si-0.45Mg-0.75Cu and Al-9Si-0.35Mg-1.75Cu alloys are very similar to the A359 alloy, while the fatigue life of the Al-9Si-0.45Cu-0.75Cu-4Zn alloy (alloy 3) was lower than the A359 alloy. The lower fatigue life of this alloy could result from the higher hydrogen content of the casting, as stated previously.

Increasing aging time (higher tensile strength) tended to decrease the number of cycles to failure. For example, as the aging time increased from 15 hours to 60 hours, the average number of cycles to failure at 150 MPa stress level decreased from ~323,000 to ~205,000 for the Al-9% Si-0.45% Mg-0.75% Cu alloy and from ~155,900 to ~82,500 for the A359 alloy. The result could be a general trend of the strength/fatigue relationship of Al—Si—Mg—(Cu) casting alloys. Again, alloy 3 showed a lower fatigue performance than others.

1.4.6 Corrosion Tests—ASTM G110

FIGS. 19 to 23 show optical micrographs of the cross-sectional views after 6-hour ASTM G110 tests for five selected alloys of both the as-cast surfaces and machined surfaces. The mode of corrosion attack was predominantly interdendritic corrosion. The number of corrosion sites was generally higher in the four Cu-containing compositions than in the Cu-free baseline alloy.

More particularly, FIGS. 19*a-d* show optical micrographs of cross-sections of Al-9% Si-0.5% Mg after a 6-hour ASTM G110 test: a) of the alloy as cast and aged 15 hours at 155° C.; b) of the alloy as cast and aged 60 hours at 155° C.; c) of the alloy with a machined surface and aged 15 hours at 155° C.; and d) of the alloy with a machined surface and aged 60 hours at 155° C.

FIGS. 20*a-d* show optical micrographs of cross-sections of Al-9% Si-0.35% Mg-0.75% Cu-4% Zn after a 6-hour ASTM G110 test: a) of the alloy as cast and aged 15 hours at 155° C.; b) of the alloy as cast and aged 60 hours at 155° C.; c) of the alloy with a machined surface and aged 15 hours at 155° C.; and d) of the alloy with a machined surface and aged 60 hours at 155° C.

FIGS. 21*a-d* show optical micrographs of cross-sections of Al-9% Si-0.45% Mg-0.75% Cu after a 6-hour ASTM G110 test: a) of the alloy as cast and aged 15 hours at 155° C.; b) of the alloy as cast and aged 60 hours at 155° C.; c) of the alloy with a machined surface and aged 15 hours at 155° C.; and d) of the alloy with a machined surface and aged 60 hours at 155° C.

FIGS. 22*a-d* show optical micrographs of cross-sections of Al-9% Si-0.45% Mg-1.25% Cu after a 6-hour ASTM G110 test: a) of the alloy as cast and aged 15 hours at 155° C.; b) of the alloy as cast and aged 60 hours at 155° C.; c) of the alloy with a machined surface and aged 15 hours at 155° C.; and d) of the alloy with a machined surface and aged 60 hours at 155° C.

FIGS. 23*a-d* show optical micrographs of cross-sections of Al-9% Si-0.35% Mg-1.75% Cu after a 6-hour ASTM G110 test: a) of the alloy as cast and aged 15 hours at 155° C.; b) of the alloy as cast and aged 60 hours at 155° C.; c) of the alloy with a machined surface and aged 15 hours at 155° C.; and d) of the alloy with a machined surface and aged 60 hours at 155° C.

Figure 24:
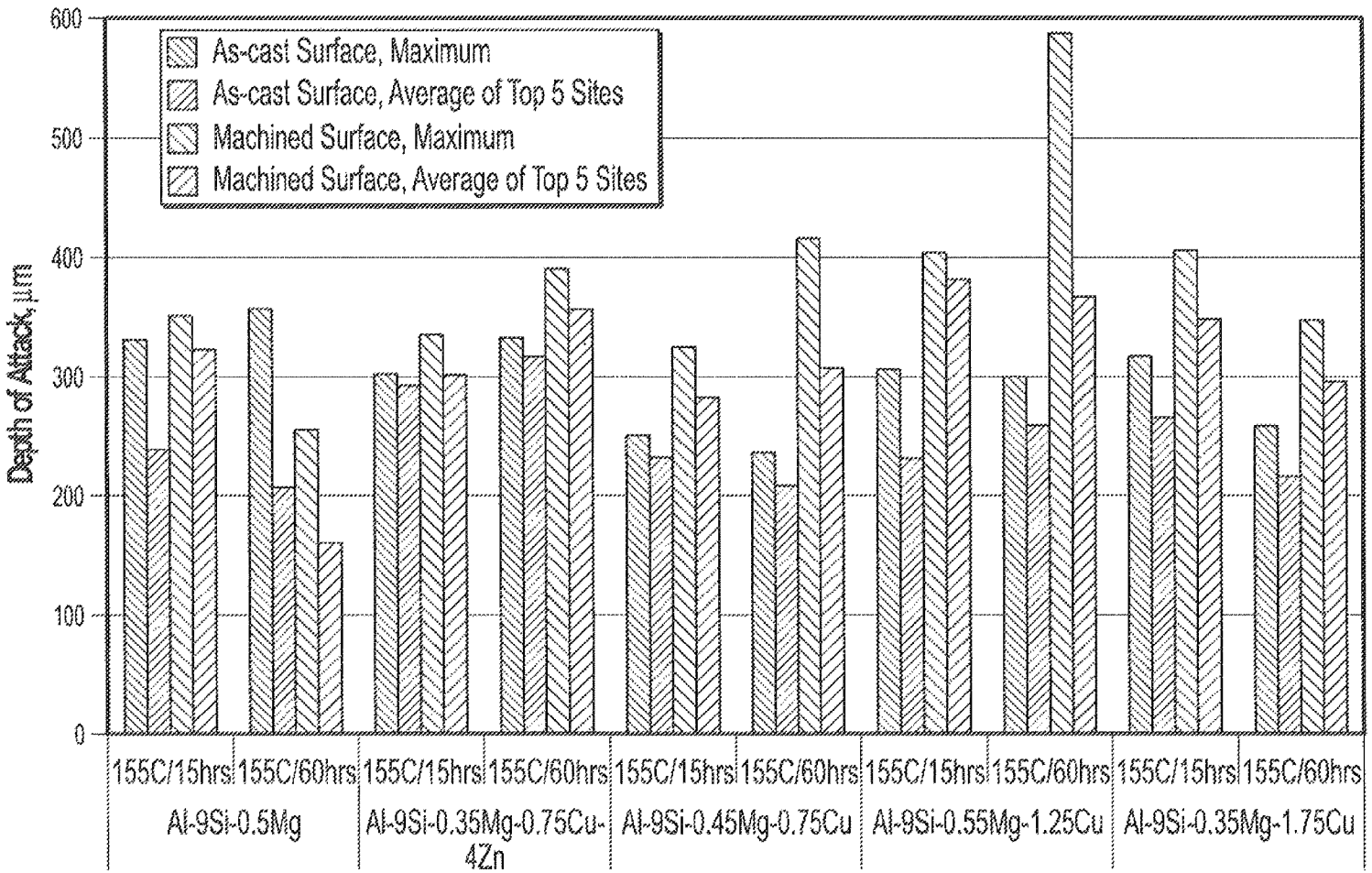
FIG. 24 is a graph of depth of attack of selected alloys aged for different time periods on the as-cast and machined surfaces after a 6-hour G110 test.

FIG. 24 shows the depth of attack after the 6-hour ASTM G110 test. There is no clear difference or trend among the alloys. Aging time did not show obvious impact on the depth of attack either, while some differences were found between the as-cast surfaces and the machined surfaces. In general, the corrosion attack was slightly deeper on the machined surface than the as-cast surface of the same sample.

Overall, the additions of Cu or Cu+Zn do not change the corrosion mode nor increase the depth-of-attack of the alloys. It is believed that all the alloys evaluated have similar corrosion resistance as the baseline alloy, A359.

The present disclosure has described Al—Si—Cu—Mg alloys that can achieve high strength without sacrificing ductility. Tensile properties including 450-470 MPa ultimate tensile strength, 360-390 MPa yield strength, 5-7% elongation, and 560-590 MPa Quality Index were obtained. These properties exceed conventional 3xx alloys and are very similar to that of the A201 (2xx+Ag) Alloy, while the castabilities of the new Al-9Si—MgCu alloys are much better than that of the A201 alloy. The new alloys showed better S-N fatigue resistance than A359 (Al-9Si-0.5 Mg) alloys. Alloys in accordance with the present disclosure have adequate fracture toughness and general corrosion resistance.

EXAMPLE 2

Cast Alloys for Applications at Elevated Temperatures

Figure 26:
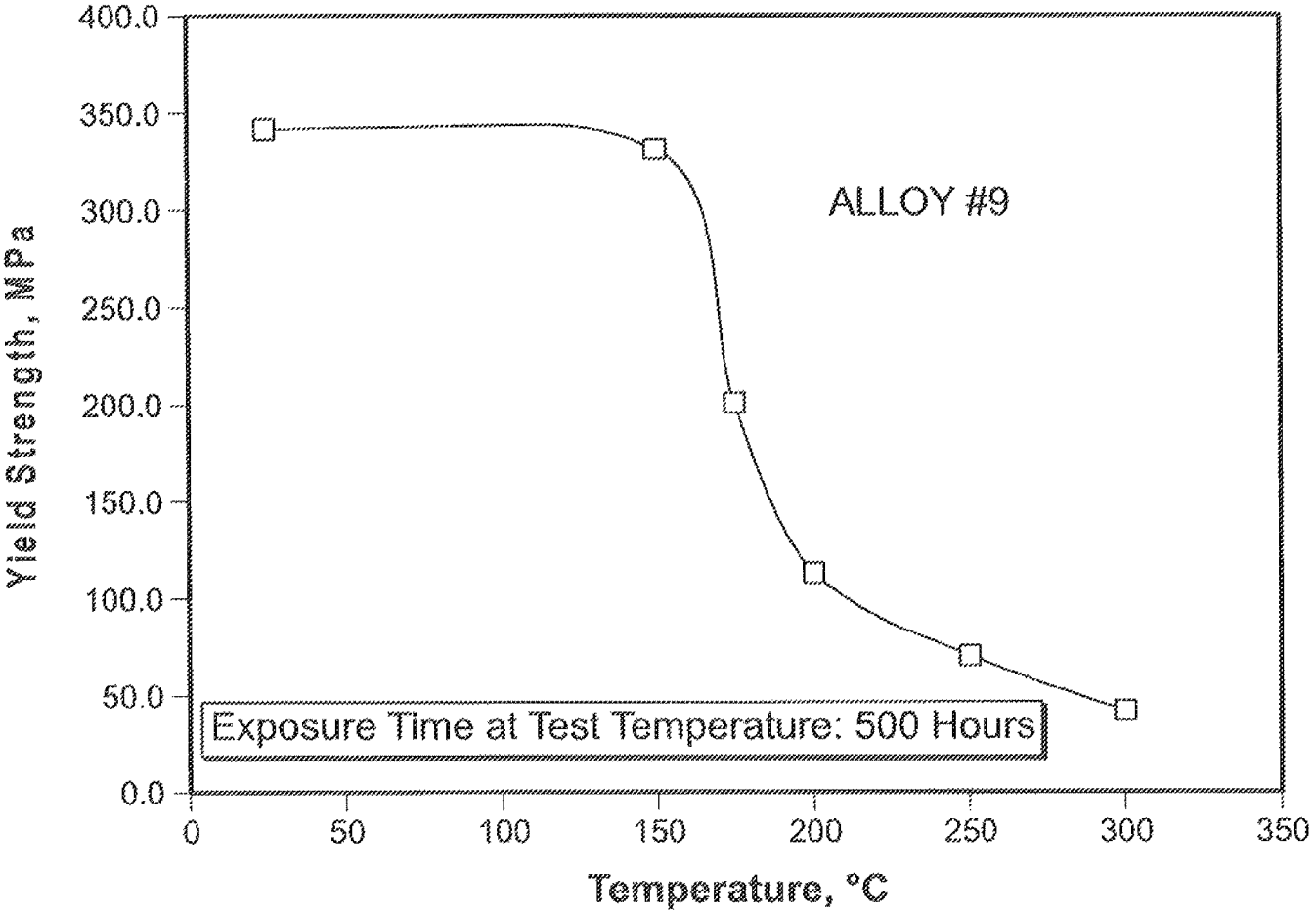
FIG. 26 is a graph of tensile properties of a specific alloy (alloy 9) after exposure to high temperatures.

Because alloys such as those described in the present disclosure may be utilized in applications wherein they are exposed to high temperatures, such as in engines in the form of engine blocks, cylinder heads, pistons, etc., it is of interest to assess how such alloys behave when exposed to high temperatures. FIG. 26 shows a graph of tensile properties of an alloy in accordance with the present disclosure, namely, Al-9Si-0.35Mg-1.75Cu (previously referred to as alloy 9, e.g., in FIG. 15) after exposure to various temperatures. As noted, for each test generating data in the graph, the exposure time of the alloys was 500 hours at the indicated temperature. The samples were also tested at the temperature indicated. As shown in the graph, the yield strength of the alloy diminished significantly at temperatures above 150° C. In accordance with the present disclosure, the metal was analyzed to ascertain features associated with the loss in strength due to exposure to increased temperatures.

Figure 27:
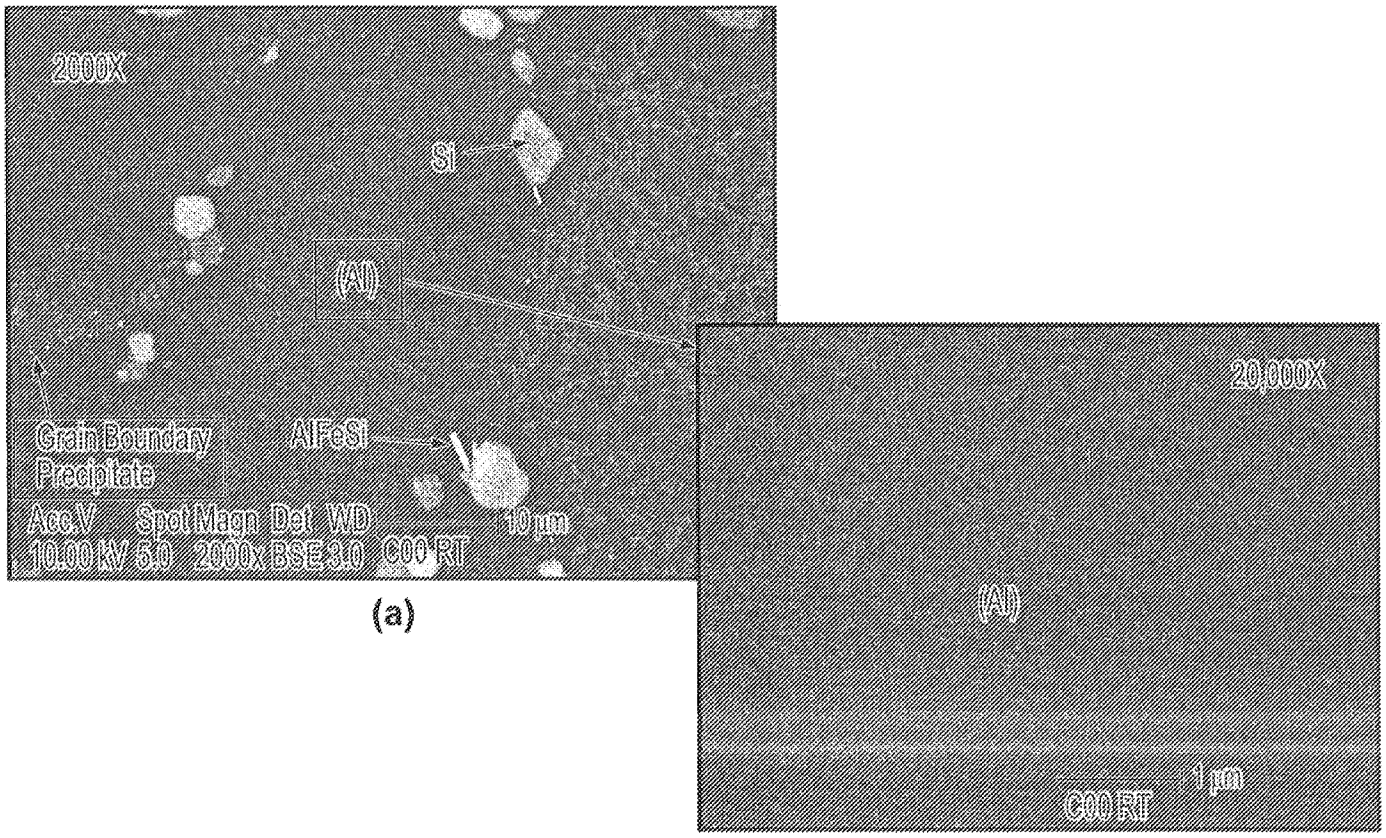
FIGS. 27*a* and 27*b* are scanning electron micrographs of a cross-section of a sample of alloy 9 prior to exposure to high temperatures.
Figure 28:
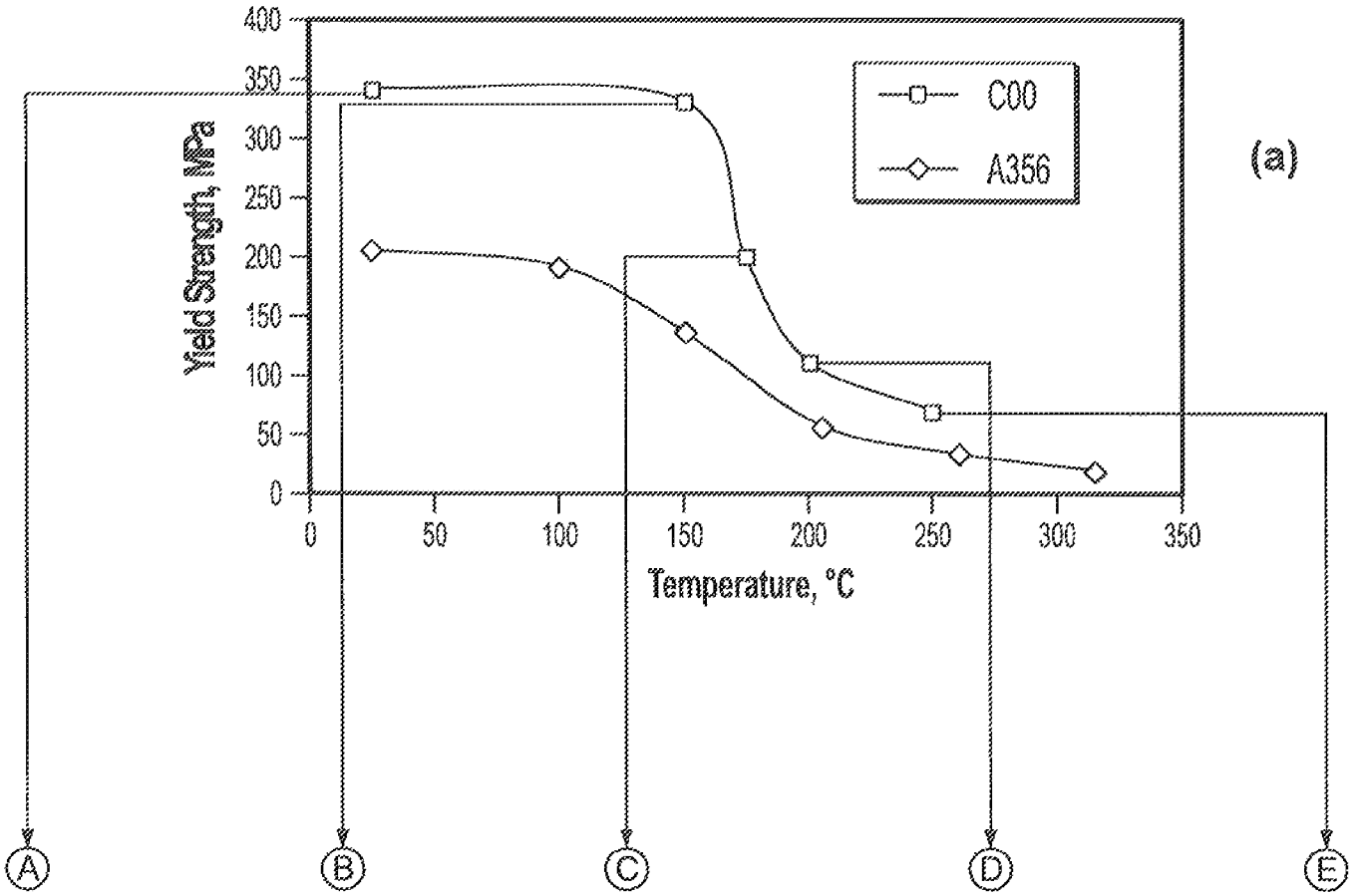
FIGS. 28*a-e* are a series of scanning electron micrographs of a cross-section of alloy 9 after exposure to increasing temperatures correlated to a tensile property graph of alloy 9 and A356 alloy.
Figure 28:
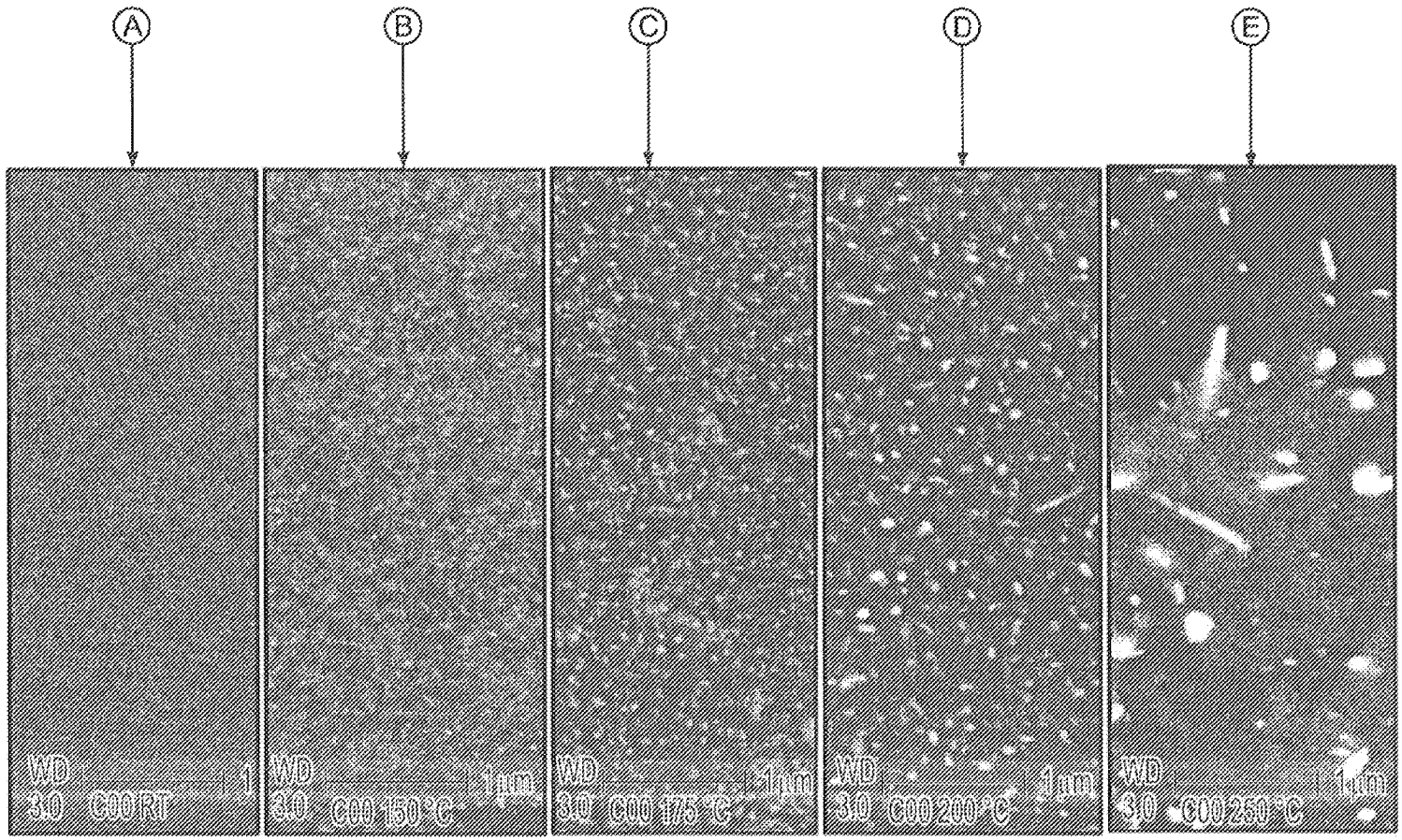

FIGS. 27*a* and 27*b* show scanning electron microscope (SEM) micrographs of a cross-section of a sample of alloy 9 prior to exposure to high temperatures, with 27*b* being an enlarged view of the portion of the micrograph of 31a indicated as "Al". As shown in FIG. 27*a*, the grain boundaries are visible, as well as, Si and AlFeSi particles. The predominately Al portion shown in FIG. 27*b* shows no visible precipitate at 20,000× magnification.

FIGS. 28*a-e* show a series of scanning electron microscope (SEM) micrographs of a cross-section of alloy C00 (previously referred to as alloy 9, e.g., in FIG. 15) of the same scale as the micrograph shown in FIG. 27*b* after exposure to increasing temperatures as shown by the correlation of the micrographs to the data points on the tensile property graph G of alloy 9. The tensile characteristics of A356 alloy in the given temperature range are also shown in graph G for comparison. As can be appreciated from the sequence of micrographs, exposure of alloy 9 to increasing temperatures results in continuously increasing prominence of precipitate particles, which are larger, and which exhibit divergent geometries.

The inventors of the present disclosure recognized that certain alloying elements, viz., Ti, V, Zr, Mn, Ni, Hf, and Fe could be introduced to the C00 alloy (previously referred to as alloy 9, e.g., in FIG. 15) of the present disclosure in small amounts to produce an alloy that resists strength degradation at elevated temperatures.

The following table (Table 10) show 18 alloys utilizing additive elements in small quantities to the C00 alloy (previously referred to as alloy 9, e.g., in FIG. 15) for the purpose of developing improved strength at elevated temperatures.

TABLE 10

Alloy Compositions (all values in weight percent)

| Alloy | Fe | Si | Mn | Cu | Mg | Sr | Ti | B | V | Zr | Ni | Hf |
|---|---|---|---|---|---|---|---|---|---|---|---|---|
| C00 | 0.08 | 9.29 | 0 | 1.83 | 0.37 | 0.0125 | 0.05 | | 0 | 0 | 0 | 0 |
| C01 | 0.15 | 9.3 | 0.002 | 1.82 | 0.002 | 0.008 | 0.11 | 0.0047 | 0.012 | 0.002 | 0 | 0 |
| C02 | 0.15 | 9.35 | 0.002 | 1.82 | 0.39 | 0.008 | 0.11 | 0.0043 | 0.012 | 0.002 | 0 | 0 |
| C03 | 0.15 | 9.05 | 0.002 | 1.77 | 0.37 | 0.007 | 0.11 | 0.0051 | 0.13 | 0.002 | 0 | 0 |
| C04 | 0.16 | 8.95 | 0.002 | 1.77 | 0.36 | 0.006 | 0.1 | 0.0026 | 0.1 | 0.091 | 0 | 0 |
| C05 | 0.16 | 8.86 | 0.002 | 1.76 | 0.36 | 0.005 | 0.1 | 0.0016 | 0.13 | 0.15 | 0 | 0 |
| C06 | 0.16 | 8.54 | 0.002 | 1.72 | 0.35 | 0.004 | 0.1 | 0.005 | 0.13 | 0.18 | 0 | 0 |
| C07 | 0.16 | 9.31 | 0.15 | 1.8 | 0.34 | 0.004 | 0.11 | 0.0044 | 0.025 | 0.016 | 0 | 0 |
| C08 | 0.16 | 9.32 | 0.16 | 1.84 | 0.34 | 0.004 | 0.11 | 0.0051 | 0.025 | 0.017 | 0 | 0 |
| C09 | 0.17 | 9.1 | 0.28 | 1.8 | 0.33 | 0.003 | 0.11 | 0.005 | 0.025 | 0.016 | 0 | 0 |
| C10 | 0.32 | 9.26 | 0.3 | 1.83 | 0.34 | 0.003 | 0.11 | 0.0045 | 0.024 | 0.017 | 0 | 0 |
| C11 | 0.49 | 8.96 | 0.3 | 1.78 | 0.32 | 0.003 | 0.12 | 0.0055 | 0.11 | 0.016 | 0 | 0 |
| C12 | 0.56 | 8.97 | 0.3 | 1.79 | 0.32 | 0.002 | 0.1 | 0.0039 | 0.11 | 0.12 | 0 | 0 |
| C13 | 0.15 | 9.28 | 0.003 | 1.82 | 0.33 | 0.0125 | 0.1 | 0.005 | 0.001 | 0.002 | 0.28 | 0 |
| C14 | 0.2 | 9.28 | 0.004 | 1.81 | 0.33 | 0.004 | 0.1 | 0.0026 | 0.012 | 0.002 | 0.28 | 0 |
| C15 | 0.31 | 9.27 | 0.03 | 1.82 | 0.33 | 0.004 | 0.1 | 0.0032 | 0.012 | 0.002 | 0.28 | 0 |
| C16 | 0.32 | 9.14 | 0.1 | 1.79 | 0.32 | 0.003 | 0.1 | 0.0032 | 0.012 | 0.003 | 0.27 | 0.1 |
| C17 | 0.32 | 8.88 | 0.12 | 1.75 | 0.3 | 0.003 | 0.1 | 0.0031 | 0.11 | 0.013 | 0.26 | 0.1 |
| C18 | 0.32 | 8.89 | 0.14 | 1.76 | 0.3 | 0.003 | 0.1 | 0.003 | 0.11 | 0.036 | 0.27 | 0.1 |

Table 11 shows the mechanical properties of the foregoing alloys, viz., ultimate tensile strength (UTS), total yield strength (TYS) and Elongation % at 300° C., 175° C. and room temperature (RT).

TABLE 11

Mechanical Properties at Various Temperatures

| | 300° C. | | | | | | | | |
|---|---|---|---|---|---|---|---|---|---|
| Alloy | UTS (ksi) | | | TYS (ksi) | | | Elong. (%) | | |
| C00 | 8.2 | 8.4 | 8.3 | 6 | 6.3 | 6 | 49 | 54 | 29.5 |
| C01 | 9.3 | 9.5 | 9.6 | 6.5 | 6.4 | 6.7 | 63 | 54.5 | 49.5 |
| C02 | 10 | 10.3 | 9 | 6.9 | 7.2 | 6.5 | 51.5 | 40.5 | 40.5 |
| C03 | 8.8 | 10.2 | 10.6 | 6.8 | 7.2 | 7.5 | 52 | 43.5 | 56.5 |
| C04 | 10.4 | 10.3 | 11.7 | 7.9 | 7.4 | 8 | 47.5 | 47 | 41.5 |
| C05 | 10.8 | 10.7 | 11.1 | 8.5 | 8 | 8.2 | 47 | 41.5 | 36.5 |
| C06 | 11 | 9.3 | 11.2 | 7.7 | 7.1 | 8.5 | 35 | 36 | 42.5 |
| C07 | 10.5 | 10.6 | 10.3 | 8.1 | 8 | 7.7 | 53 | 40 | 43.5 |
| C08 | 10 | 9.7 | 10.6 | 7.5 | 6.7 | 7.9 | 39 | 40.5 | 36.5 |
| C09 | 10.3 | 10.8 | 11.7 | 7.5 | 7.8 | 8.6 | 35 | 35 | 36 |
| C10 | 10.7 | 10.7 | 11.3 | 8.1 | 8 | 8.3 | 37 | 40 | 33 |
| C11 | 11 | 11.3 | 10.5 | 7.9 | 8.1 | 7.7 | 27.5 | 30.5 | 34.5 |
| C12 | 11.7 | 10.8 | 11.4 | 8.2 | 7.9 | 8.2 | 33 | 28.5 | 34.5 |
| C13 | 10.2 | 9 | 9.4 | 7.5 | 6.9 | 7 | 45.5 | 53 | 40 |
| C14 | 9.3 | 9.2 | 9.9 | 6.6 | 6.6 | 6.9 | 56 | 44 | 42.5 |
| C15 | 10 | 9.8 | 10 | 7.2 | 7.2 | 7.2 | 46.5 | 32 | 31.5 |
| C16 | 10.3 | 10.3 | 10.1 | 7.7 | 7.5 | 7.5 | 44.5 | 36.5 | 34.5 |
| C17 | 10.5 | 9.4 | 10 | 7.5 | 7.2 | 7.2 | 46.5 | 42.5 | 29.5 |
| C18 | 10.1 | 11.4 | 11.3 | 7.5 | 8.6 | 8.2 | 29 | 28.5 | 25.5 |

| | 175° C. | | | | | | | | |
|---|---|---|---|---|---|---|---|---|---|
| Alloy | UTS (ksi) | | | TYS (ksi) | | | Elongation (%) | | |
| C00 | 34.8 | 33.7 | 37.1 | 28.8 | 27.8 | 31 | 8.5 | 10.5 | 10.5 |
| C01 | 28.1 | 31 | 29.4 | 21.4 | 23.7 | 21.8 | 16.6 | 24 | 14.9 |
| C02 | 43.6 | 46.2 | 46.1 | 38 | 39.6 | 40.2 | 6.9 | 5.1 | 5.1 |
| C03 | 44.9 | 43.1 | 45.4 | 40.6 | 37.4 | 39.8 | 0.6 | 7.4 | 4 |
| C04 | 46.5 | 46.5 | 48.3 | 40.6 | 41 | 42.8 | 6.9 | 9.1 | 4.6 |
| C05 | 40 | 47.4 | 47 | 35.4 | 40.7 | 39.9 | 2.9 | 5.1 | 5.1 |
| C06 | 44.3 | 43.6 | 46.6 | 38.4 | 37.4 | 40.9 | 5.7 | 8 | 3.4 |
| C07 | 48.3 | 46.7 | 43 | 41.6 | 40.8 | 38 | 6.3 | 2.3 | 6.9 |

TABLE 11-continued

| Mechanical Properties at Various Temperatures | | | | | | | | | |
|---|---|---|---|---|---|---|---|---|---|
| C08 | 49.3 | 41.8 | 42.6 | 41.2 | 36.5 | 36.6 | 6.3 | 2.3 | 6.9 |
| C09 | 39 | 45.2 | 43.9 | 33.7 | 39.2 | 38.6 | 3.4 | 3.4 | 2.3 |
| C10 | 35.7 | 43.6 | 48.6 | 30.9 | 37.3 | 41.9 | 2.3 | 3.4 | 2.3 |
| C11 | 42.4 | 42.5 | 47.6 | 36.5 | 35.8 | 41.1 | 1.1 | 2.3 | 2.3 |
| C12 | 37.9 | 37.3 | 37.3 | 35.3 | 31.7 | 31.2 | 1.1 | 1.7 | 4 |
| C13 | 45.3 | 45.2 | 41.3 | 39.2 | 38.2 | 35 | 2.9 | 6.3 | 8 |
| C14 | 34.3 | 38.6 | 45.7 | 32.3 | 32.4 | 39 | 0.6 | 9.1 | 5.1 |
| C15 | 40.1 | 45.2 | 44.7 | 34.2 | 38.5 | 37.6 | 2.9 | 5.1 | 3.4 |
| C16 | 42.3 | 41.6 | 41.7 | 35.4 | 35.2 | 35.9 | 4 | 5.1 | 2.3 |
| C17 | 42.6 | 38.4 | 39.5 | 21.8 | 38 | 34.2 | 14.9 | 6.9 | 2.3 |
| C18 | 37.2 | 41.4 | 41.5 | 35.1 | 34.6 | 34.7 | 1.1 | 5.1 | 3.4 |

| | Room Temperature | | | | | | | | |
|---|---|---|---|---|---|---|---|---|---|
| Alloy | UTS (ksi) | | | TYS (ksi) | | | Elongation (%) | | |
| C00 | 58.4 | 56.5 | 47.7 | 52.4 | 4 | 4 | 58.4 | 56.5 | 47.7 |
| C01 | 37.7 | 38.4 | 20.1 | 20.9 | 9 | 12 | 37.7 | 38.4 | 20.1 |
| C02 | 60.2 | 56.7 | | 46.2 | 3 | 3 | 60.2 | 56.7 | |
| C03 | 50.5 | 59.8 | 48.7 | 50.3 | 3 | 5.5 | 50.5 | 59.8 | 48.7 |
| C04 | 58.7 | 57.5 | 49.7 | 48.1 | 3 | 1 | 58.7 | 57.5 | 49.7 |
| C05 | 52.4 | 58.2 | 51.1 | 47.7 | 1 | 3 | 52.4 | 58.2 | 51.1 |
| C06 | 57.9 | 59.1 | 48.2 | 48.8 | 3 | 4 | 57.9 | 59.1 | 48.2 |
| C07 | 57 | 58.3 | 48.1 | | 3.5 | 3.5 | 57 | 58.3 | 48.1 |
| C08 | 58.6 | 52 | 46.2 | 48.2 | 3.5 | 3 | 58.6 | 52 | 46.2 |
| C09 | 52 | 58.1 | 47.9 | 48.5 | 3 | 3 | 52 | 58.1 | 47.9 |
| C10 | 55 | 55.6 | 47.7 | 49.6 | 3 | 3 | 55 | 55.6 | 47.7 |
| C11 | 54.1 | 52.6 | 49.3 | 49.1 | 3 | 3 | 54.1 | 52.6 | 49.3 |
| C12 | 50.2 | 52.7 | 48.5 | 50.6 | 1 | 1.5 | 50.2 | 52.7 | 48.5 |
| C13 | 56.3 | 58.5 | 48.1 | 45.9 | 2.5 | 8 | 56.3 | 58.5 | 48.1 |
| C14 | 61.3 | 57.1 | 44.3 | 44.5 | 8 | 4 | 61.3 | 57.1 | 44.3 |
| C15 | 56.7 | 55.8 | 45.9 | 47.1 | 4 | 4 | 56.7 | 55.8 | 45.9 |
| C16 | 57.4 | 53.7 | 46.4 | 46 | 4 | 3 | 57.4 | 53.7 | 46.4 |
| C17 | 57.2 | 56.1 | 47.1 | 46.9 | 3 | 3 | 57.2 | 56.1 | 47.1 |
| C18 | 48.5 | 50.6 | 45.1 | 46.9 | 2 | 2 | 48.5 | 50.6 | 45.1 |

Figure 29:
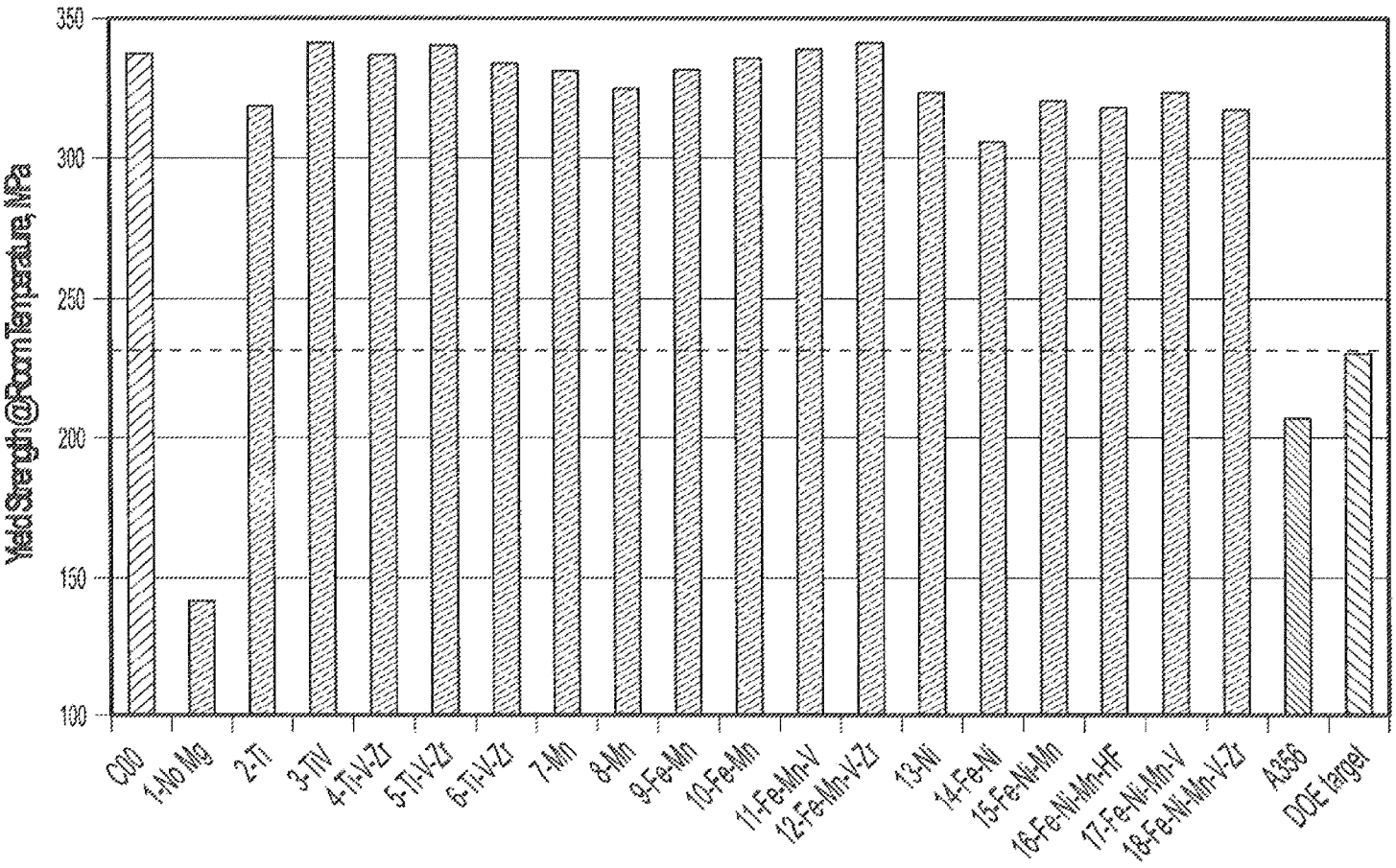
FIG. 29 is a graph of yield strength at room temperature for various alloys.

FIG. 29 shows a graph of yield strength at room temperature for foregoing alloys. A356 is shown for comparison. In addition, a department of energy (DOE) published target for strength improvement is shown for comparison [Predictive Modeling for Automotive Light weighting Applications and Advanced Alloy Development for Automotive and Heavy-Duty Engines, Issue by Department of Energy on Mar. 3, 2012]. As can be appreciated, the C00 alloy is comparable in strength at room temperature to alloys C02-C18, all of which substantially exceed the strength of the A356 alloy and the DOE target properties. Alloy C01-without substantial quantities of Mg, has a far lower yield strength.

Figure 30:
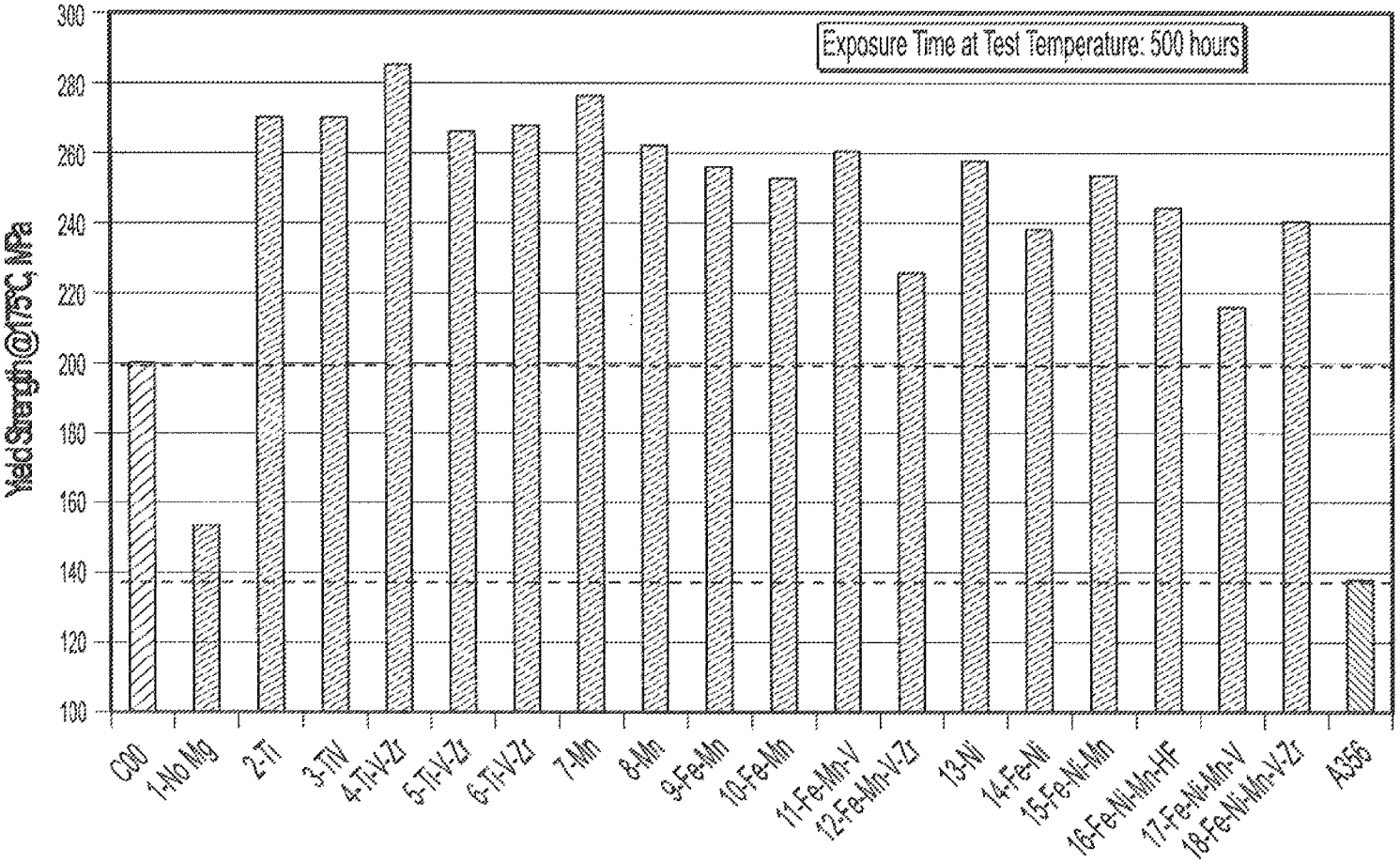
FIG. 30 is a graph of yield strength after exposure to 175° C. for various alloys.

FIG. 30 is a graph of yield strength after exposure to 175° C. for 500 hours for the foregoing alloys. The C00, as well as A356 are shown for comparison. As can be appreciated, the C00 alloy substantially exceeds the strength of the A356 alloy. Alloys C02-C18), all show marked improvement over both A356 and C00.

Figure 31:
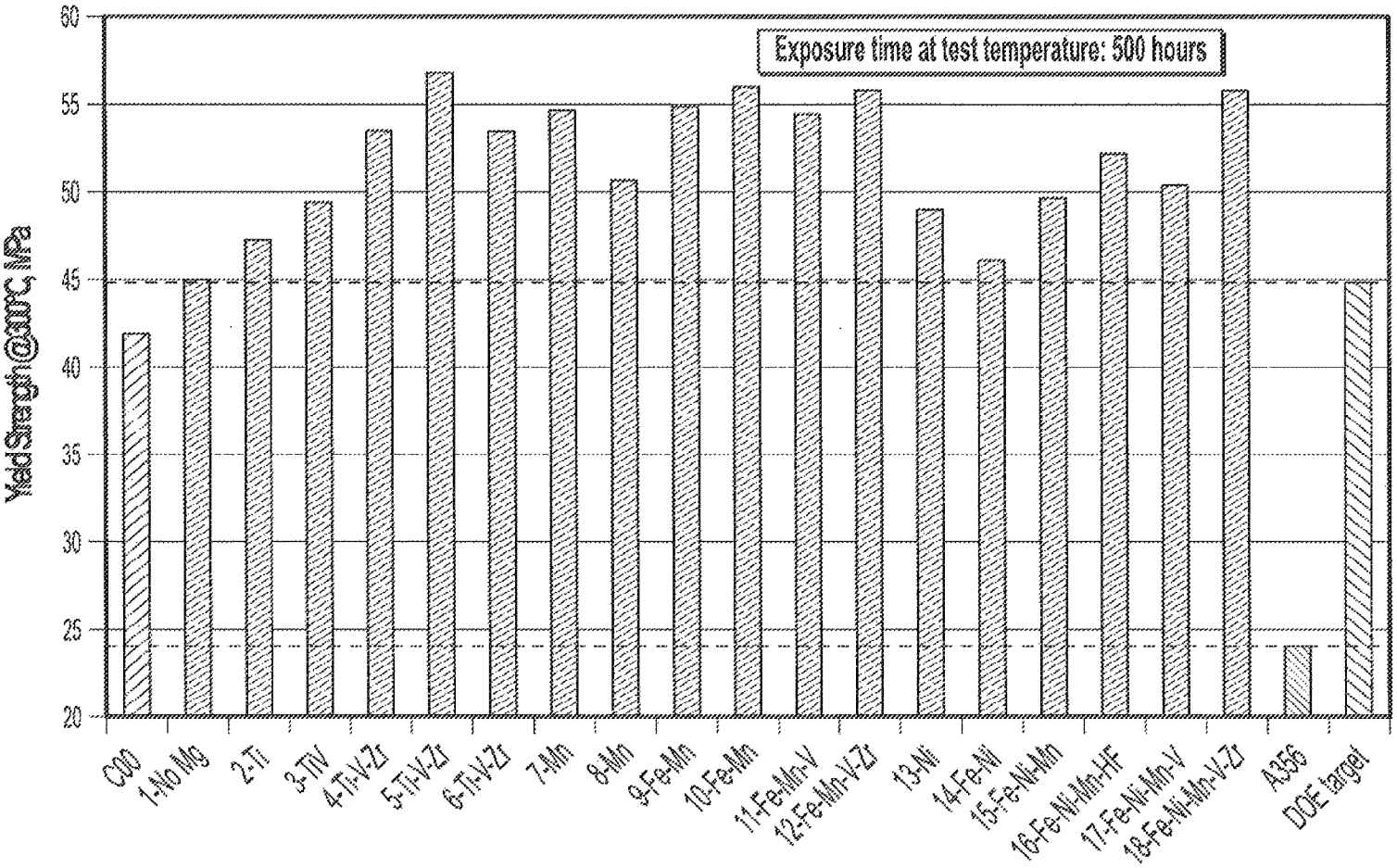
FIG. 31 is a graph of yield strength after exposure to 300° C. for various alloys.
Figure 32:
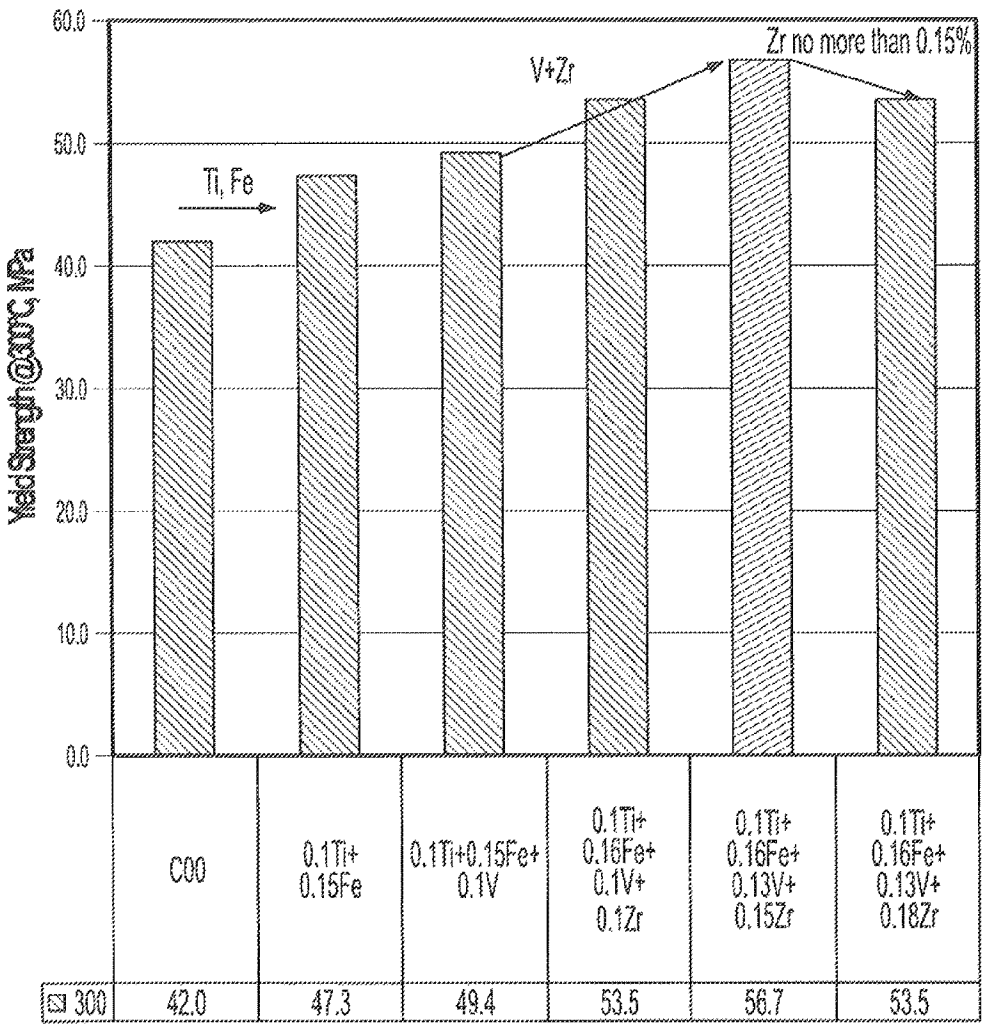
FIG. 32 is a graph of yield strength after exposure to 300° C. for various alloys.

FIG. 31 is a graph of yield strength after exposure to 300° C. for 500 hours for the foregoing alloys. C00, as well as A356 are shown for comparison. FIG. 32 shows is a graph of yield strength after exposure to 300° C. for various alloys. More particularly, adjacent alloys (going in the direction of the arrows) show the result of an additional element or the increase in quantity of an element. The highest result in the graph of FIG. 32 is for C00+0.1T+0.16Fe+0.13V+0.15Zr. The addition of more Zr (to 0.18%) to this combination results in decreased performance.

Figure 33:
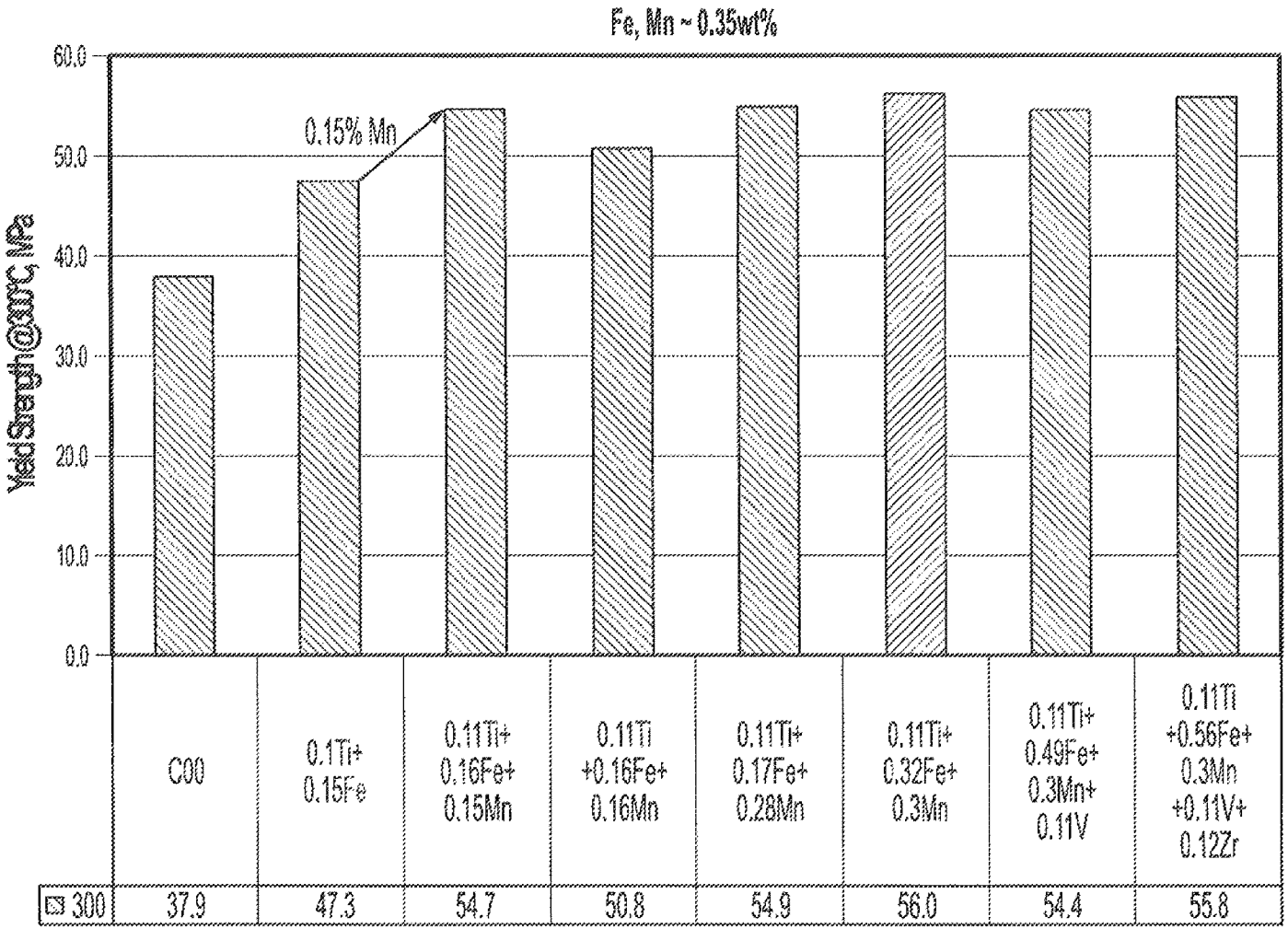
FIG. 33 is a graph of yield strength after exposure to 300° C. for various alloys.

FIG. 33 is a graph of yield strength after exposure to 300° C. for various alloys for 500 hours. The graphs show improvements due to the addition of Ti, Fe and Mn to the C00 composition, with the maximum performance noted relative to C00+0.11Ti+0.32Fe+0.3Mn. The addition of V to the foregoing reduces performance and the further addition of 0.12 Zr brings performance almost back to the maximum level.

Figure 34:
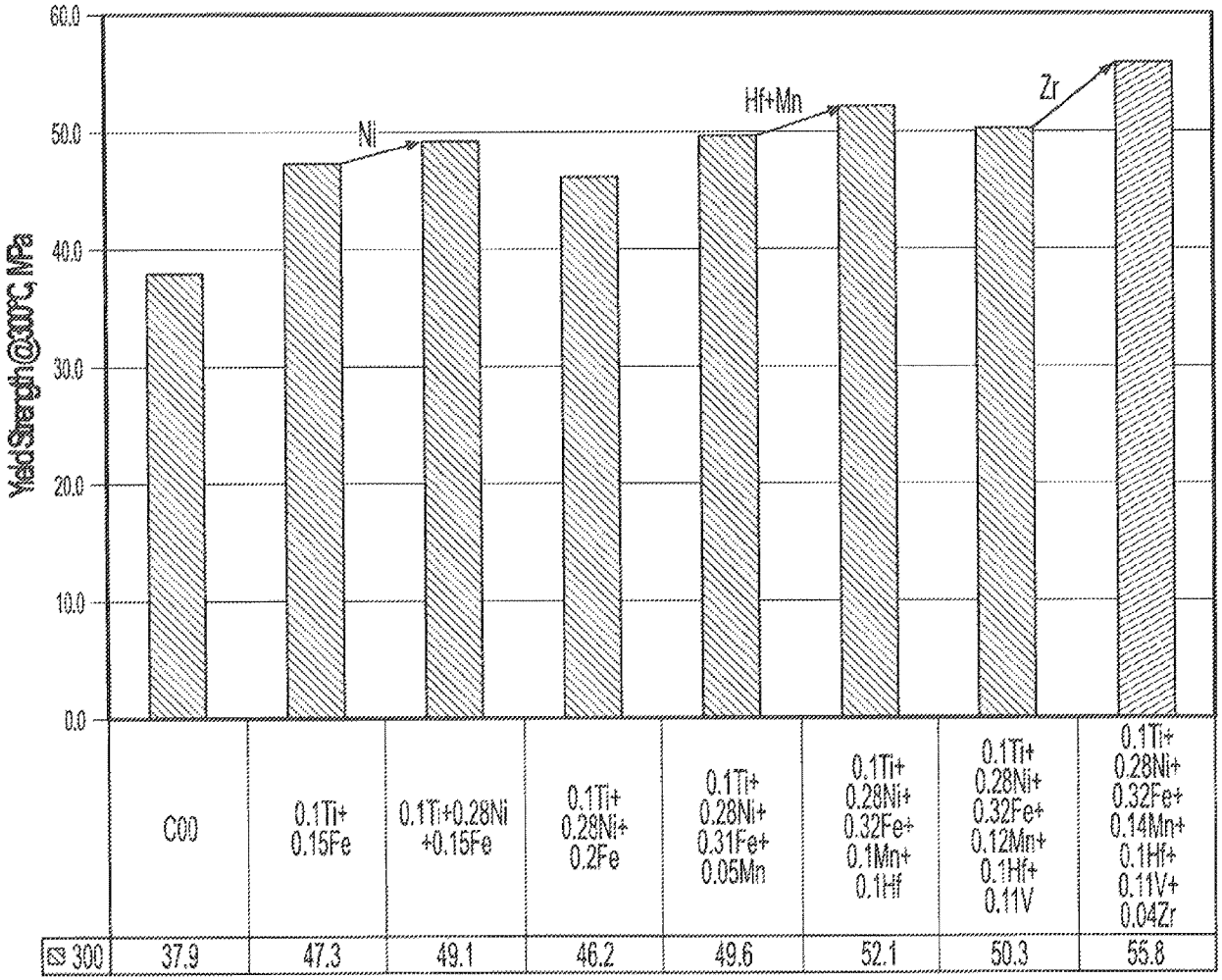
FIG. 34 is a graph of yield strength after exposure to 300° C. for various alloys.

FIG. 34 is a graph of yield strength after exposure to 300° C. for various alloys, i.e., due to the addition of elements to the C00 composition. The optimal performance is noted relative to C00+0.1Ti+0.28Ni+0.32 Fe+0.14Mn+0.1Hf+0.11V+0.04Zr.

EXAMPLE 3

Cast Alloys for Semi-Permanent Mold Cylinder Head Applications

High strength at elevated temperature and very good castability make the C05 alloy (TABLE 10) an excellent candidate for cylinder head applications, e.g., for internal combustion engines. Plant-scale trials for the C05 alloy (TABLE 10) were conducted. Cylinder head castings were made using a gravity semi-permanent mold casting process. The actual compositions are listed in Table 12.

TABLE 12

| Actual Composition of Example 3 Alloys | | | | | | | | | | |
|---|---|---|---|---|---|---|---|---|---|---|
| Alloy | Si | Fe | Cu | Mn | Mg | Ti | V | Zr | Sr | B |
| D1 | 8.97 | 0.12 | 1.91 | 0.13 | 0.38 | 0.11 | 0.085 | 0.085 | 0.01 | 0 |
| D2 | 9.14 | 0.14 | 1.98 | 0.14 | 0.37 | 0.11 | 0.094 | 0.1 | 0.011 | 0.0011 |

Tensile specimen blocks were cut from the combustion chamber area. They were solution heat treated using following practice:

2-hr log to 940° F. (504.4° C.)+940° F.(504.4° C.)/2 hrs+30 minutes ramp up to 986° F.(530° C.)+986° F.(530° C.)/4 hrs+CWQ Three artificial aging practices, 190° C./6 hrs, 205° C./6 hrs and 220° C./6 hrs, were evaluated and the mechanical property results are shown in Table 13.

TABLE 13

| Mechanical Properties of Example 3 Alloys | | | |
|---|---|---|---|
| Artificial Aging Condition | Tensile Yield Strength (MPa) | Ultimate Tensile Strength (MPa) | Elongation (%) |
| 190° C./6 hrs | 332 | 386 | 2 |
| 190° C./6 hrs | 336 | 387 | 2 |
| 205° C./6 hrs | 320 | 362 | 2 |
| 205° C./6 hrs | 326 | 369 | 3 |
| 220° C./6 hrs | 273 | 322 | 2 |
| 220° C./6 hrs | 281 | 335 | 3 |

The foregoing alloy compositions may also be used to form cylinder heads by high pressure die casting (HPDC) methods and using T5 tempering procedures.

EXAMPLE 4

Cast Alloys for HPDC Engine Block Applications

In accordance with another embodiment of the present disclosure, the disclosed aluminum alloys may be used to cast cylinder blocks, e.g., for internal combustion engines. Since the engine block is the main contributor to engine mass, use of the disclosed alloys for the engine block may result in significant weight reduction, e.g., up to 45% weight reduction for gasoline engines, compared to engines made from cast-iron. Engines having lower mass translate into improved performance, better fuel economy and reduced emissions. For mass engine production, high-pressure die-casting (HPDC) process is widely used for high production rates and reduced production costs.

HPDC engine block casting methods frequently employ T5 temper practices. The alloys of the present disclosure may be tempered using T5 practices. Note that this approach does not employ a high-temperature solution heat treatment and quench. In accordance with an embodiment of the present disclosure, six alloys having the compositions shown in Table 14 were prepared, cast into a modified ASTM tensile bar mold.

TABLE 14

Actual Composition of Example 4 Alloys (weight percent)

| Alloy | Si | Cu | Mg | Fe | Mn | Ti | V | Zr | Sr | B |
|---|---|---|---|---|---|---|---|---|---|---|
| R1 | 9.32 | 0.55 | 0.22 | 0.13 | 0.48 | 0.13 | 0.13 | 0.14 | 0.012 | 0.002 |
| R2 | 9.25 | 0.54 | 0.42 | 0.13 | 0.52 | 0.13 | 0.13 | 0.14 | 0.012 | 0.002 |
| R3 | 9.24 | 1.02 | 0.21 | 0.16 | 0.53 | 0.13 | 0.12 | 0.10 | 0.012 | 0.002 |
| R4 | 9.41 | 1.02 | 0.41 | 0.17 | 0.53 | 0.14 | 0.12 | 0.10 | 0.012 | 0.002 |
| R5 | 9.14 | 1.53 | 0.22 | 0.16 | 0.53 | 0.11 | 0.12 | 0.12 | 0.012 | 0.002 |
| R6 | 9.27 | 1.52 | 0.43 | 0.16 | 0.53 | 0.12 | 0.12 | 0.12 | 0.012 | 0.002 |

The weight ratio of Fe:Mn for all alloys was from 0.25 to 0.32.

Sixty (60) tensile bar specimens were made for each composition. After the specimens were completely solidified, half were water quenched, and the other half were air cooled. The physical attributes of the resultant specimens were then tested and are also described below. Three different artificial aging practices, 175° C./6 hrs, 190° C./6 hrs and 205° C./6 hrs, were evaluated for both water quenched and air-cooled specimens.

Tables 15, 16 and 17 list average yield strength, ultimate tensile strength and elongation, respectively, for air-cooled specimens aged at different conditions. Table 15 shows the effect of Cu, Mg and aging condition on yield strength of the Al-9Si-0.15Fe-0.55Mn—Cu—Mg alloys. After being completely solidified, the tensile bar castings were cooled in the air. As shown in Table 15, Mg and Cu content showed significant impact on yield strength. Alloys with 0.4% Mg and 1.0-1.5% Cu showed higher yield strength than other alloys.

Table 16 shows the effect of Cu, Mg and aging condition on ultimate tensile strength of the Al-9Si-0.15Fe-0.55Mn—Cu—Mg alloys. After being completely solidified, tensile bar castings were cooled in the air. Table 16 shows the effect of Cu, Mg and aging condition on elongation of the Al-9Si-0.15Fe-0.55Mn—Cu—Mg alloys. After being completely solidified, tensile bar castings were cooled in the air. As shown in Tables 16-17, increasing Mg and Cu will slightly increase UTS, and decrease elongation. For air cooled specimens, the highest achieved yield strength in the T5 condition was about 190 MPa.

TABLE 15

Yield Strength for R1-R6 Alloys (Air Cool) at Various Artificial Aging Conditions

| | Average Tensile Yield Strength | | | Standard Deviation | | |
|---|---|---|---|---|---|---|
| Alloy | 175° C./6 hrs | 190° C./6 hrs | 205° C./6 hrs | 175° C./6 hrs | 190° C./6 hrs | 205° C./6 hrs |
| R1 | 150 | 178 | 172 | 6.2 | 9.0 | 23.4 |
| R3 | 142 | 150 | 149 | 1.4 | 3.4 | 1.4 |
| R5 | 174 | 198 | 179 | 4.1 | 4.8 | 12.4 |
| R2 | 179 | 167 | 185 | 2.1 | 13.1 | 2.1 |
| R4 | 188 | 197 | 194 | 0.7 | 2.1 | 6.9 |
| R6 | 200 | 194 | 195 | 9.6 | 6.9 | 8.3 |

TABLE 16

Tensile Strength for R1-R6 Alloys (Air Cool) at Various Artificial Aging Conditions

| | Average Ultimate Tensile Strength | | | Standard Deviation | | |
|---|---|---|---|---|---|---|
| Alloy | 175° C./6 hrs | 190° C./ 6 hrs | 205° C./ 6 hrs | 175° C./6 hrs | 190° C./ 6 hrs | 205° C./ 6 hrs |
| R1 | 223 | 248 | 269 | 14.5 | 22.7 | 22.0 |
| R3 | 241 | 240 | 234 | 2.1 | 7.6 | 17.2 |
| R5 | 263 | 251 | 229 | 3.4 | 19.3 | 33.8 |
| R2 | 251 | 249 | 243 | 9.0 | 26.2 | 4.8 |
| R4 | 243 | 234 | 249 | 26.2 | 19.3 | 9.6 |
| R6 | 243 | 269 | 237 | 17.9 | 11.0 | 29.6 |

TABLE 17

Elongation for R1-R6 Alloys (Air Cool) at Various Artificial Aging Conditions

| | Average Elongation | | | Standard Deviation | | |
|---|---|---|---|---|---|---|
| Alloy | 175° C./6 hrs | 190° C./ 6 hrs | 205° C./ 6 hrs | 175° C./6 hrs | 190° C./ 6 hrs | 205° C./ 6 hrs |
| R1 | 2.50 | 2.17 | 3.50 | 0.50 | 0.76 | 1.32 |
| R3 | 2.83 | 2.33 | 2.00 | 0.29 | 0.29 | 0.87 |
| R5 | 2.50 | 1.67 | 1.17 | 0.00 | 0.29 | 0.29 |
| R2 | 2.17 | 2.67 | 1.83 | 0.58 | 0.29 | 0.29 |
| R4 | 1.83 | 1.33 | 1.67 | 0.58 | 0.29 | 0.29 |
| R6 | 1.33 | 1.50 | 1.50 | 0.29 | 0.87 | 0.50 |

Tables 18, 19 and 20 list average yield strength, ultimate tensile strength and elongation, respectively, for warm water quenched specimens aged at different conditions. Table 18 shows the effect of Cu, Mg and aging condition on yield strength of the Al-9Si-0.15Fe-0.55Mn—Cu—Mg alloys. After being completely solidified, the tensile bar castings were cooled in warm water. As shown in Table 18, Mg and Cu content showed significant impact on yield strength. Table 19 shows the effect of Cu, Mg and aging condition on ultimate tensile strength of the Al-9Si-0.15Fe-0.55Mn—Cu—Mg alloys. After being completely solidified, the tensile bar castings were cooled in warm water. Table 20 shows the effect of Cu, Mg and aging condition on elongation of the Al-9Si-0.15Fe-0.55Mn—Cu—Mg alloys. After being completely solidified, the tensile bar castings were cooled in warm water.

Alloys with 0.4% Mg and 1.0-1.5% Cu showed higher yield strength than other alloys. For warm water quenched specimens, the highest achieved yield strength in the T5 condition was about 260 MPa.

TABLE 18

Yield Strength for R1-R6 Alloys (Water Cool) at Various Artificial Aging Conditions

| | Average Tensile Yield Strength | | | Standard Deviation | | |
|---|---|---|---|---|---|---|
| Alloy | 175° C./6 hrs | 190° C./ 6 hrs | 205° C./ 6 hrs | 175° C./6 hrs | 190° C./ 6 hrs | 205° C./ 6 hrs |
| R1 | 194 | 201 | 193 | 2.1 | 2.8 | 4.1 |
| R3 | 195 | 205 | 180 | 16.5 | 10.3 | 7.6 |
| R5 | 246 | 232 | 222 | 17.9 | 22.0 | 3.4 |
| R2 | 227 | 234 | 232 | 6.2 | 11.7 | 7.6 |
| R4 | 256 | 261 | 243 | 6.2 | 6.2 | 23.4 |
| R6 | 239 | 267 | 251 | 5.5 | 6.9 | 15.8 |

TABLE 19

Tensile Strength for R1-R6 Alloys (Water Cool) at Various Artificial Aging Conditions

| | Average Ultimate Tensile Strength | | | Standard Deviation | | |
|---|---|---|---|---|---|---|
| Alloy | 175° C./6 hrs | 190° C./ 6 hrs | 205° C./ 6 hrs | 175° C./6 hrs | 190° C./ 6 hrs | 205° C./ 6 hrs |
| R1 | 285 | 298 | 274 | 9.0 | 19.3 | 4.8 |
| R3 | 268 | 283 | 235 | 30.3 | 18.6 | 46.9 |

TABLE 19-continued

Tensile Strength for R1-R6 Alloys (Water Cool) at Various Artificial Aging Conditions

| | Average Ultimate Tensile Strength | | | Standard Deviation | | |
|---|---|---|---|---|---|---|
| Alloy | 175° C./6 hrs | 190° C./ 6 hrs | 205° C./ 6 hrs | 175° C./6 hrs | 190° C./ 6 hrs | 205° C./ 6 hrs |
| R5 | 289 | 274 | 247 | 7.6 | 18.6 | 2.1 |
| R2 | 294 | 278 | 278 | 11.0 | 28.9 | 9.6 |
| R4 | 306 | 279 | 291 | 23.4 | 1.4 | 20.7 |
| R6 | 293 | 293 | 291 | 23.4 | 4.1 | 17.2 |

TABLE 20

Elongation for R1-R6 Alloys (Water Cool) at Various Artificial Aging Conditions

| | Average Elongation | | | Standard Deviation | | |
|---|---|---|---|---|---|---|
| Alloy | 175° C./6 hrs | 190° C./ 6 hrs | 205° C./ 6 hrs | 175° C./6 hrs | 190° C./ 6 hrs | 205° C./ 6 hrs |
| R1 | 2.7 | 3.7 | 3.0 | 0.8 | 1.4 | 0.5 |
| R3 | 2.2 | 2.5 | 2.2 | 0.6 | 0.5 | 1.6 |
| R5 | 1.7 | 1.3 | 1.3 | 0.3 | 0.6 | 0.6 |
| R2 | 2.2 | 2.0 | 1.7 | 0.3 | 0.5 | 0.3 |
| R4 | 1.7 | 0.8 | 1.5 | 0.6 | 0.3 | 0.0 |
| R6 | 1.8 | 0.8 | 1.5 | 0.3 | 0.3 | 0.0 |

EXAMPLE 5

Cast Alloys for HPDC Engine Block Applications

Additional high-pressure die-casting (HPDC) tests were completed on two alloys, the compositions of which are shown below in Table 21. The alloys were cast as journal pieces. After casting, various ones of the alloys were quenched in air, while other ones of the alloys were quenched in warm water (≈60° C.). Various ones of the alloys were aged at various times and temperatures, after which various mechanical properties were tested, the results of which are provided in Tables 22-24, below. Strength and elongation were tested using JIS14B test specimens taken from about 1 mm below the casting surface.

TABLE 21

Actual Composition of Example 5 Alloys (weight percent)

| Alloy | Si | Cu | Mg | Fe | Mn | Ti | V | Zr | Sr | B |
|---|---|---|---|---|---|---|---|---|---|---|
| R7 | 9.15 | 0.52 | 0.19 | 0.16 | 0.57 | 0.10 | 0.13 | 0.11 | 0.013 | 0.0018 |
| R8 | 9.24 | 1.10 | 0.41 | 0.17 | 0.53 | 0.11 | 0.12 | 0.13 | 0.014 | 0.0017 |

The weight ratio of Fe:Mn for all alloys was from 0.28 to 0.32.

TABLE 22

T5 properties of Alloys Aged at about 205° C. for about 6 hours (values averages of five specimens; standard deviation shown)

| Alloy | Quench | UTS (MPa) | TYS (MPa) | Elong. (%) |
|---|---|---|---|---|
| R7 | Air | 248.8 ± 9.2 | 136.9 ± 11.1 | 5.6 ± 1.3 |
| R7 | Water | 278.6 ± 4.0 | 177.9 ± 1.2 | 4.4 ± 0.7 |
| R8 | Air | 249.1 ± 10.3 | 140.9 ± 15.7 | 3.8 ± 0.5 |
| R8 | Water | 295.7 ± 4.1 | 210.5 ± 1.5 | 2.7 ± 0.2 |

TABLE 23

T5 properties of Alloys Aged at about 205° C. for various times (values averages of five specimens; standard deviation shown; all water quenched)

| Alloy | Aging Time | UTS (MPa) | TYS (MPa) | Elong. (%) |
|---|---|---|---|---|
| R8 | 2 hours | 298.4 ± 9.5 | 224.0 ± 2.2 | 2.2 ± 0.4 |
| R8 | 4 hours | 300.3 ± 4.0 | 220.3 ± 1.3 | 2.4 ± 0.2 |
| R8 | 6 hours | 295.7 ± 4.1 | 210.5 ± 1.5 | 2.7 ± 0.2 |

TABLE 24

T5 fatigue Properties of Alloy R8 (water quenched and aged at about 205° C. for 6 hours)

| Sample No. | Stress amplitude $\sigma_a$ (MPa) | Number of cycles (Nf) | Condition |
|---|---|---|---|
| 1 | 110 | 1.00E+06 | Fracture |
| 2 | 90 | 1.00E+07 | OK |
| 3 | 93 | 1.00E+07 | Fracture |
| 4 | 93 | 3.998E+06 | Fracture |

TABLE 24-continued

T5 fatigue Properties of Alloy R8 (water quenched and aged at about 205° C. for 6 hours)

| Sample No. | Stress amplitude $\sigma_a$ (MPa) | Number of cycles (Nf) | Condition |
|---|---|---|---|
| 5 | 95 | 1.82E+06 | Fracture |
| 6 | 120 | 3.596E+05 | Fracture |
| 7 | 110 | 7.37E+05 | Fracture |
| 8 | 100 | 2.206E+06 | Fracture |
| 9 | 90 | 1.00E+07 | OK |
| 10 | 100 | 2.915E+06 | Fracture |

The fatigue properties of alloy R8 were measured at room temperature, at a stress ratio of R=−1 ($=\sigma_{min}/\sigma_{max}$) with a frequency of 1500 rpm, and with a mean stress ($\sigma_m$) of zero (0) MPa. The fatigue was 90 MPa at room temperature.

Fatigue strength (staircase fatigue) at about 150° C. was also measured for alloy R8 in one T5 temper, having been water quenched and artificially aged for about 6 hours at about 205° C. Alloy R8 in this type of T5 temper realized a mean fatigue strength of 81.25±7.83 MPa at 150° C. The stress amplitude increment was 5.0 MPa and the convergence factor was 0.94.

It will be understood that the embodiments described herein are merely exemplary and that a person skilled in the art may make many variations and modifications without departing from the spirit and scope of the claimed subject matter. For example, use different aging conditions may produce different resultant characteristics. All such variations and modifications are intended to be included within the scope of the appended claims.

What is claimed is:

1. An aluminum casting alloy consisting of:
8.5-9.5 wt. % silicon;
0.8-1.2 wt. % copper (Cu);
wherein 2.5≤(Cu+10Mg)≤5.8;
0.36-0.53 wt. % magnesium (Mg);
0.35 to 0.8 wt. % manganese;
up to 0.05 wt. % zinc;
up to 0.01 wt. % silver;
up to 0.05 wt. % nickel;
up to 0.01 wt. % hafnium;
0.10-0.35 wt. % iron;
0.03-0.15 wt. % titanium;
0.07-0.30 wt. % zirconium;
0.07-0.30 wt. % vanadium;
wherein 0.14≤Zr+V≤0.40
up to 0.03 wt. % of one or more of strontium, sodium and antimony;
other elements being ≤0.04 wt. % each and ≤0.12 wt. % in total;
the balance being aluminum.

2. The alloy of claim 1, wherein the ratio of iron to manganese is ≤0.5.

3. The alloy of claim 2, wherein the alloy includes from 0.4 to 0.45 wt. % Mg, and wherein 4.7≤(Cu+10Mg)≤5.8.

4. The alloy of claim 3, wherein the alloy includes from 0.10 to 0.30 wt. % Fe.

5. The alloy of claim 4, wherein the alloy includes from 0.45-0.70 wt. % Mn.

6. A method comprising:
(a) introducing the molten aluminum alloy of claim 1 into a mold;
(b) removing a defect-free shape cast article from the mold; and
(c) tempering the shape cast article to one of a T5, T6 or T7 temper.

7. The method of claim 6, wherein the mold is a high pressure die casting mold and the step of introducing is by high pressure die casting.

8. The alloy of claim 5, wherein the alloy includes at least 0.08 wt. % of each of Zr and V.

9. The alloy of claim 5, wherein the alloy includes at least 0.09 wt. % of each of Zr and V.

10. The alloy of claim 8, wherein the alloy includes 0.16-0.35 wt. % of Zr+V.

11. The alloy of claim 9, wherein the alloy includes 0.18-0.35 wt. % of Zr+V.

12. The alloy of claim 9, wherein the alloy includes 0.20-0.30 wt. % of Zr+V.

* * * * *